US011274374B2

(12) United States Patent
Konopka et al.

(10) Patent No.: US 11,274,374 B2
(45) Date of Patent: Mar. 15, 2022

(54) METAL DEPOSITS, COMPOSITIONS, AND METHODS FOR MAKING THE SAME

(71) Applicant: Iontra LLC, Denver, CO (US)

(72) Inventors: Daniel A. Konopka, Denver, CO (US); Li Hsien Chou, Aurora, CO (US)

(73) Assignee: Iontra LLC, Denver, CO (US)

( * ) Notice: Subject to any disclaimer, the term of this patent is extended or adjusted under 35 U.S.C. 154(b) by 0 days.

(21) Appl. No.: 16/438,077

(22) Filed: Jun. 11, 2019

(65) Prior Publication Data

US 2019/0301039 A1 Oct. 3, 2019

Related U.S. Application Data

(62) Division of application No. 15/293,096, filed on Oct. 13, 2016, now abandoned.

(51) Int. Cl.

| | |
|---|---|
| ***C25D 3/20*** | (2006.01) |
| ***C25D 3/10*** | (2006.01) |
| ***C25D 3/12*** | (2006.01) |
| ***C25D 3/22*** | (2006.01) |
| ***C25D 3/26*** | (2006.01) |
| ***C25D 3/32*** | (2006.01) |
| ***C25D 3/38*** | (2006.01) |
| ***C25D 3/58*** | (2006.01) |
| ***C25D 3/66*** | (2006.01) |

(52) U.S. Cl.

CPC ..... *C25D 3/20* (2013.01); *C25D 3/10* (2013.01); *C25D 3/12* (2013.01); *C25D 3/22* (2013.01); *C25D 3/26* (2013.01); *C25D 3/32* (2013.01); *C25D 3/38* (2013.01); *C25D 3/58* (2013.01); *C25D 3/665* (2013.01)

(58) Field of Classification Search

CPC ..... C25D 3/20; C25D 3/665

See application file for complete search history.

(56) References Cited

U.S. PATENT DOCUMENTS

2004/0054231 A1* 3/2004 Abbott ..... C25F 3/24 564/282

* cited by examiner

*Primary Examiner* — Ho-Sung Chung

(74) *Attorney, Agent, or Firm* — Polsinelli PC; Gregory P. Durbin

(57) ABSTRACT

Provided herein is a composition for forming a metal deposit on a substrate. The composition consists essentially of a carboxamide, trialkylamine chloride, and a metal salt. The carboxamide comprises Formula (I). The trialkylamine chloride and the carboxamide are in molar ratio between 1:1 and 1:30 to form an ionic liquid. The trialkylamine chloride is trimethylamine chloride (TMACl), triethylamine chloride (TEACl), triethanolamine chloride, or combinations thereof. The metal salt has the formula $MX_y$, wherein M is a metal, X is a halide, and y is an oxidation number of M, the metal salt being in a concentration between about 0.2 and about 1.5 moles per liter of the ionic liquid. The metal deposit has an average grain size between about 0.2 μm and about 3 μm and contains less than about 1 mol % of each oxygen, carbon, and chlorine.

18 Claims, 34 Drawing Sheets
(26 of 34 Drawing Sheet(s) Filed in Color)

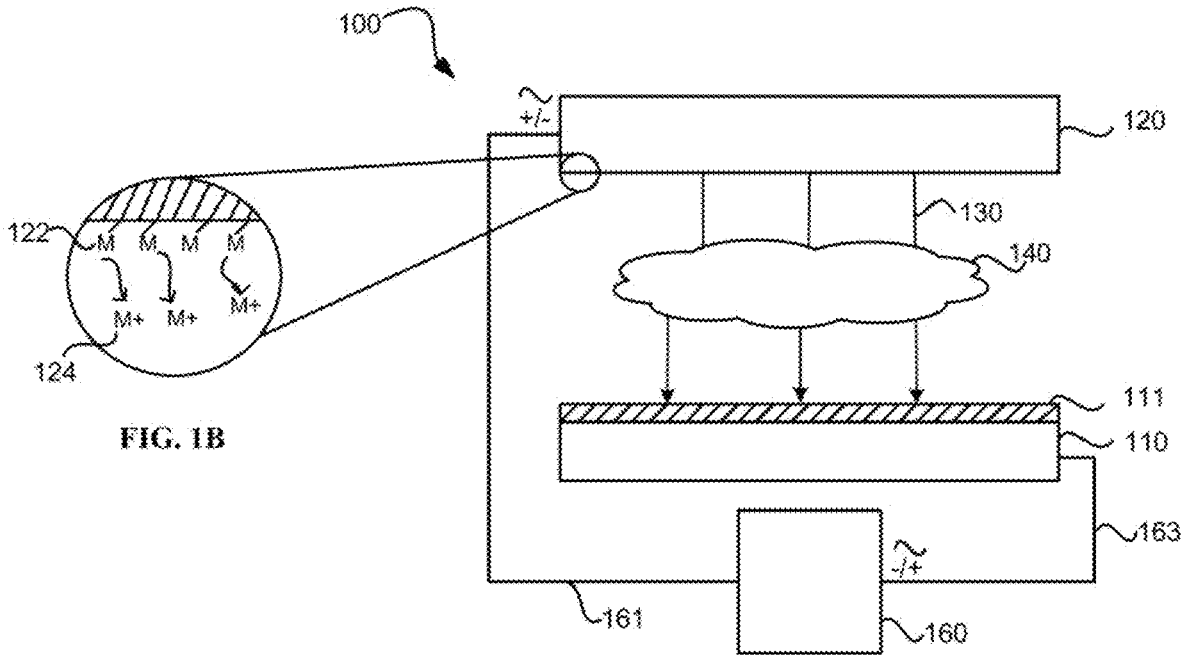
FIG. 1B
FIG. 1A
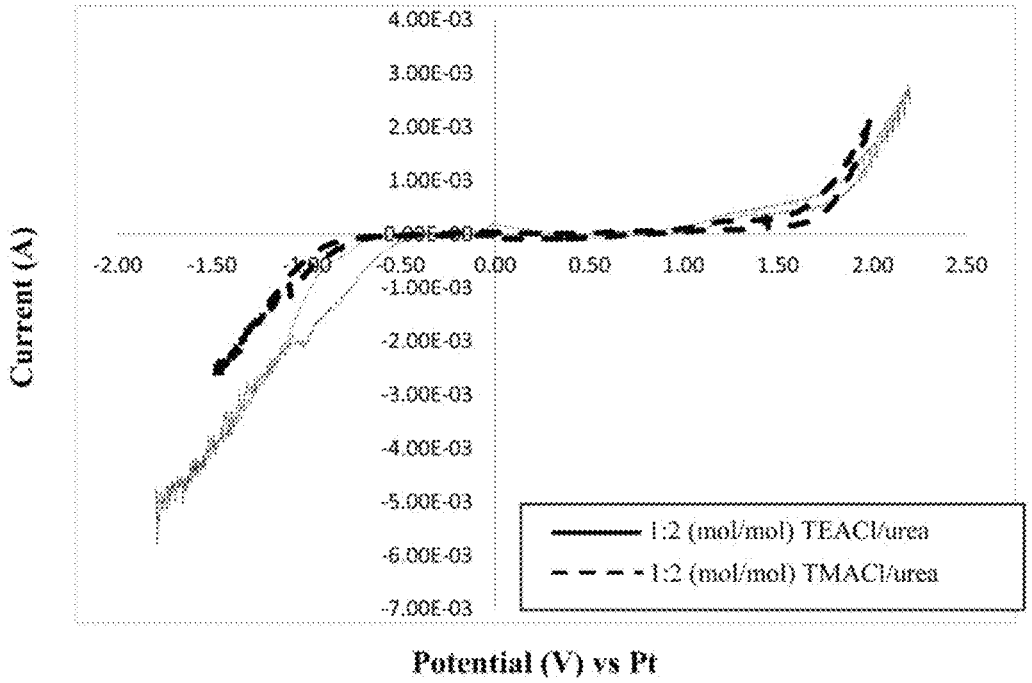
FIG. 2 y

METAL DEPOSITS, COMPOSITIONS, AND METHODS FOR MAKING THE SAME

CROSS-REFERENCE TO RELATED APPLICATION

This divisional application is related to and claims priority to U.S. patent application Ser. No. 15/293,096, filed Oct. 13, 2016 entitled "Metal Deposits, Compositions, and Methods for Making the Same," the entire contents of which is incorporated herein by reference for all purposes.

TECHNICAL FIELD

Aspects of the present disclosure involve metal deposits and methods for making the same. In particular, the present disclosure relates to iron deposits and ionic liquid electrolytes used in metal deposition processes.

BACKGROUND

Conventional metal deposition, such as iron deposition, relies upon caustic aqueous solutions, such as $FeSO_4/H_2SO_4$ or $FeCl_2/FeCl_3$. Large amounts of hydrogen gas evolve at the surface, pitting the substrate and causing the metal deposit to become brittle. The aqueous electrolyte has a narrow stability window of only 1.2 V and a maximum operating temperature between about 80° C. and about 100° C. Conventionally, many metals, such $Fe^0$, cannot be deposited without also decomposing the solvent because of the necessary voltages. Higher temperatures are desired to drive off the hydrogen, but higher temperature lead to unfavorably large crystal grain sizes, which are already a problem because of iron's high intrinsic crystallinity. Moreover, in water, $Fe^{3+}$ forms at the anode. If low concentrations of $Fe^{3+}$ migrate to the cathode, then the deposit quality is significantly compromised.

It is with these issues in mind, among others, that aspects of the present disclosure were conceived.

SUMMARY

Following the compositions provided herein, a metal deposit on a substrate. The composition consist essentially of a carboxamide, trialkylamine chloride, and a metal salt. The carboxamide may comprise Formula (I):

(I)

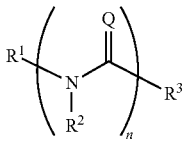

wherein n is 1 to 6;

each Q is independently chosen from O or $NR^4R^5$;

$R^1$ is independently chosen from H or alkyl, and $R^3$ is $NR^4R^5$; or $R^1$ and $R^3$ are taken together to form a ring; and each $R^2$, $R^4$, and $R^5$ is independently chosen from H or alkyl;

The trialkylamine chloride and the carboxamide may be in molar ratio between 1:1 and 1:30 to form an ionic liquid, wherein the trialkylamine chloride is trimethylamine chloride (TMACl), triethylamine chloride (TEACl), triethanolamine chloride, or combinations thereof. The metal salt may have the formula $MX_y$, wherein M is a metal, X is a halide, and y is an oxidation number of M. The metal salt may be in a concentration between about 0.2 and about 1.5 moles per liter of the ionic liquid. The metal deposit may have an average grain size between about 0.2 μm and about 3 μm and contains less than about 1 mol % of each oxygen, carbon, and chlorine.

Also provided herein is a composition for forming an iron deposit on a substrate. The composition consists essentially of a carboxamide, trialkylamine chloride, and a metal salt. The carboxamide may be selected from the group consisting of urea, biuret, triuret, tetrauret, pentauret, hexauret, cyanuric acid, ammelide, ammeline, and combinations thereof. The trialkylamine chloride and the carboxamide may be in molar ratio between 1:1 and 1:30 to form an ionic liquid, wherein the trialkylamine chloride is trimethylamine chloride (TMACl), triethylamine chloride (TEACl), or combinations of the two. The metal salt may have the formula $MX_y$, wherein M is a metal, X is a halide, and y is an oxidation number of M. The metal salt may be in a concentration between about 0.2 and about 1.5 moles per liter of the ionic liquid. The iron deposit may have an average grain size between about 0.2 μm and about 3 μm and contains less than about 1 mol % of each oxygen, carbon, and chlorine.

The present disclosure provides a metal deposit formed from any composition described herein. For example, an iron deposit may have an average grain size between about 0.2 μm and about 3 μm and may contain less than about 1 mol % of each oxygen, carbon, and chlorine. This iron deposit may be formed on a substrate by inducing a potential between an iron salt and the substrate through an electrolyte to cause a metal-metal bond to form between the iron salt and metal on the substrate. The electrolyte may comprise trialkylamine halide, urea, and an iron salt. The trialkylamine halide and carboxamide may be in molar ratio between about 1:1 and about 1:30 to form an ionic liquid, such at about 1:1 (mol/mol) or about 1:30 (mol/mol). The iron salt, such as $FeCl_3$, may be at a concentration between about 0.2 and about 1.5 moles per liter of the ionic liquid.

Also provided herein a method comprising, inducing a potential between a metal salt and a substrate through an electrolyte to deposit metal onto the substrate by causing a metal-metal bond to form between the metal salt and metal on the substrate. In this method, the potential may have a current density between about 10 $mA/cm^3$ and about 300 $mA/cm^3$ and a reduction potential of between about −0.6 V and about −2.2 V. The electrolyte may comprise trialkylamine chloride, a metal salt, and a carboxamide of Formula (I):

(I)

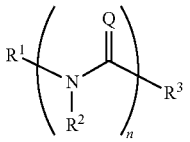

wherein n is 1 to 6;

each Q is independently chosen from O or $NR^4R^5$;

$R^1$ is independently chosen from H or alkyl, and $R^3$ is $NR^4R^5$; or $R^1$ and $R^3$ are taken together to form a ring; and each $R^2$, $R^4$, and $R^5$ is independently chosen from H or alkyl.

The trialkylamine chloride and carboxamide may be in molar ratio between 1:1 and 1:30 to form an ionic liquid. The trialkylamine chloride may be trimethylamine chloride (TMACl), triethylamine chloride (TEACl), or combinations of the two. The metal salt has the formula $MX_y$, wherein M is a metal, X is a halide, and y is an oxidation number of M. The metal salt may be in a concentration between about 0.2 and about 1.0 moles per liter of the ionic liquid (that is, 0.2-1.0 M). The deposited metal produced from this method may have an average grain size between about 0.2 μm and about 3 μm, such as between about 0.5 μm and about 2 μm, and contains less than about 1 mol % of each oxygen, carbon, and chlorine, as verified through electron microscopy and energy-dispersive spectroscopy.

The present disclosure provides a metal deposit formed by any method described herein. For example, an iron deposit may have an average grain size between about 0.2 μm and about 3 μm and may contain less than about 1 mol % of each oxygen, carbon, and chlorine. This iron deposit may be formed on a substrate by inducing a potential between an iron salt and the substrate through an electrolyte to cause a metal-metal bond to form between the iron salt and metal on the substrate. The electrolyte may comprise trialkylamine halide, carboxamide, and an iron salt. The trialkylamine halide and carboxamide may be in molar ratio between about 1:1 and about 1:30 to form an ionic liquid, such at about 1:2 (mol/mol) or about 1:10 (mol/mol). The iron salt, such as $FeCl_3$, may be at a concentration between about 0.2 and about 1.5 moles per liter of the ionic liquid.

Additional embodiments and features are set forth in part in the description that follows, and in part will become apparent to those skilled in the art upon examination of the specification, or may be learned by the practice of the embodiments discussed herein. A further understanding of the nature and advantages of certain embodiments may be realized by reference to the remaining portions of the specification and the drawings, which forms a part of this disclosure.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

Example embodiments are illustrated in referenced figures of the drawings. It is intended that the embodiments and figures disclosed herein are to be considered illustrative rather than limiting.

FIG. 1A depicts a device 100 which may be used in the disclosed methods. The device comprises a source of a countercharge 120, and a substrate 110 in electrical communication with the source of a countercharge 120 through an electrolyte 140. A potential 130 is induced through the electrolyte 140 between the source of a countercharge 120 and the substrate 110, having a surface 111. The device also comprises a power supply 160 in electrical communication 161 with the source for a countercharge 120 and in electrical communication 163 with the substrate 110.

FIG. 1B is an inset of FIG. 1A, showing an embodiment where the source of countercharge 120 is a corroding electrode. When the potential 130 is induced between the corroding electrode 120 and the substrate 110 through the electrolyte 140, metal 122 from the corroding electrode 120 is released as metal species (M+) 124 into the electrolyte 140.

FIG. 2 shows a cyclic voltammogram for 1:2 (mol/mol) triethylamine chloride (TEACl)/urea (solid line) and 1:2 (mol/mol) trimethylamine chloride (TMACl)/urea (dashed line) ionic liquids on a glassy carbon electrode in the absence of ferric chloride ($FeCl_3$).

(FIGS. 26A&B) Mo pressed anode, (FIGS. 26C&D) Sn pressed anode, (FIGS. 26E&F), Cu—Fe pressed anode, (FIGS. 26G&H) Cu pressed anode, and (FIGS. 26I&J) Cu—Sn pressed anode.

DETAILED DESCRIPTION

Figure 3:
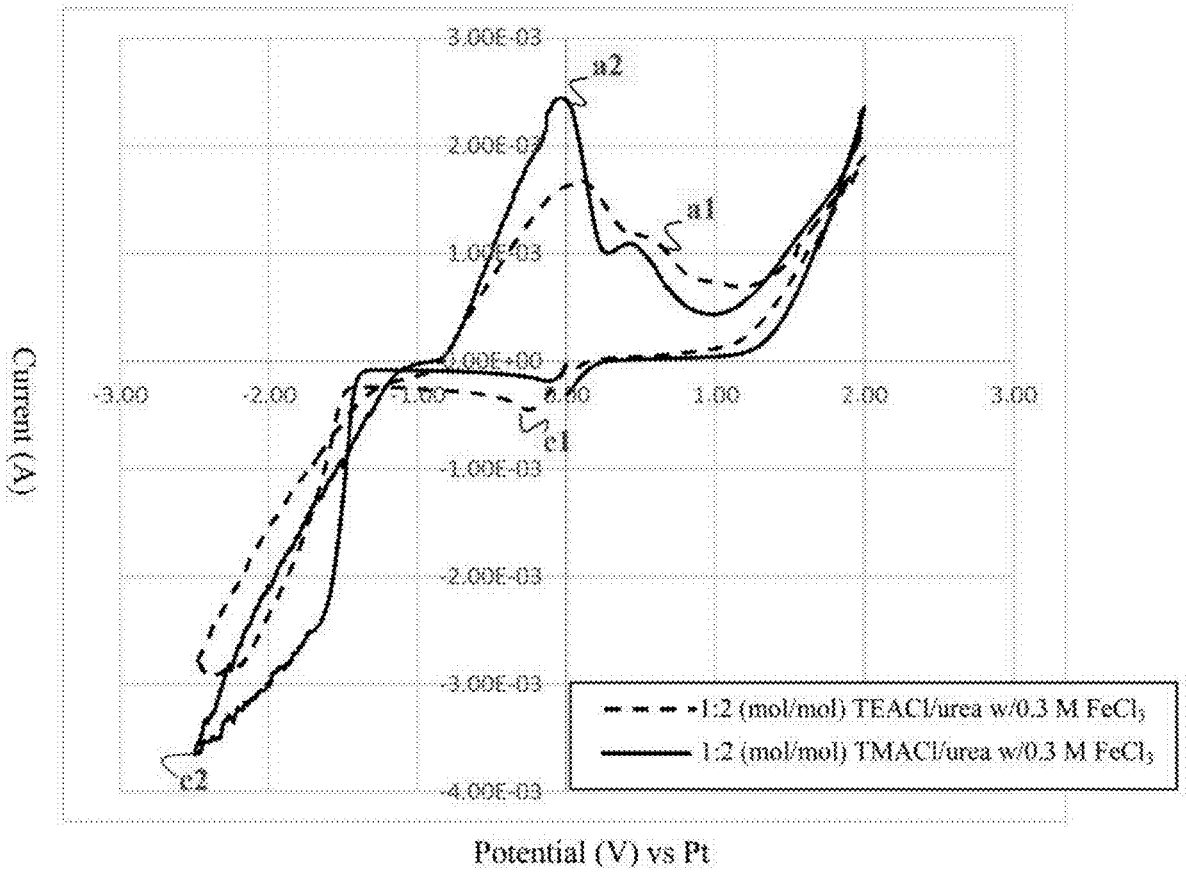
FIG. 3 shows a cyclic voltammogram for 1:2 (mol/mol) TEACl/urea (dashed line) and 1:2 (mol/mol) TMACl/urea (solid line) with 0.3 M $FeCl_3$.

Provided herein are methods, devices and compositions which deposit highly pure, dense metal deposits onto substrates from an electrolyte. The electrolyte comprises trialkylamine halide, carboxamide, and a metal source, such as an iron salt. In another example, the electrolyte comprises trialkylamine halide and carboxamide in molar ratio between about 1:1 and about 1:30 to form an ionic liquid, such as about 1:2 or about 1:10. The metal source is at a concentration between about 0.2 and about 1.5 moles per liter of the ionic liquid (that is, 0.2-1.5 M), such as about 0.3 M. A potential is induced between the metal source and a substrate through the electrolyte. Metal is thereby deposited onto the substrate by causing a metal-metal bond to form between the metal source and metal on the substrate. Included also in this disclosure are metal deposits formed using the methods disclosed herein and compositions employed in the method.

Using the disclosed methods, hydrogen is not evolved at the substrate during metal deposition and denser metal is deposited compared to previously known methods. Voltage and temperature operate in wider windows of the induced potential relative to conventional aqueous electrolytes, and the average grain size of deposited metal is better controlled compared to previous deposits. When iron is present, $Fe^{3+}$ is reduced completely to $Fe^0$, thus avoiding the catastrophic system failures which plague prior methods and systems. Moreover, as evinced by the microscopic and energy-dispersive spectroscopic data disclosed herein, the metal deposits have surprisingly high purity and conformity. These deposits are corrosion resistant, substantially free from oxygen, carbon, and chlorine, and adhering strongly to the substrates upon which the metal deposit is formed.

The present disclosure may be understood by reference to the following detailed description, taken in conjunction with the drawings as described above. It is noted that, for purposes of illustrative clarity, certain elements in various drawings may not be drawn to scale, may be represented schematically or conceptually, or otherwise may not correspond exactly to certain physical configurations of embodiments.

I. Method

The present disclosure provides a method for depositing metal onto a substrate, for example a working electrode (workpiece) of an electrochemical cell. The substrate may be any electrically conductive surface, including metals such as steel or iron, or common electrode materials, such as glassy carbon.

The methods according to this disclosure can be understood with relation to exemplary devices. Referring to FIG. 1, a device 100 may comprise a source of a countercharge 120, and a substrate 110 in electrical communication with the source of a countercharge 120 through an electrolyte 140. A potential 130 is induced through the electrolyte 140 between the source of a countercharge 120 and the substrate 110. In some embodiments, the device also comprises a power supply 160 in electrical communication 161 with the source for a countercharge 120 and in electrical communication 163 with the substrate 110.

According to the methods of this disclosure, when potential between a metal source and a substrate through an electrolyte, metal is thereby deposited onto the substrate by causing a metal-metal bond to form between the metal source and metal on the substrate. In particular embodiments, a potential may be induced between a metal source and a substrate through an electrolyte to deposit metal onto the substrate by causing a metal-metal bond to form between the metal source and metal on the substrate.

Referring to FIG. 1B, a corroding electrode is depicted as a possible source of a countercharge. When the potential 130 is induced between the corroding electrode 120 and the substrate 110 through the electrolyte 140, metal 122 from the corroding electrode 120 is released as metal species ($M^+$) 124 into the electrolyte 140. In another example, the electrolyte may comprise trialkylamine halide and carboxamide in molar ratio between 1:1 and 1:30 to form an ionic liquid. Alternatively, the methods according to this disclosure may be contemplated in the context of a device without a corroding electrode, wherein a substrate 110 has a potential 130 induced in the presence of a chemical potential between an electrolyte 140 and the surface 111. In this embodiment, the electrolyte comprises trialkylamine halide, carboxamide, and a metal source. The metal source may be a metal salt, for example at a concentration between about 0.2 and about 1.5 moles per liter of the ionic liquid (that is, 0.2-1.5 M).

A. Induced Potential

The methods disclosed herein induce a potential between a metal source and a substrate through an electrolyte. The potential has features which can be varied to effect the outcome of the method and the characteristics of the deposited metal. These features include current density and a reduction potential.

The potential may have a current density ranging between about 0 mA/cm$^3$ and about 300 mA/cm$^3$. In various embodiments, the current density may be between about 0 mA/cm$^3$ and about 5 mA/cm$^3$, between about 5 mA/cm$^3$ and about 10 mA/cm$^3$, between about 10 mA/cm$^3$ and about 15 mA/cm$^3$, between about 15 mA/cm$^3$ and about 20 mA/cm$^3$, between about 20 mA/cm$^3$ and about 25 mA/cm$^3$, between about 25 mA/cm$^3$ and about 30 mA/cm$^3$, between about 30 mA/cm$^3$ and about 35 mA/cm$^3$, between about 35 mA/cm$^3$ and about 40 mA/cm$^3$, between about 40 mA/cm$^3$ and about 50 mA/cm$^3$, between about 50 mA/cm$^3$ and about 100 mA/cm$^3$, between about 100 mA/cm$^3$ and about 150 mA/cm$^3$, between about 150 mA/cm$^3$ and about 200 mA/cm$^3$, between about 200 mA/cm$^3$ and about 250 mA/cm$^3$, or between about 250 mA/cm$^3$ and about 300 mA/cm$^3$, or any current density therebetween. The current density may be less than about 300 mA/cm$^3$, such as less than about 100 mA/cm$^3$, or less than about 50 mA/cm$^3$. The current density may be more than about 10 mA/cm$^3$, such as more than about 50 mA/cm$^3$, or more than about 100 mA/cm$^3$. In particular, the current density may be about 20 mA/cm$^3$. Alternatively, the current density may be about 40 mA/cm$^3$.

The potential may have a reduction potential ranging of between about −0.6 V and about −2.2 V. A reduction potential of −2.2V is close to the boundary of the electrochemical stability window of the electrolytes disclosed herein, causing the grain structure of the deposited metals to become more varied. Thus, the reduction potential tends to be more positive than about −2.2 V. In various embodiments, the reduction potential may be between about −0.6 V and about −0.7 V, between about −0.7 V and about −0.8 V, between about −0.8 V and about −0.9 V, between about −0.9 V and about −1.0 V, between about −1.0 V and about −1.1 V, between about −1.1 V and about −1.2 V, between about −1.2 V and about −1.3 V, between about −1.3 V and about −1.4 V, between about −1.4 V and about −1.5 V, between about −1.5 V and about −1.6 V, between about −1.6 V and about −1.7 V, between about −1.7 V and about −1.8 V, between about −1.8 V and about −1.9 V, between about −1.9 V and about −2.0 V, between about −2.0 V and about −2.1 V, or between about −2.1 V and about −2.2 V. The reduction potential may be less than about −0.6 V.

B. Electrolyte

The methods described herein use an electrolyte. Generally, the electrolyte comprises an ionic liquid and a metal source, which is a source for new material deposited at the substrate. In particular, the electrolyte may comprise ionic liquid formed from trialkylamine halide and carboxamide. The metal source is mixed with or dissolved in the ionic liquid. The electrolyte may also comprise one or more additives, for example, a silica-providing agent such at tetraethoxysilane (ortho silicate, TEOS).

1. Ionic Liquid

Generally, the electrolyte comprises an ionic liquid formed from trialkylamine halide and carboxamide in molar ratio between about 1:1 and about 1:30, especially at a molar ratio of about 1:2 or of about 1:10. In another example, the electrolyte may only contain a trace amount of water, such as that absorbed from the atmosphere. That is, the electrolyte may be substantially non-aqueous.

The alkyl groups of the trialkylamine halide may be the same or different. The alkyl groups may be lower alkyl containing from one to eight carbon atoms in the principal chain and up to 20 carbon atoms. The alkyl groups may be straight or branched chain or cyclic and include methyl, ethyl, propyl, isopropyl, butyl, hexyl and the like. The alkyl groups may be optionally substituted with one or more hydroxyl groups, such as a methanol, ethanol, or propanol substituent. As such, the trialkylamine halide may be trimethanolamine halide, triethanolamine halide, or tripropanolamine halide.

The halide in the trialkylamine halide may be fluoride, chloride, bromide, or iodine. For example, the halide may be chloride. In particular, the trialkylamine halide may be a trialkylamine chloride, such as trimethylamine chloride (TMACl), triethylamine chloride (TEACl), or combinations of the two. That is, the trialkylamine halide may be trimethylamine chloride. Alternatively, the trialkylamine halide may be triethylamine chloride.

The carboxamide may comprise Formula (I):

(I)

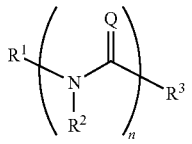

wherein n is 1 to 6;

each Q is independently chosen from O or $NR^4R^5$;

$R^1$ is independently chosen from H or alkyl, and $R^3$ is $NR^4R^5$; or $R^1$ and $R^3$ are taken together to form a ring; and each $R^2$, $R^4$, and $R^5$ is independently chosen from H or alkyl.

Generally, at least one Q is an O.

The carboxamide of Formula (I) may comprise a compound of Formula (II):

(II)

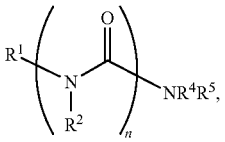

wherein n is 1 to 6;

each Q is independently chosen from O or $NR^4R^5$;

$R^1$, $R^4$, and $R^5$ are independently chosen from H or alkyl; and each $R^2$ is chosen from H or alkyl.

That is, the carboxamide of Formula (II) is a carboxamide of Formula (I), wherein Q is O, and $R^3$ is $NR^4R^5$.

The carboxamide of Formula (II) may comprise a compound of Formula (III):

(III)

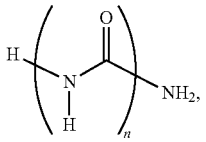

wherein n is 1 to 6.

That is, the carboxamide of Formula (III) is a carboxamide of Formula (II), wherein $R^1$, $R^2$, $R^4$, and $R^5$ are each H. Viewed another way, the carboxamide of Formula (III) is a carboxamide of Formula (I), wherein Q is O, $R^3$ is $NR^4R^5$, and wherein $R^1$, $R^2$, $R^4$, and $R^5$ are each H. When n is 1, the carboxamide is urea. When n is 2, the carboxamide is biuret. When n is 3, the carboxamide is triuret. When n is 4, the carboxamide is tetrauret. When n is 5, the carboxamide is pentauret. When n is 6, the carboxamide is hexauret.

The carboxamide of Formula (I) may comprise a compound of Formula (IV):

(IV)

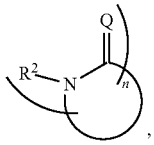

n is 2 to 6;

each Q is independently chosen from O or $NR^4R^5$; and each $R^2$, $R^4$, and $R^5$ is independently chosen from H or alkyl.

That is, a carboxamide of Formula (IV) is a carboxamide of Formula (I), wherein $R^1$ and $R^3$ have been taken together to form a ring.

The carboxamide of Formula (IV) may comprise a compound of Formula (V):

(V)

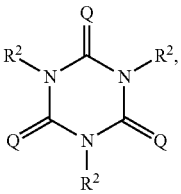

each Q is independently chosen from O or $NR^4R^5$; and each $R^2$, $R^4$, and $R^5$ is independently chosen from H or alkyl.

That is, the carboxamide of Formula (V) is a carboxamide of Formula (IV), where n is 3. Viewed another way, the carboxamide of Formula (V) is a carboxamide of Formula (I), wherein $R^1$ and $R^3$ have been taken together to form a ring, and n is 3; that is, a 6-membered ring.

In some embodiments, the carboxamide of Formula (I) may be selected from the group consisting of urea, biuret, triuret, tetrauret, pentauret, hexauret, cyanuric acid, ammelide, ammeline, and combinations thereof. The carboxamide may be selected from the group consisting of cyanuric acid, ammelide, ammeline, and combinations thereof, encompassing a compound of Formula (V). The carboxamide may be selected from the group consisting of urea, biuret, triuret, tetrauret, pentauret, hexauret, and combinations thereof, encompassing a compound of Formula (III). In particular, the carboxamide may be urea or biuret. In exemplary embodiments, the carboxamide is urea.

Without wishing to be bound by theory, the carboxamide is a proton carrier, which permits the formation of the ionic liquid when combined with the trialkylamine halide in specific molar ratios. Generally, the trialkylamine halide and carboxamide may be in molar ratio between about 1:1 and 1:30. In various embodiments, the trialkylamine halide and carboxamide may be in molar ratio between about 1:1 and about 1:2, between about 1:2 and about 1:3, between about 1:3 and about 1:4, between about 1:4 and about 1:5, between about 1:5 and about 1:6, between about 1:6 and about 1:7, between about 1:7 and about 1:8, between about 1:8 and about 1:9, between about 1:9 and about 1:10, between about 1:10 and about 1:11, between about 1:11 and about 1:12, between about 1:12 and about 1:13, between about 1:13 and about 1:14, between about 1:14 and about 1:15, between about 1:15 and about 1:16, between about 1:16 and about 1:17, between about 1:17 and about 1:18, between about 1:18 and about 1:19, between about 1:19 and about 1:20, between about 1:20 and about 1:21, between about 1:21 and about 1:22, between about 1:22 and about 1:23, between about 1:23 and about 1:24, between about 1:24 and about 1:25, between about 1:25 and about 1:26, between about 1:26 and about 1:27, between about 1:27 and about 1:28, between about 1:28 and about 1:29, or between about 1:29 and about 1:30.

The trialkylamine halide and carboxamide may be in molar ratio of greater than about 1:2, such as greater than about 1:5. The trialkylamine halide and carboxamide may be in molar ratio of less than about 1:30, such as less than about 1:20, or less than about 1:10. In particular, the trialkylamine halide and carboxamide may be in molar ratio of about 1:2. The trialkylamine halide and carboxamide may be also in molar ratio of about 1:5. Alternatively, the trialkylamine halide and carboxamide may be in molar ratio between about 1:10.

In particular, the carboxamide may be urea, wherein the trialkylamine halide and urea may be in molar ratio of greater than about 1:2, such as greater than about 1:5. The trialkylamine halide and urea may be in molar ratio of less than about 1:30, such as less than about 1:20, or less than about 1:10. In particular, the trialkylamine halide and urea may be in molar ratio of about 1:2. The trialkylamine halide and urea may be also in molar ratio of about 1:5. Alternatively, the trialkylamine halide and urea may be in molar ratio between about 1:10.

When the potential is induced, the electrolyte may have at a temperature above 50° C. and below about 300° C., such between about 50° C. and about 60° C., between about 60° C. and about 70° C., between about 70° C. and about 80° C., between about 80° C. and about 90° C., between about 90° C. and about 100° C., between about 100° C. and about 110° C., between about 110° C. and about 120° C., between about 120° C. and about 130° C., between about 130° C. and about 140° C., between about 140° C. and about 150° C., between about 150° C. and about 160° C., between about 160° C. and about 170° C., between about 170° C. and about 180° C., between about 180° C. and about 190° C., between about 190° C. and about 200° C., between about 200° C. and about 210° C., between about 210° C. and about 220° C., between about 220° C. and about 230° C., between about 230° C. and about 240° C., between about 240° C. and about 250° C., between about 250° C. and about 260° C., between about 260° C. and about 270° C., between about 270° C. and about 280° C., between about 280° C. and about 290° C., or between about 290° C. and about 300° C. The temperature may be less than about 300° C., such as less than about 150° C. The temperature may be more than about 0° C., such as more than about 100° C. In particular, the electrolyte may have a temperature between about 80° C. and about 120° C. when the potential is induced, such as at about 100° C.

The pH of the electrolyte may vary depending upon the embodiment. Different metals and composites typically have pH requirements to maintain a stable mixture in solution.

2. Metal Source

Generally, the electrolyte comprises a metal source. The metal source may be metal particles, such as dissolved or suspended metallic micro- or nanoparticles, or molecular metal ions, such as dissolved metal salts. Referring to FIG. 1B, the metal source may be provided by corroding an electrode, such as a counter or reference electrode in contact with the electrolyte. The corroding electrodes may comprise an iron plate, or provide a metal source to the electrolyte from a pressed anode. Alternatively or in addition to the corroding electrode, the metal source may be one or more metal salts present in the ionic liquid, such as a metal salt $MX_y$.

Examples of suitable metals include, but are not limited to, zinc, cadmium, copper, nickel chromium, tin, gold, silver, platinum, lead, ruthenium, rhodium, palladium, osmium, iridium, iron, cobalt, indium, arsenic, antimony, bismuth, manganese, rhenium, aluminum, zirconium, titanium, hafnium, vanadium, niobium, tantalum, tungsten, and molybdenum. Examples of suitable alloys having two metals include, but are not limited to gold-copper-cadmium, zinc-cobalt, zinc-iron, zinc-nickel, brass (an alloy of copper and zinc), bronze (copper-tin), tin-zinc, tin-nickel, and tin-cobalt. Especially suitable metals are molybdenum, tine, iron, and copper. In particular, the metal may be iron.

In some embodiments, the metal source may be provided into the electrolyte by a pressed anode. The pressed anode comprises one or more metals selected from the group consisting of Mo, Sn, Zn, Al, Fe, and Cu. The pressed anode may also be formed from an alloy such as bronze (Cu—Sn). The pressed anode may be produced following the procedure of Example 5 disclosed herein.

Alternatively, or in addition to, the electrolyte may comprise a metal salt. Any metal salt known within the electrochemical arts is suitable for use in this method. In some instances, the metal source may be a metal salt having the formula $MX_y$, wherein M is a metal, X is a halide, and y is an oxidation number of M. In particular, the metal salt $MX_y$ may be $FeCl_3$.

M may be any suitable metal, such as those listed above. In particular, M may be Fe. As such, $MX_y$ may be $FeX_y$, where X is a halide and y is an oxidation state of Fe. In particular, the metal salt $FeX_y$ may be $FeCl_3$.

X may be any halide, such as fluoride, chloride, bromide, or iodide. In particular, X may be Cl. As such, $MX_y$ may be $MCl_y$. Generally, the halide of the salt is selected to correspond with the halide of the trialkylamine halide. For example, when the trialkylamine halide is a trialkylamine chloride, the metal salt $MX_y$ is selected to be $MCl_y$, wherein the halide of the metal salt is chloride as well. In particular, the metal salt $MCl_y$ may be $FeCl_3$.

The number y may be any oxidation number available to the suitable metals, such as 1, 2, 3, 4, 5, 6, 7, 8, 9, or 10. y may be 2. y may be 2 or 3. In particular, y may be 3. As such, $MX_y$ may be $MX_3$, where M is selected from among suitable metals which can have an oxidation state of 3+. In particular, the metal salt $MX_3$ may be $FeCl_3$.

Generally, the metal source is at a concentration between about 0.2 and about 1.5 moles per liter of the ionic liquid; that is, between about 0.2 M and about 1.5 M. In various embodiments, the metal source is at a concentration between about 0.2 M and about 0.25 M, between about 0.25 M and about 0.3 M, between about 0.3 M and about 0.35 M, between about 0.35 M and about 0.4 M, between about 0.4 M and about 0.45 M, between about 0.45 M and about 0.5 M, between about 0.5 M and about 0.55 M, between about 0.55 M and about 0.6 M, between about 0.6 M and about 0.65 M, between about 0.65 M and about 0.7 M, between about 0.7 M and about 0.75 M, between about 0.75 M and about 0.8 M, between about 0.8 M and about 0.85 M, between about 0.85 M and about 0.9 M, between about 0.9 M and about 0.95 M, between about 0.95 M and about 1.0 M, between about 1.0 M and about 1.05 M, between about 1.05 M and about 1.1 M, between about 1.1 M and about 1.15 M, between about 1.15 M and about 1.2 M, between about 1.2 M and about 1.25 M, between about 1.25 M and about 1.3 M, between about 1.3 M and about 1.35 M, between about 1.35 M and about 1.4 M, between about 1.4 M and about 1.45 M, or between about 1.45 M and about 1.5 M. The concentration of metal source may be more than about 0.2 moles per liter of the ionic liquid. The concentration of metal source may be less than about 1.5 moles per liter of the ionic liquid. In particular, the concentration of metal source may be about 0.3 moles per liter of the ionic liquid.

3. Additives

The electrolyte may further comprise one or more additives, including but not limited to, organic solvents, acids, bases, salts, surfactants, thickeners, buffers, ionizable organic compounds, and silica-providing agents. In particular, the electrolyte may comprise thickener to modulate the viscosity and increase the mass of particulates stably suspended in the liquid electrolyte.

The electrolyte compositions may include a silica-providing agent. Examples of silica-providing agents include, but are not limited to, silica, silicon dioxide, silicic oxide, colloidal silica, silica gel, kieselguhr, quartz, tridymite, cristobalite, keatite, moganite, stishovite, seifertite, melanophlogite, sand, and monomeric silanes. The silica-providing agent may be hydrated, precipitated, fumed, fused, fibrous, mesoporous, and/or micronized. The silica provided by the silica-providing agent may be microcrystalline or present on the micrometer or nanometer scale.

When the silica-providing agent is a monomeric silane, the agent can be hydrolyzed, thermally, or electrochemically decomposed to provide microcrystalline silica dispersed throughout the metal deposit. The monomeric silane may be trialkoxysilane, such as triethoxysilane, or a tetraalkoxysilane, such as tetraethoxysilane (e.g. Wacker® TES 28, tetraethyl orthosilicate). Wacker® TES 28 is a monomeric silane, which can be hydrolyzed to form silicon dioxide (silica). Other suitable examples of trialkoxysilanes include trimethoxysilane, tripropoxysilane, and triisopropoxysilane. Other suitable examples of tetraalkoxysilanes include tetramethoxysilane, tetrapropoxysilane, and tetraisopropoxysilane. In particular, the electrolyte comprises tetraethoxysilane.

When present, the organic solvent may be a polar protic solvent, a polar aprotic solvent, a non-polar solvent, or combinations thereof. Suitable examples of polar protic solvents include, but are not limited to alcohols such as methanol, ethanol, isopropanol, n-propanol, isobutanol, n-butanol, s-butanol, t-butanol, and the like; diols such as propylene glycol; organic acids such as formic acid, acetic acid, and so forth; amines such as trimethylamine, or triethylamine, and the like; amides such as formamide, acetamide, and so forth; and combinations of any of the above.

Non-limiting examples of suitable polar aprotic solvents include acetonitrile, dichloromethane (DCM), diethoxymethane, N,N-dimethylacetamide (DMAC), N,N-dimethylformamide (DMF), dimethyl sulfoxide (DMSO), N,N-dimethylpropionamide, 1,3-dimethyl-3,4,5,6-tetrahydro-2(1H)-pyrimidinone (DMPU), 1,3-dimethyl-2-imidazolidinone (DMI), 1,2-dimethoxyethane (DME), dimethoxymethane, bis(2-methoxyethyl)ether, 1,4-dioxane, N-methyl-2-pyrrolidinone (NMP), ethyl formate, formamide, hexamethylphosphoramide, N-methylacetamide, N-methylformamide, methylene chloride, nitrobenzene, nitromethane, propionitrile, sulfolane, tetramethylurea, tetrahydrofuran (THF), 2-methyltetrahydrofuran, trichloromethane, and combinations thereof.

Suitable examples of non-polar solvents include, but are not limited to, alkane and substituted alkane solvents (including cycloalkanes), aromatic hydrocarbons, esters, ethers, combinations thereof, and the like. Specific non-polar solvents that may be employed include, for example, benzene, butyl acetate, t-butyl methylether, chlorobenzene, chloroform, chloromethane, cyclohexane, dichloromethane, dichloroethane, diethyl ether, ethyl acetate, diethylene glycol, fluorobenzene, heptane, hexane, isopropyl acetate, methyltetrahydrofuran, pentyl acetate, n-propyl acetate, tetrahydrofuran, toluene, and combinations thereof.

An electrolyte comprising organic solutions frequently exhibit greater viscosity, which can cause slower molecular diffusion but benefits from increased particle suspension capacity. Electrolyte having organic solvent may also display much larger electrochemical windows (2 V to 6 V), compared to water (about 1.23 V). Organic solvents may also have greater operating temperature ranges above the 100° C. limit for aqueous systems. Generally, organic solutions do not codeposit with the metal during deposition.

The range of concentration of additives in the electrolyte can and will vary. Generally, the concentration of additives in the electrolyte may range between about $10^{-2}$ mol/L and about $10^{-5}$ mol/L, such as between about $10^{-2}$ mol/L and about $10^{-3}$ mol/L, between about $10^{-3}$ mol/L and about $10^{4}$ mol/L, or between about $10^{4}$ mol/L and about $10^{-5}$ mol/L.

II. Metal Deposits

A metal deposit may be formed by any method described herein. In particular, these metal deposits may be an iron deposit formed from an iron-containing metal source.

Generally, the metal deposit may have an average grain size ranging between about 0.2 μm and about 3 μm. In various embodiments, the grain size may be between about 0.2 μm and about 0.5 μm, between about 0.5 μm and about 1 μm, between about 1 μm and about 1.5 μm, between about 1.5 μm and about 2 μm, between about 2 μm and about 2.5 μm, or between about 2.5 μm and about 3 μm. The average grain size may be between about 0.5 μm and about 2 μm. The average grain size may be more than about 0.2 μm. The grain boundary may be less than about 3 μm. When the metal is iron, the metal deposit may be especially crystalline, where the grain boundaries lie between different crystals in the metal deposit.

Metal deposits produced using methods disclosed herein are surprisingly pure, where atomic elements from the electrolyte other than the metal are not substantially incorporated into the metal deposit. The metal deposit may contain less than about 5 mol % oxygen, such as less than about 4 mol %, less than about 3 mol %, less than about 2 mol %, less than about 1 mol %, less than about 0.5 mol %, less than about 0.1 mol %. The metal deposit may contain less than about 5 mol % carbon, such as less than about 4 mol %, less than about 3 mol %, less than about 2 mol %, less than about 1 mol %, less than about 0.5 mol %, less than about 0.1 mol %. The metal deposit may contain less than about 5 mol % chlorine, such as less than about 4 mol %, less than about 3 mol %, less than about 2 mol %, less than about 1 mol %, less than about 0.5 mol %, less than about 0.1 mol %. In particular embodiments, the metal deposit may contain less than about 5 mol % of each oxygen, carbon and chlorine, such as less than about 4 mol %, less than about 3 mol %, less than about 2 mol %, less than about 1 mol %, less than about 0.5 mol %, less than about 0.1 mol %. These mole percentages may be determined using any method known in the art, including for example electron-dispersive spectroscopy (EDS).

III. Compositions

Compositions are disclosed herein which were used as electrolytes in the methods. Broadly, these compositions may comprise a trialkylamine halide, carboxamide, and a metal source. In particular embodiments, these compositions may consist essentially of trialkylamine chloride, carboxamide, and a metal salt. That is, the electrolyte may be of a composition where the trialkylamine halide is a trialkylamine chloride and the metal source may be a metal salt. In another example, the compositions may comprise trialkylamine chloride and carboxamide in molar ratio between 1:1 and 1:30 to form an ionic liquid, wherein the trialkylamine chloride is trimethylamine chloride (TMACl), triethylamine chloride (TEACl), or combinations of the two. In various embodiments, the metal salt may have the formula $MX_y$, wherein M is a metal, X is a halide, and y is an oxidation number of M. The metal salt may be in a concentration between about 0.2 and about 1.5 moles per liter of the ionic liquid. Any metal salt $MX_y$ described herein is suitable for use in these compositions. Also, any variation of the ranges of molar ratios or concentrations described herein are suitable for these compositions. These compositions encompass any molar ratio, metal salt, or concentration of metal salt described herein.

In particular, the composition may consist essentially of trimethylamine/triethylamine chloride, a carboxamide of Formula (I), and iron chloride. Generally, the trimethylamine/triethylamine chloride and carboxamide may be in molar ratio between 1:1 and 1:30 to form an ionic liquid. In various embodiments, the trimethylamine/triethylamine halide and carboxamide may be in molar ratio between about 1:1 and about 1:2, between about 1:2 and about 1:3, between about 1:3 and about 1:4, between about 1:4 and about 1:5, between about 1:5 and about 1:6, between about 1:6 and about 1:7, between about 1:7 and about 1:8, between about 1:8 and about 1:9, between about 1:9 and about 1:10, between about 1:10 and about 1:11, between about 1:11 and about 1:12, between about 1:12 and about 1:13, between about 1:13 and about 1:14, between about 1:14 and about 1:15, between about 1:15 and about 1:16, between about 1:16 and about 1:17, between about 1:17 and about 1:18, between about 1:18 and about 1:19, between about 1:19 and about 1:20, between about 1:20 and about 1:21, between about 1:21 and about 1:22, between about 1:22 and about 1:23, between about 1:23 and about 1:24, between about 1:24 and about 1:25, between about 1:25 and about 1:26, between about 1:26 and about 1:27, between about 1:27 and about 1:28, between about 1:28 and about 1:29, or between about 1:29 and about 1:30.

The trimethylamine/triethylamine halide and carboxamide may be in molar ratio of greater than about 1:2, such as greater than about 1:5. The trimethylamine/triethylamine halide and carboxamide may be in molar ratio of less than about 1:30, such as less than about 1:20, or less than about 1:10. In particular, the trimethylamine/triethylamine halide and carboxamide may be in molar ratio of about 1:2. The trimethylamine/triethylamine halide and carboxamide may also be in molar ratio of about 1:5. Alternatively, the trimethylamine/triethylamine halide and carboxamide may be in molar ratio of about 1:10.

In particular, the carboxamide may be urea, wherein the trimethylamine/triethylamine halide and urea may be in molar ratio of greater than about 1:2, such as greater than about 1:5. The trimethylamine/triethylamine halide and urea may be in molar ratio of less than about 1:30, such as less than about 1:20, or less than about 1:10. In particular, the trimethylamine/triethylamine halide and urea may be in molar ratio of about 1:2. The trimethylamine/triethylamine halide and urea may also be in molar ratio of about 1:5. Alternatively, the trimethylamine/triethylamine halide and urea may be in molar ratio of about 1:10.

Generally, the iron chloride may be in a concentration between about 0.2 and about 1.5 moles per liter of the ionic liquid; that is, between about 0.2 M and about 1.5 M. In various embodiments, the iron chloride may be at a concentration between about 0.2 M and about 0.25 M, between about 0.25 M and about 0.3 M, between about 0.3 M and about 0.35 M, between about 0.35 M and about 0.4 M, between about 0.4 M and about 0.45 M, between about 0.45 M and about 0.5 M, between about 0.5 M and about 0.55 M, or between about 0.55 M and about 0.6 M. The concentration of iron chloride may be more than about 0.2 moles per liter of the ionic liquid. The concentration of iron chloride may be less than about 1.5 moles per liter of the ionic liquid. In particular, the concentration of iron chloride may be about 0.3 moles per liter of the ionic liquid.

In some embodiments, the composition may consist of trimethylamine/triethylamine chloride, carboxamide and iron chloride. These compositions encompass the molar ratios and concentrations of metal salt described herein The compounds described herein have asymmetric centers. Compounds of the present disclosure containing an asymmetrically substituted atom may be isolated in optically active or racemic form. All chiral, diastereomeric, racemic forms and all geometric isomeric forms of a structure are intended, unless the specific stereochemistry or isomeric form is specifically indicated.

When introducing elements of the present disclosure or the embodiments(s) thereof, the articles "a," "an," "the," and "said" are intended to mean that there are one or more of the elements. The terms "comprising," "including," and "having" are intended to be inclusive and mean that there may be additional elements other than the listed elements.

EXAMPLES

Example 1—Metal Deposition from Ionic Liquids Under Varying Current Density, Reduction Potential, and Concentration of the Metal Source Two ionic liquids were prepared by mixing triethylamine hydrochloride or trimethylamine hydrochloride with urea in a 1:2 molar ratio at 110° C. Iron electrodeposition used of these ionic liquids at different potentials, current densities, and varying concentrations of iron chloride ($FeCl_3$) under ambient conditions and variable temperature. A Gamry™ Reference 3000 potentiostat/galvanostat/zero-resistance ammeter was employed to conduct the electrochemical experiment within a three-electrode electrochemical cell. The electrochemistry of ionic liquids with and without $FeCl_3$ were investigated using a glassy carbon (geometric area of about 0.07 $cm^2$) working electrode, Pt wire counter electrode, and a Pt electrode reference electrode. Iron was deposited onto mild steel substrates, which were prepared by washing sequentially with 2-propanol, 6 M HCl(aq) and deionized water. In these measurements, an iron plate was used as the counter and reference electrodes.

To examine the surface morphology and elemental compositions of the metal deposits, a Phenom™ XL scanning electron microscope (SEM) with energy-dispersive spectrometer (EDS) working at 15 kV was used. The EDS detector had a resolution of about +/−1%.

Cross-sections of samples were prepared using a Buehler low speed saw with 4" diamond blade, followed by sequential polishing with 400, 800, 1000, and 1500 grit paper. Current efficiencies were calculated by comparing the total charge (coulomb) of deposition to the net mass change of the substrate.

Referring to FIG. 2, an electrochemical window (potential range of relative stability) of about 2.9 V was evinced by the cyclic voltammograms for 1:2 (mol/mol) triethylamine chloride (TEACl)/urea (solid line) and 1:2 (mol/mol) trimethylamine chloride (TMACl)/urea (dashed line) ionic liquids on a glassy carbon electrode in the absence of iron(III) chloride ($FeCl_3$). (The scan rate was 50 mv/s at 100° C.) The oxidation and reduction decompositions of ionic liquids were observed at 1.8 V and −1.1 V relative to a Pt reference electrode. This stability window is more than double that of previously known, water-based iron deposition methods.

Referring to FIG. 3, the cyclic voltammogram of Fe(III) for 1:2 (mol/mol) TEACl/urea (dashed line) and 1:2 (mol/mol) TMACl/urea (solid line) with 0.3 M $FeCl_3$ showed two redox couples: c1/a1 and c2/a2, associated with the reductions of Fe(III) to Fe(II) and Fe(II) to $Fe^0$, as well as the oxidations of Fe (II) to Fe(III) and $Fe^0$ to Fe(II), respectively. The scan rate was 50 mv/s at 100° C. Both cyclic voltammograms also exhibited nucleation loop and overpotential of the iron electrodeposition at −1.5 V. However, the reduction peak of Fe(II) to $Fe^0$ in 1:2 (mol/mol) TMACl/urea represented a higher electrodeposition rate (larger current) than did 1:2 (mol/mol) TEACl/urea.

"Overpotential" refers to the energy deviation from an electrode's equilibrium potential necessary to initiate a particular reaction. The equilibrium potential accounts for the surface reaction at the electrode if no external energy is applied and is set to V=0. The overpotential is then the equilibrium potential plus the change ($V+\Delta V$), necessary to shift the surface reactions away from equilibrium and toward iron deposition.

The nucleation loop occurs because of the energetic difference between a bare surface (initial surface) and a surface on which some Fe atoms have already nucleated. As more negative potentials are scanned with an initial, smooth surface, the current at X volts past the overpotential is low. Once some iron is deposited, the energy barrier to deposit even more decreases. As such, when X volts is reached in a scan over the other direction, the current is higher in magnitude because of that lower energy barrier.

Figure 4:
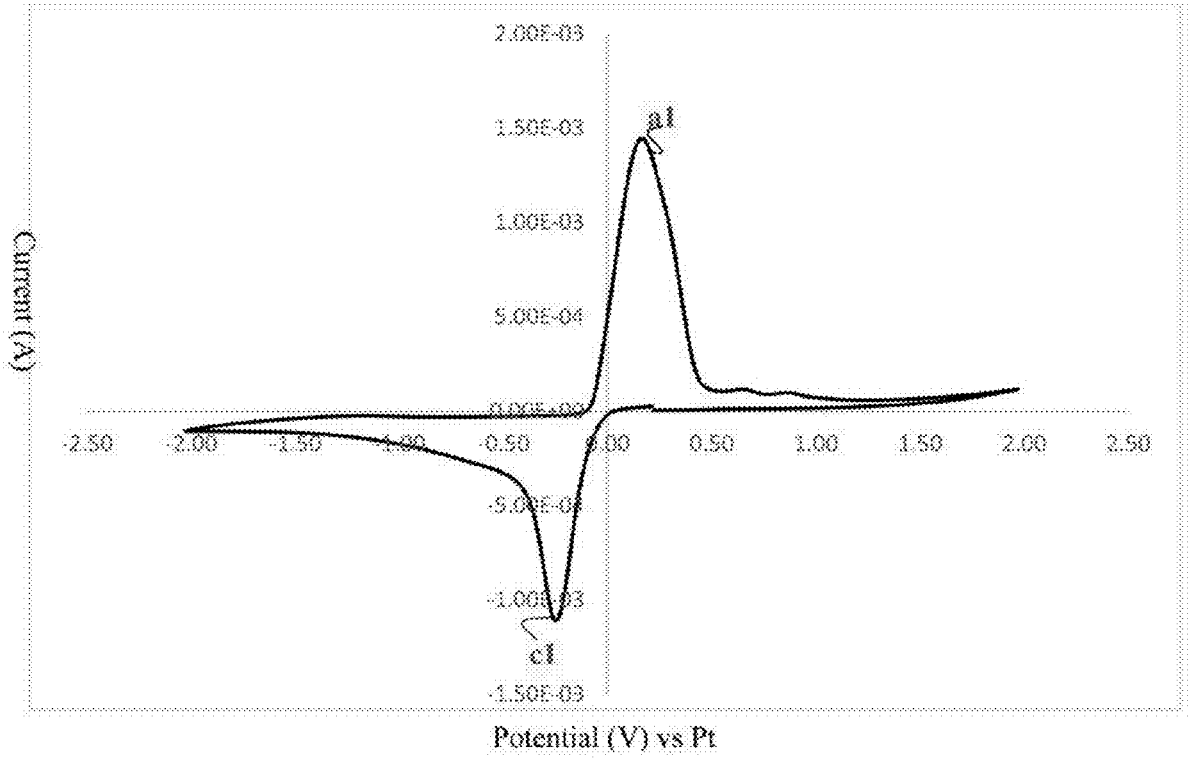
FIG. 4 shows a cyclic voltammogram for 1:2 (mol/mol) TEACl/$FeCl_3$ in the absence of urea.

Referring to FIG. 4, the cyclic voltammogram shows that without urea, only one redox couple (c1/a1) associated with the charge transfer from Fe (III) to Fe(II) is observed, and vice versa. (The scan rate was 50 mv/s, 20° C.) No reduction peaks were observed for iron deposition of Fe(II) to $Fe^0$. Hence, urea is a necessary component for iron electrodeposition.

Figure 5A:
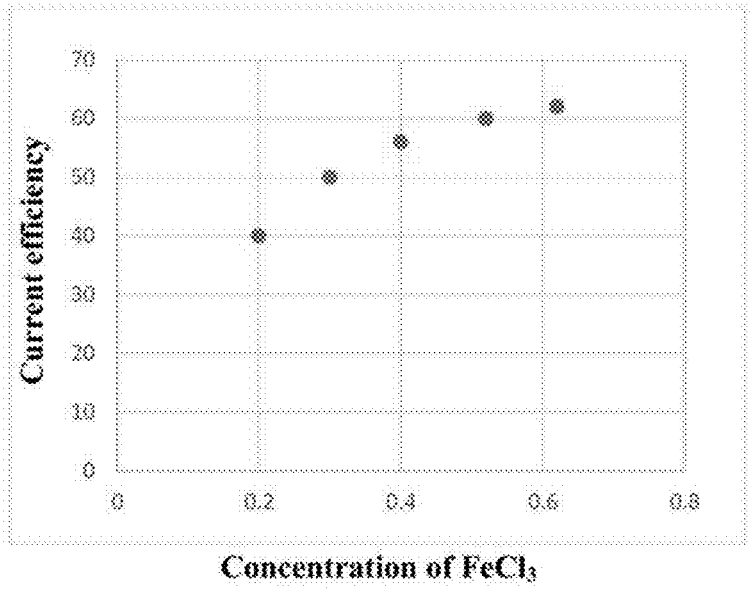
FIG. 5A shows the current efficiency versus varying the concentrations of $FeCl_3$ in 1:2 (mol/mol) TEACl/urea ionic liquid at a constant current of 20 mA.

FIG. 5A shows the current efficiency versus varying the concentrations of $FeCl_3$ in 1:2 (mol/mol) TEACl/urea ionic liquid at a constant current of 20 mA. The current efficiency increases little between the concentrations 0.6 M and 1.0 M $FeCl_3$.

Figure 5B:
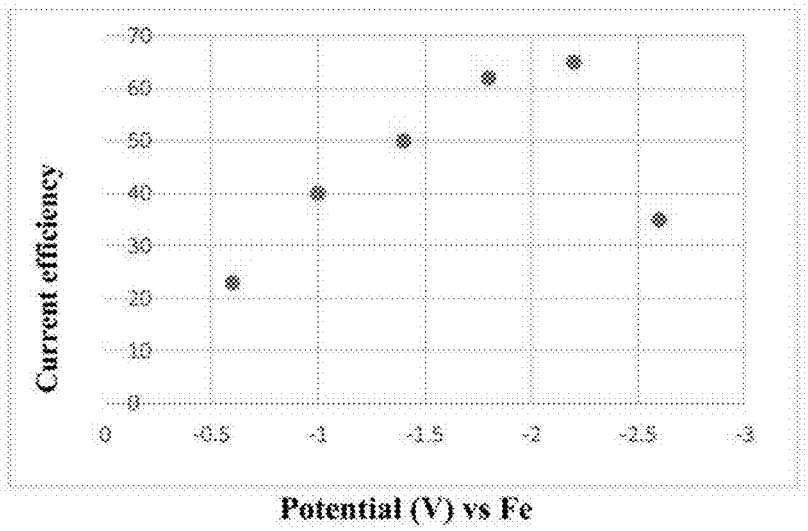
FIG. 5B shows the effect of varying potentials.
Figure 5C:
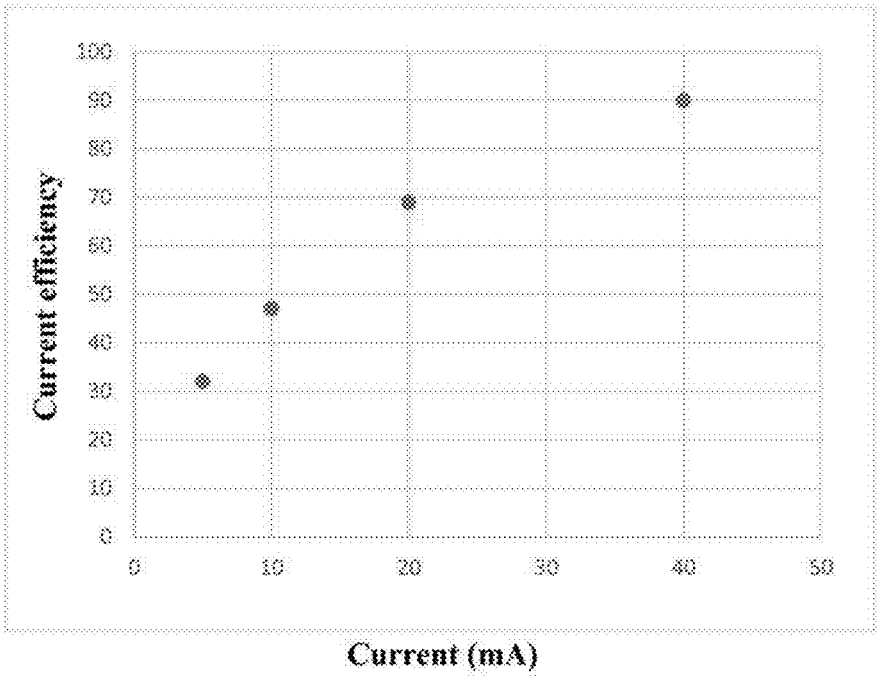
FIG. 5C shows the effect of varying current densities with 0.3 M $FeCl_3$ in 1:2 (mol/mol) TEACl/urea ionic liquid.

FIG. 5B shows the effect of varying potentials, and FIG. 5C shows the effect of varying current densities with 0.3 M $FeCl_3$ in 1:2 (mol/mol) TEACl/urea ionic liquid. The reference electrode was an iron plate, instead of the platinum that is typically used in this type of experiment. At potentials more negative than −2.2 V (the highest current efficiency point on FIG. 5B), the current efficiency drops due to breakdown of the electrolyte. From these data, a potential of −2.2V appears to yield the best operational current efficiency.

FIG. 5C showed the potential versus current density, showing that potential control may not achieve the highest current efficiency. If current density is locked instead, the actual potential may wander during the deposition but may potentially benefit the efficiency.

Figure 6:
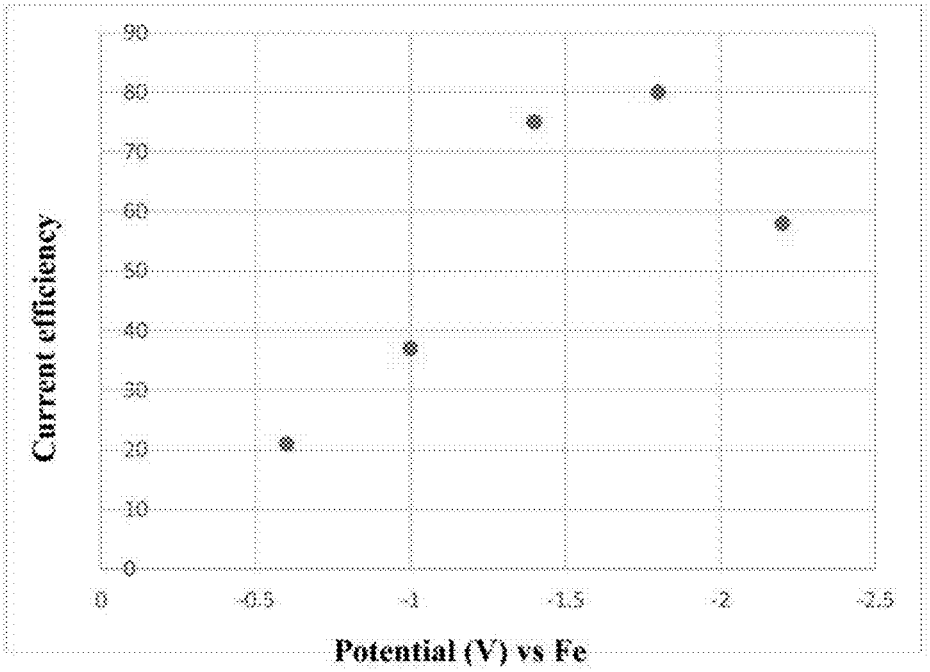
FIG. 6 shows the current efficiency versus varying potentials in 1:2 (mol/mol) TMACl/urea ionic liquid with 0.3 M $FeCl_3$.

Referring to FIG. 6, the current efficiency increases as the applied potential was increased in 1:2 (mol/mol) TMACl/urea ionic liquid with 0.3 M $FeCl_3$. This result is consistent with the results of FIG. 3, where the reduction peak of Fe(II) to $Fe^0$ was more negative than −1.4 V. Although FIG. 3 used a Pt reference electrode and FIG. 6 used an iron reference electrode, the offset between these two electrodes was very low. The upper limit of electrochemical window was roughly the same between them. Therefore, applying more negative potentials increased current efficiency up to the stability boundary of the electrochemical window at about 1.8 V.

Example 2—Grain Size is Potential-Dependent

Figure 7A:
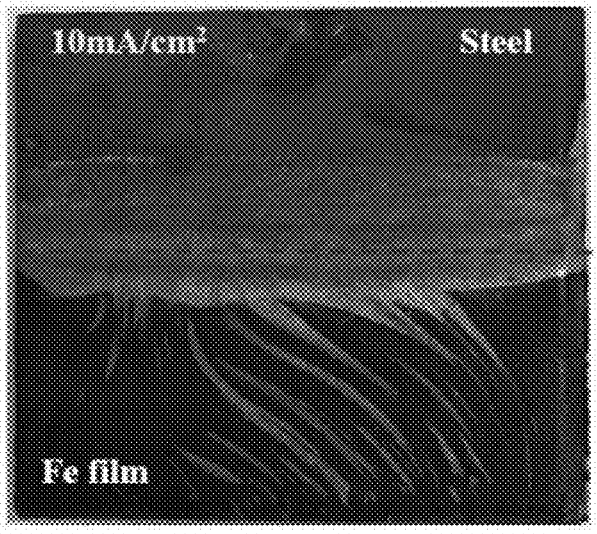
FIGS. 7A-F shows photos (FIGS. 7A, C, and E) and scanning electromicrographs (FIGS. 7B, D, and F) of $Fe^0$ deposits at differing current densities in 1:2 (mol/mol) TEACl/urea ionic liquid with 0.3 M $FeCl_3$, including current densities of 10 mA/cm$^3$ (FIGS. 7A&B), 20 mA/cm$^3$ (FIGS. 7C&D), and 40 mA/cm$^3$ (FIGS. 7E&F). Deposition occurred on the substrate below the dashed line.
Figure 7B:
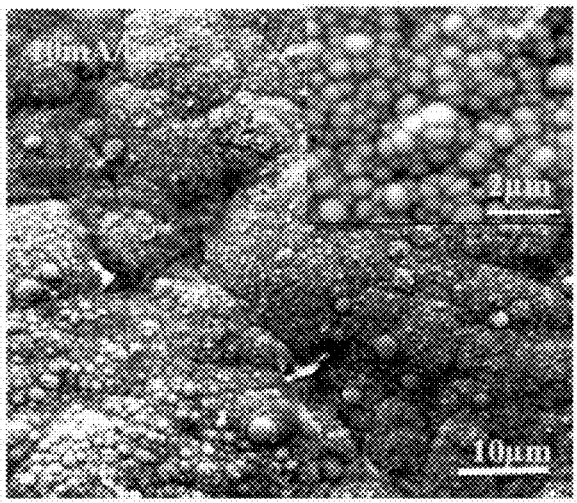
Figure 7C:
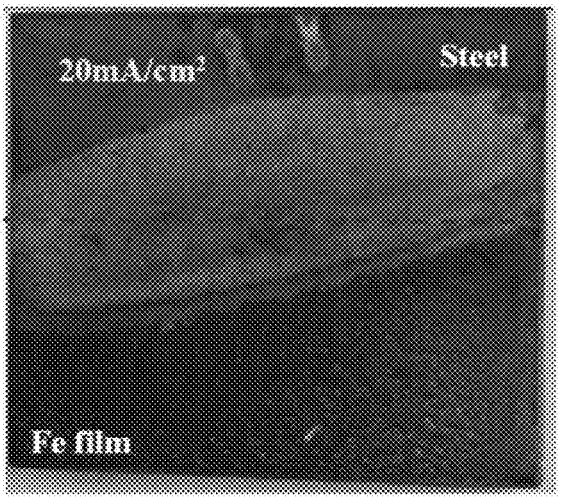
Figure 7D:
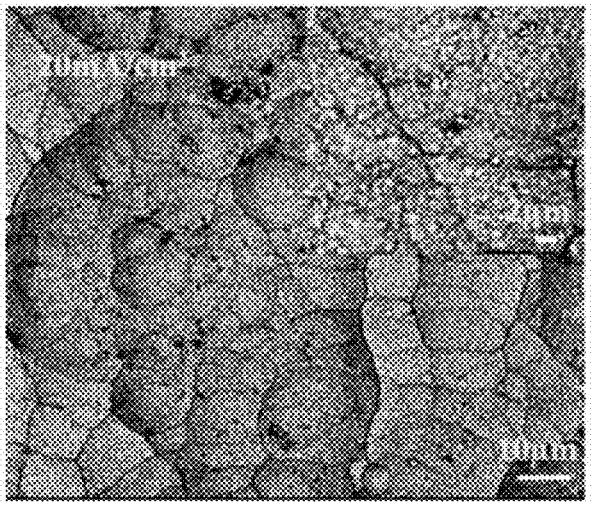
Figure 7E:
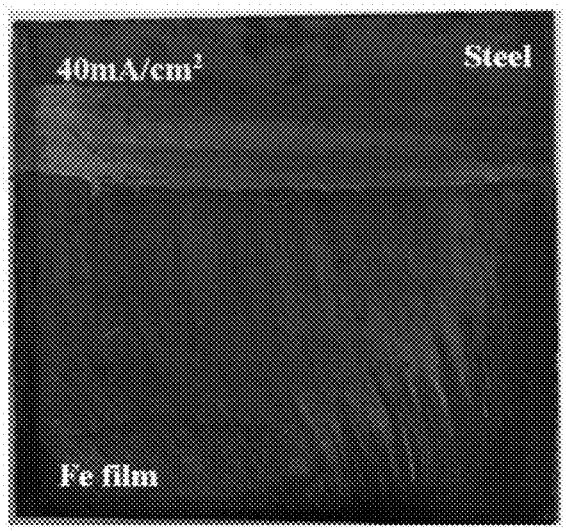
Figure 7F:
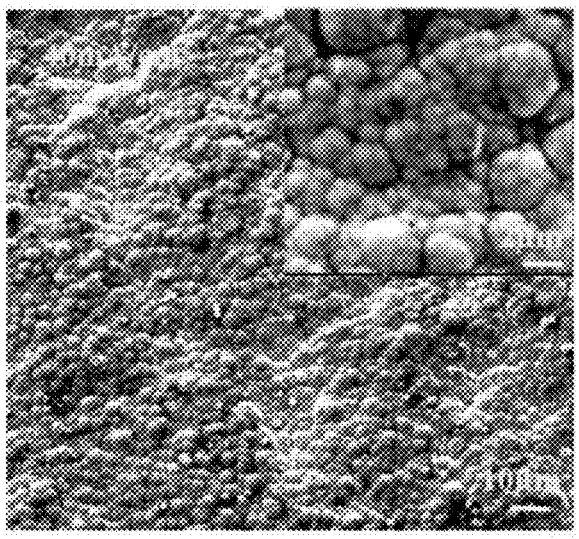

Through several series of SEM images, the average grain size of the deposited metals is shown to depend on the characteristics of the electric potential used, including its current density and the voltage of the reducing potential. FIGS. 7A-F shows photos (FIGS. 7A, C, and E) and scanning electromicrographs (FIGS. 7B, D, and F) of $Fe^0$ deposits at differing current densities in 1:2 (mol/mol) TEACl/urea ionic liquid with 0.3 M $FeCl_3$, including current densities of 10 mA/cm$^3$ (FIGS. 7A&B), 20 mA/cm$^3$ (FIGS. 7C&D), and 40 mA/cm$^3$ (FIGS. 7E&F). The electron micrographs indicated that the grain size of iron deposit at low current density (10 mA/cm$^2$) was between about 500 nm and about 1 μm. As the current density increased, the grain size also increased. For example, the grain size was 1-2 μm at 40 mA/cm$^3$.

Figure 8A:
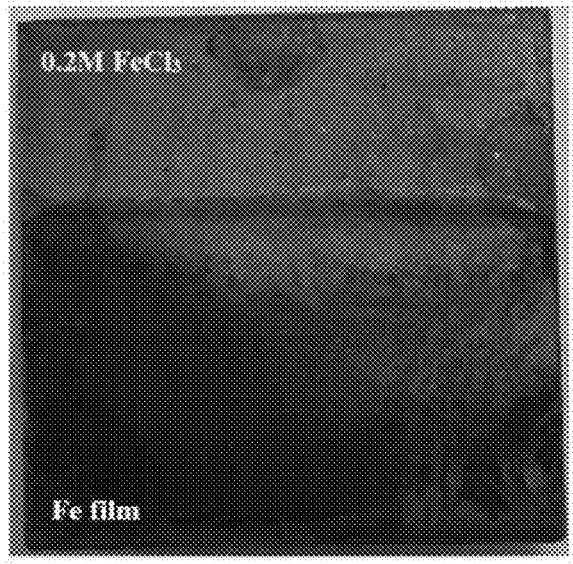
FIGS. 8A-H show photos (FIGS. 8A, C, E, and G) and scanning electromicrographs (FIGS. 8B, D, F, and H) of $Fe^0$ deposits at differing concentrations of $FeCl_3$ in 1:2 (mol/mol) TEACl/urea ionic liquid. The concentrations of $FeCl_3$ were 0.2 M (FIGS. 8A&B), 0.3 M (FIGS. 8C&D), 0.4 M (FIGS. 8E&F), and 0.53 M (FIGS. 8G&H). Deposition occurred on the substrate below the dashed line.
Figure 8B:
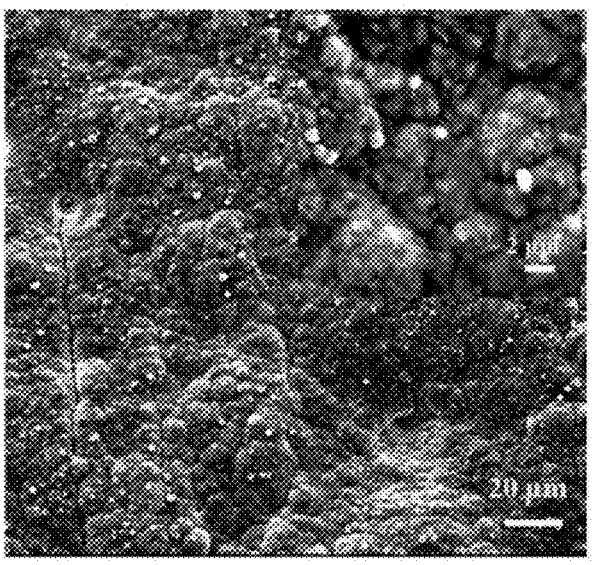
Figure 8C:
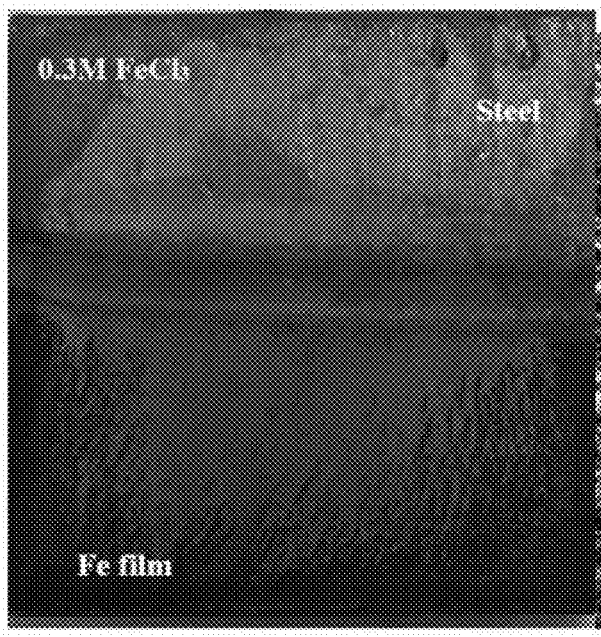
Figure 8D:
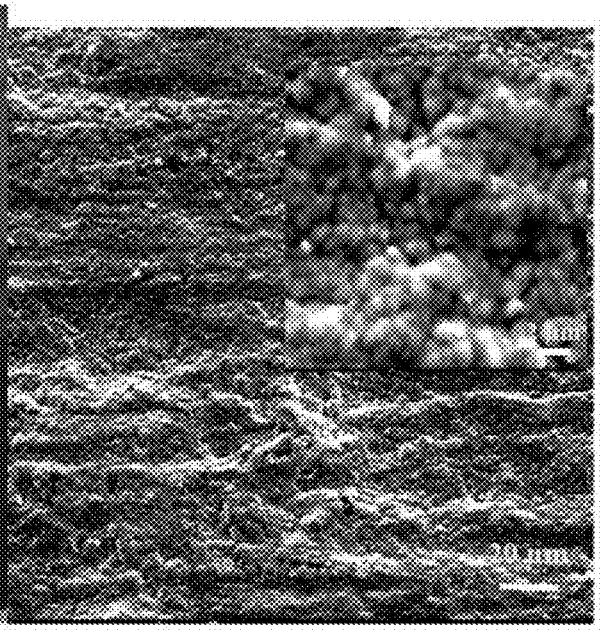
Figure 8E:
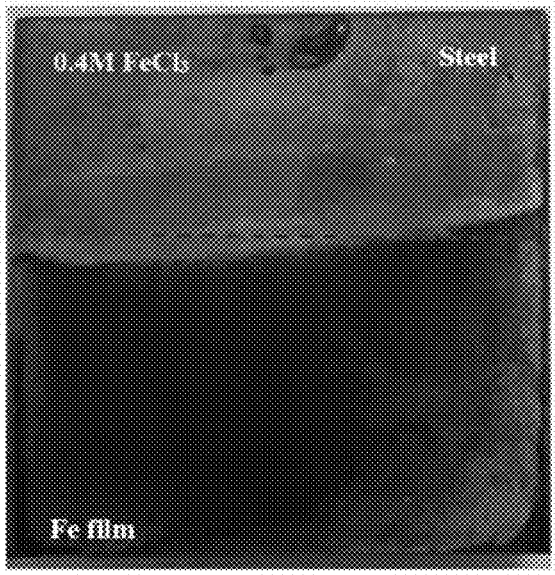
Figure 8F:
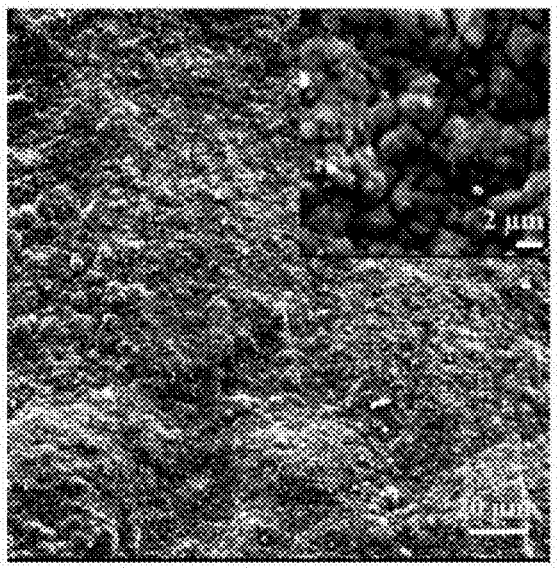
Figure 8G:
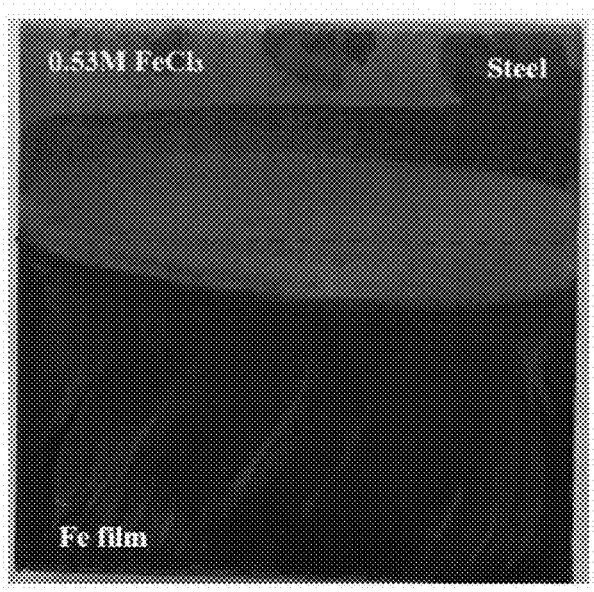
Figure 8H:
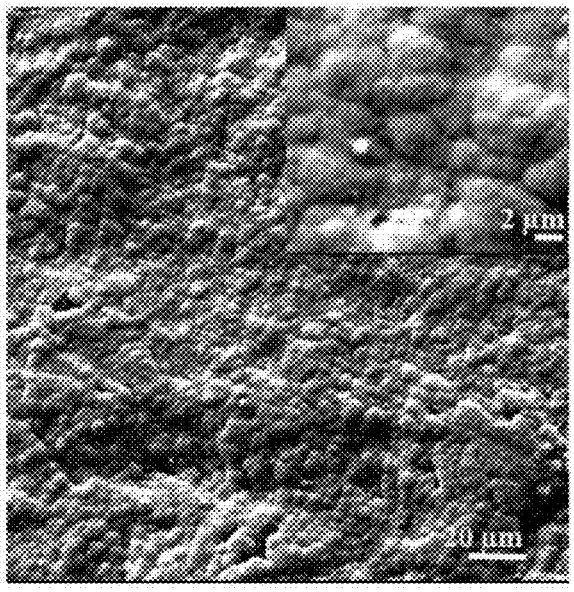
Figure 9A:
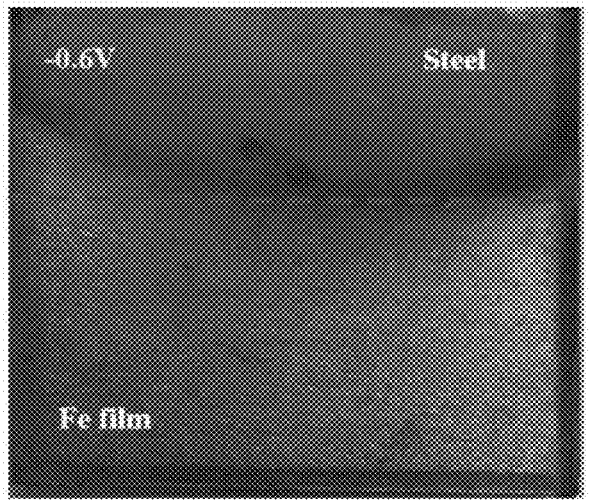
FIGS. 9A-J show photos (FIGS. 9A, C, E, G, and I) and scanning electromicrographs (FIGS. 9B, D, F, H, and J) of potentials tested in in 1:2 (mol/mol) TEACl/urea ionic liquid with a concentration of 0.3 M $FeCl_3$. The potentials were −0.6 V (FIGS. 9A&B), −1.0 V (FIGS. 9C&D), −1.4 V (FIGS. 9E&F), −1.8 V (FIGS. 9G&H), and −2.2 V (FIGS. 9I&J). Deposition occurred on the substrate below the dashed line.
Figure 9B:
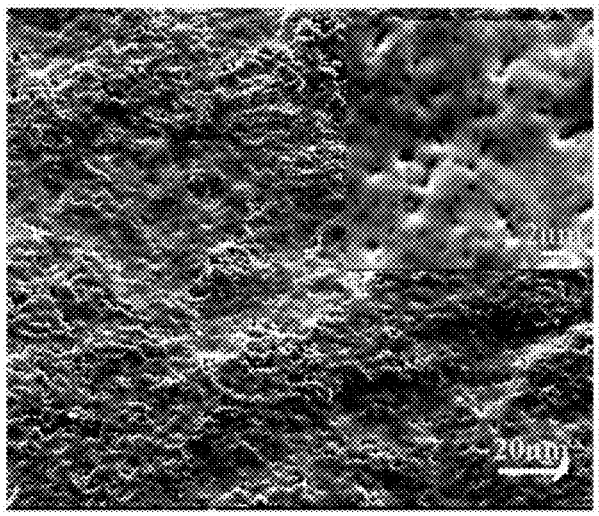
Figure 9C:
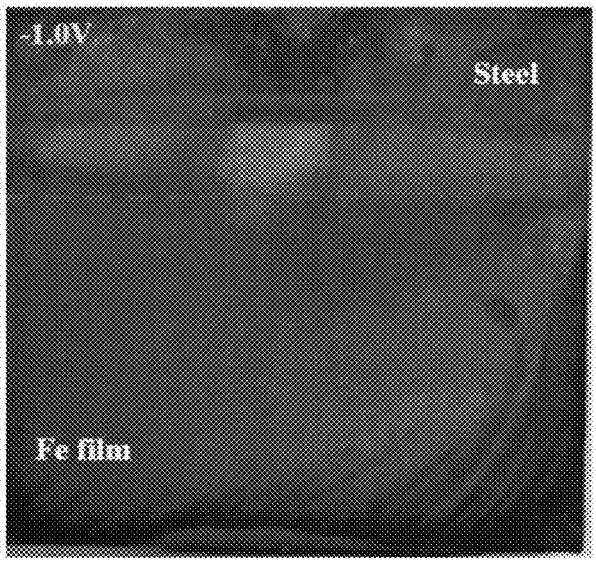
Figure 9D:
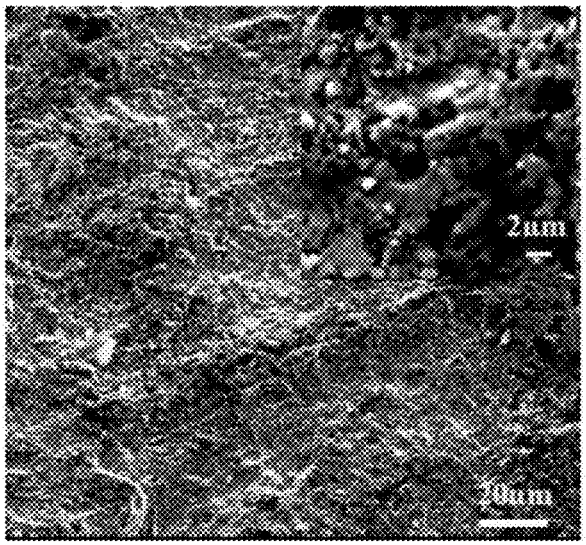
Figure 9E:
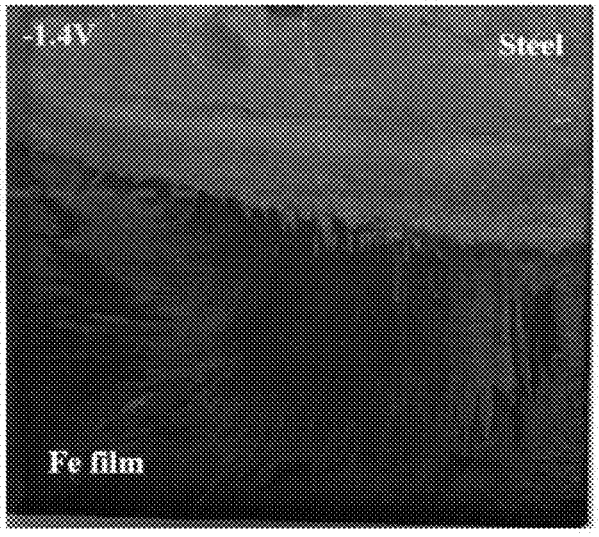
Figure 9F:
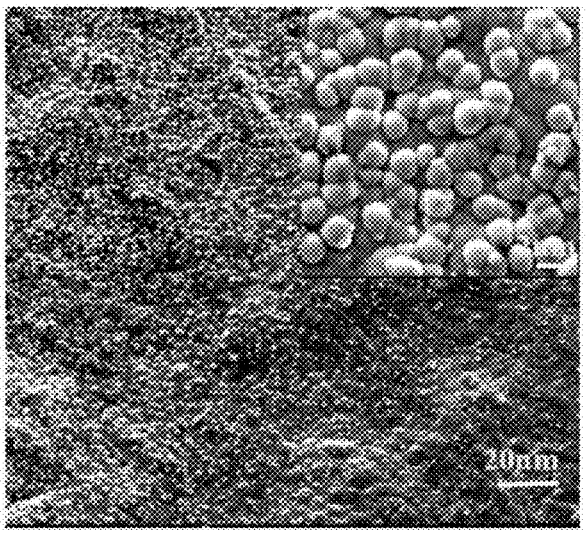
Figure 9G:
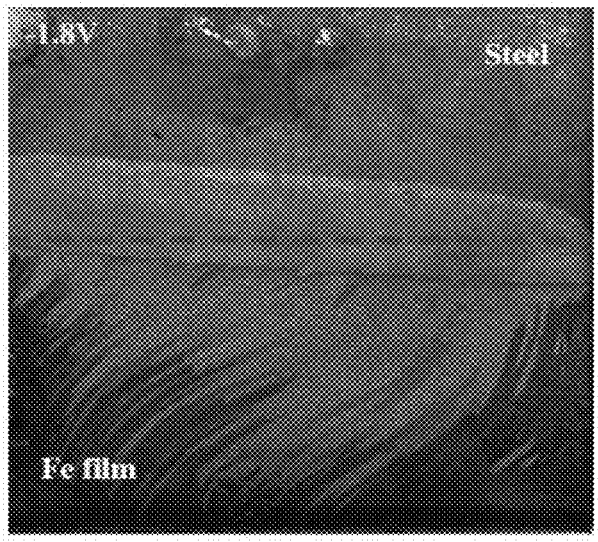
Figure 9H:
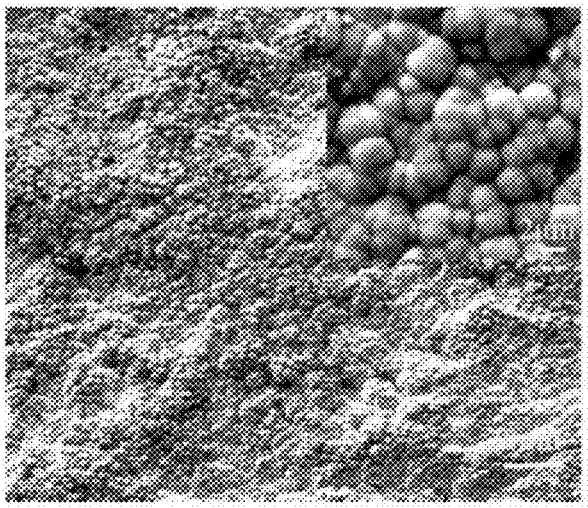
Figure 9I:
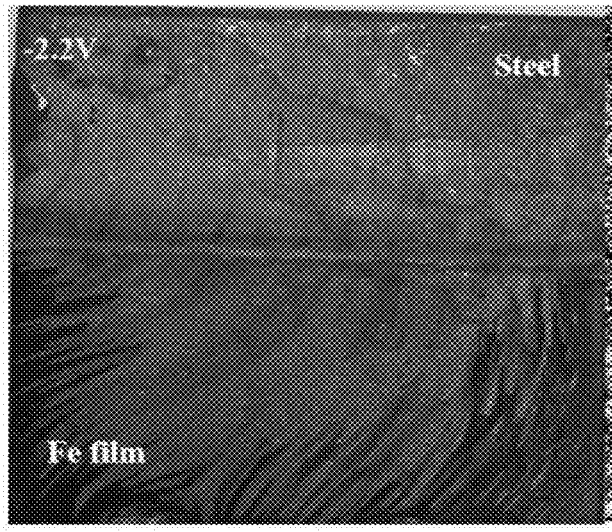
Figure 9J:
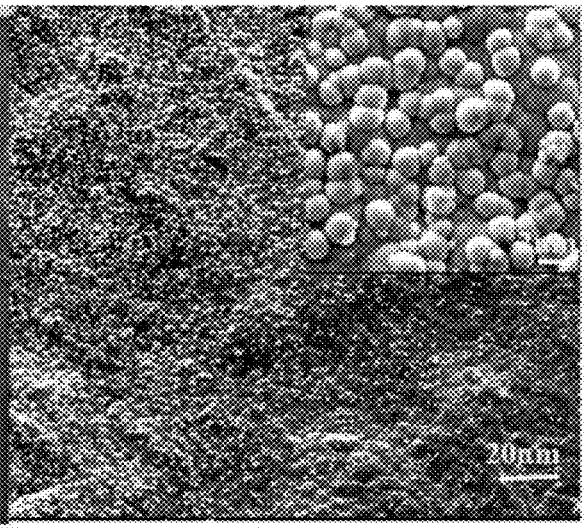
Figure 10A:
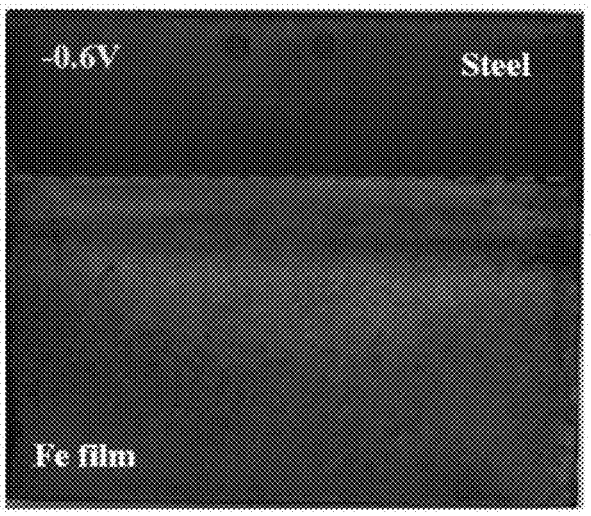
FIGS. 10A-J show photos (FIGS. 10A, C, E, G, and I) and scanning electromicrographs (FIGS. 10B, D, F, H, and J) of potentials tested in in 1:2 (mol/mol) TMACl/urea ionic liquid with a concentration of 0.3 M $FeCl_3$. The potentials measured were the same as those tested above for TEACl/urea ionic liquid at FIG. 8: −0.6 V (FIGS. 10A&B), −1.0 V (FIGS. 10C&D), −1.4 V (FIGS. 10E&F), −1.8 V (FIGS. 10G&H), and −2.2 V (FIGS. 10I&J). Deposition occurred on the substrate below the dashed line.
Figure 10B:
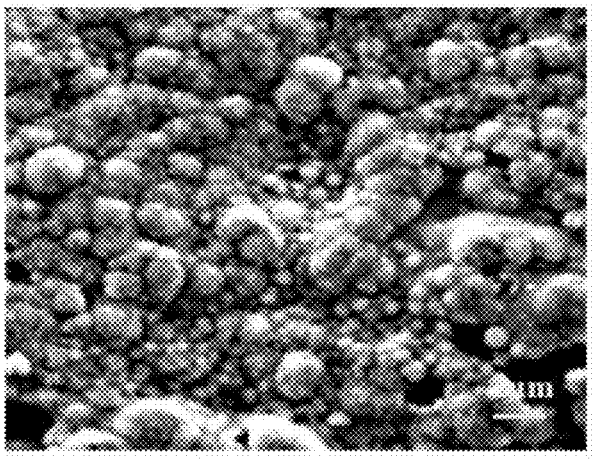
Figure 10C:
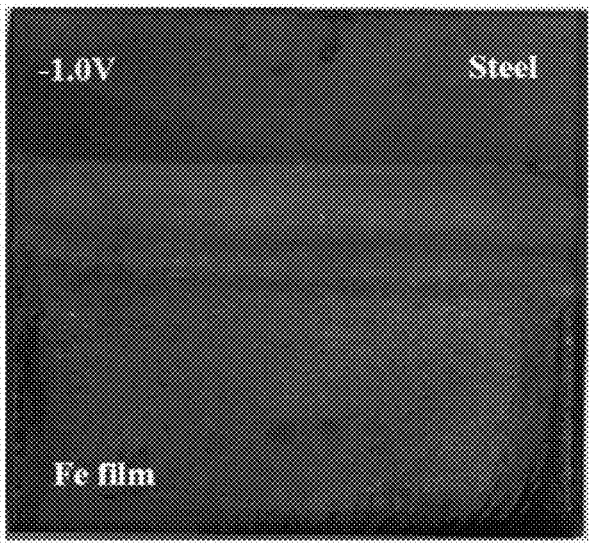
Figure 10D:
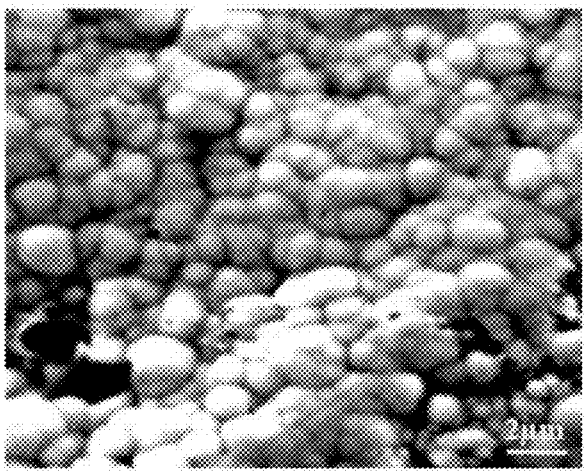
Figure 10E:
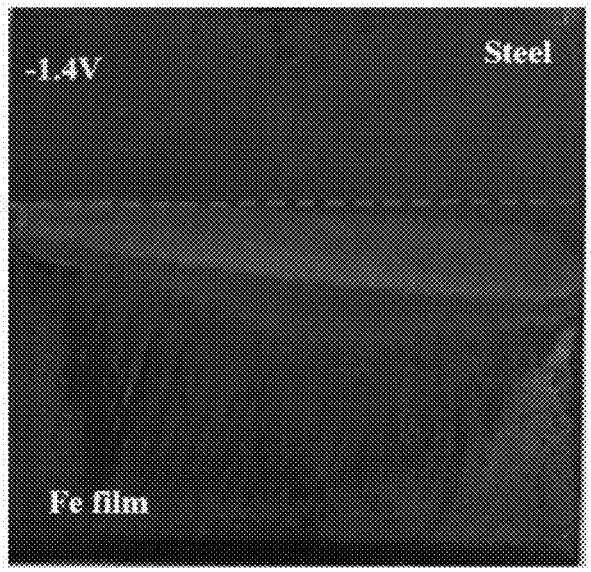
Figure 10F:
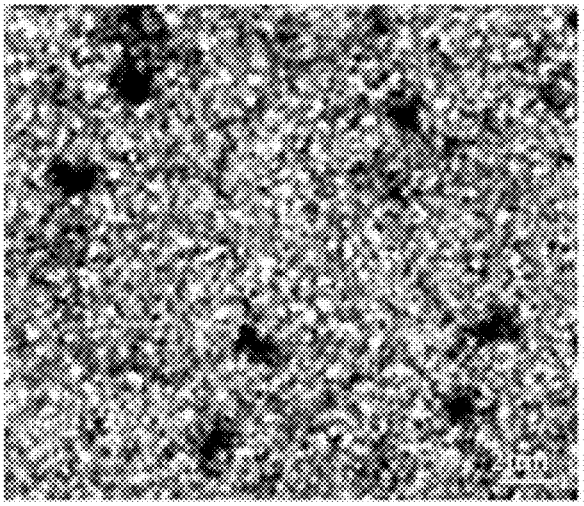
Figure 10G:
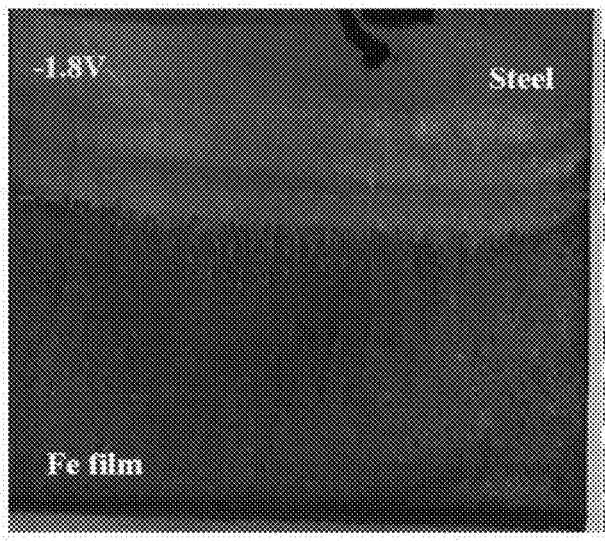
Figure 10H:
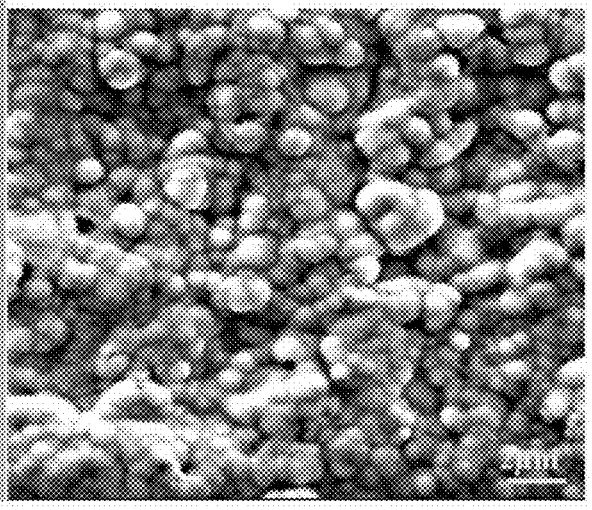
Figure 10I:
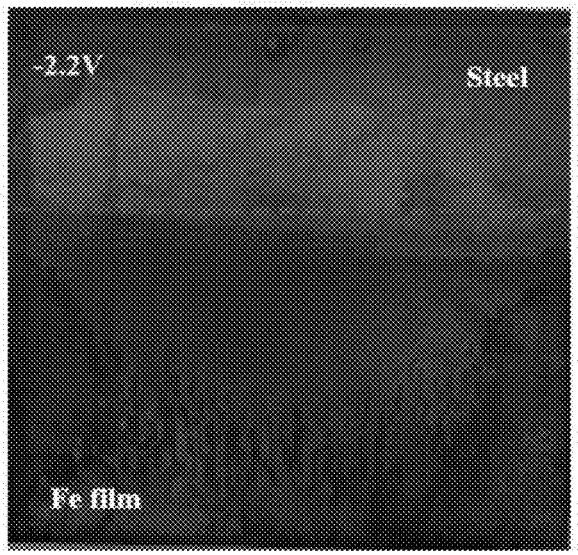
Figure 10J:
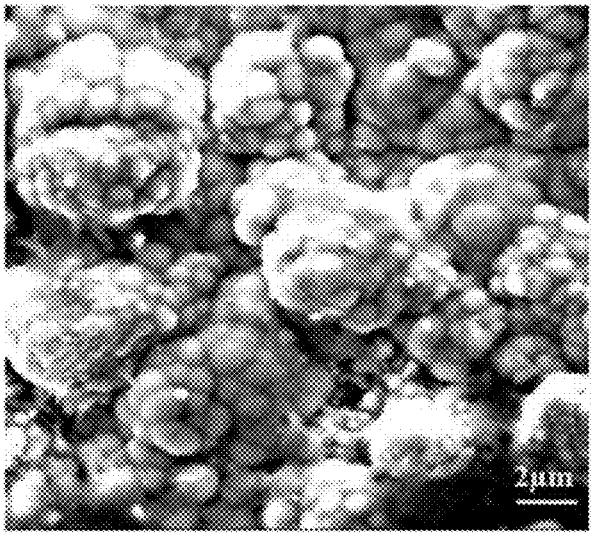

The effect of iron salt concentration in the electrolyte was measured at a constant current density. FIGS. 8A-H show photos (FIGS. 8A, C, E, and G) and scanning electron micrographs (FIGS. 8B, D, F, and H) of $Fe^0$ deposits at differing concentrations of $FeCl_3$ in 1:2 (mol/mol) TEACl/urea ionic liquid at a current density of 20 mA/cm$^3$ at 100° C. The concentrations of $FeCl_3$ were 0.2 M (FIGS. 8A&B), 0.3 M (FIGS. 8C&D), 0.4 M (FIGS. 8E&F), and 0.53 M (FIGS. 8G&H). As the concentration of $FeCl_3$ increased, the grain size appeared to increase slightly, possibly due to the increasing viscosity. Concentrations of greater than or equal to 0.5 M $FeCl_3$ showed the greatest change in surface morphology. At lower concentrations, the dependency was weak.

Referring to FIG. 9, this series of figures shows the visual trend of how varying potential affected the morphology of the iron deposit formed from TEACl/urea ionic liquid. FIGS. 9A-J show photos (FIGS. 9A, C, E, G, and I) scanning electron micrographs (FIGS. 9B, D, F, H, and J) of potentials tested in in 1:2 (mol/mol) TEACl/urea ionic liquid with a concentration of 0.3 M $FeCl_3$. Scanning electron microscopy at the resolution of about 200 nm indicated that at lower reduction potential (−0.6 V, FIGS. 9A&B), the iron deposits looked very smooth without nucleated particles. As the reduction potential increased to −1.0 V (FIGS. 9C&D), a nucleation mechanism becomes apparent. Further, increasing the reduction potential to −1.4 V (FIGS. 9E&F), many nucleated particles appeared and the average grain size average was between about 1 μm and about 2 μm. Thus, the nucleation reduction potential of Fe(II) to iron deposit starts from about −1.4 V. These data correspond well with the features shown in cyclic voltammetric data at FIG. 3. At −1.8 V (FIGS. 9G&H), average particle size was about 2 μm. The potential −2.2 V (FIGS. 9I&J) was close to the boundary of the electrochemical stability window of the electrolyte, causing the grain structure vary more.

The reduction potential experiment was repeated for the 1:2 (mol/mol) TMACl/urea ionic liquid with a concentration of 0.3 M $FeCl_3$. Referring to FIG. 10, the reduction potential of Fe(II) to iron deposit appeared earlier at smaller potentials (−0.6V and −1.0V, FIGS. 10A-D) due to its higher deposition rate compared to 1:2 (mol/mol) TEACl/urea ionic liquid, a result which is consistent the data of FIG. 3 (cf. FIG. 9). This reduction potential of Fe(II) to $Fe^0$ was at −1.4 V (FIGS. 10E&F), very small nucleated particles (about 200 nm) were obtained. As the reduction potential increased to −1.8 V and −2.2 V (FIGS. 10I&J), the grain size is increased.

Example 3—Metal Deposit Purity is Surprisingly High

Figure 11A:
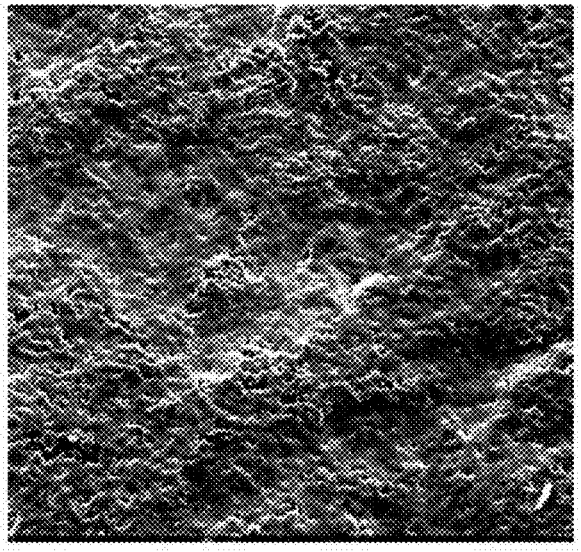
FIGS. 11A&B provide image mapping (FIG. 11A) and energy-dispersive spectrometric (EDS) data (FIG. 11B) of an iron deposit formed under a potential of −1.2 V from 1:2 (mol/mol) TEACl/urea ionic liquid. Deposition occurred on the substrate below the dashed line.
Figure 11B:
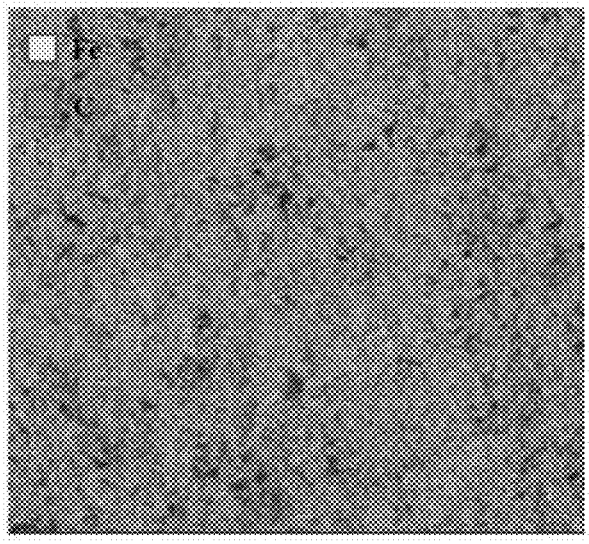

The metal deposits formed following Examples 1 and 2 were exceptionally pure, having very low carbon, oxygen, and chlorine contents. FIGS. 11A-B provide image mapping (FIG. 11A) and energy-dispersive spectrometric (EDS) data (FIG. 11B) of an iron deposit formed under a potential of −1.2 V from 1:2 (mol/mol) TEACl/urea ionic liquid. The highlighting shows the high iron (97%), the low carbon (3%), and low oxygen (<1%) content in the deposited iron metal deposit.

Figure 12A:
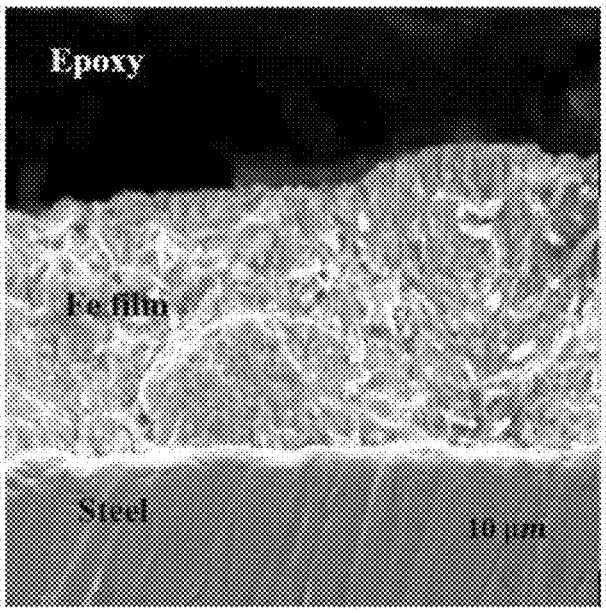
FIGS. 12A&B show grayscale (FIG. 12A) and color-coded (FIG. 12B) cross-sections of iron deposits prepared at −2.0 V (reference electrode is iron) from in 1:2 (mol/mol) TEACl/urea ionic liquid with 0.3 M $FeCl_3$.
Figure 12B:
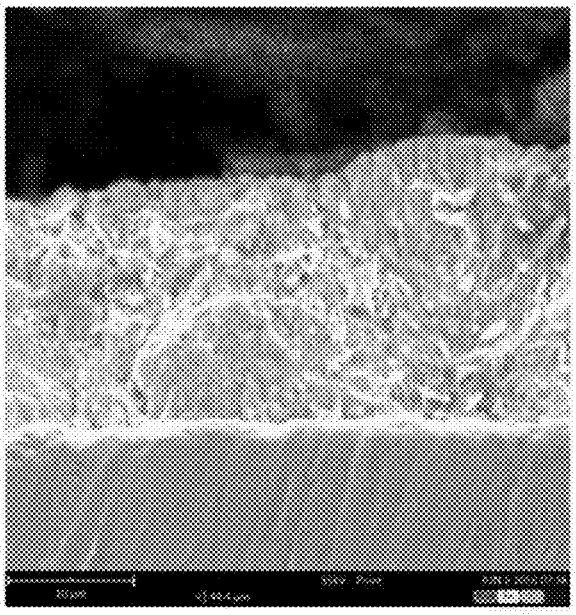
Figure 13A:
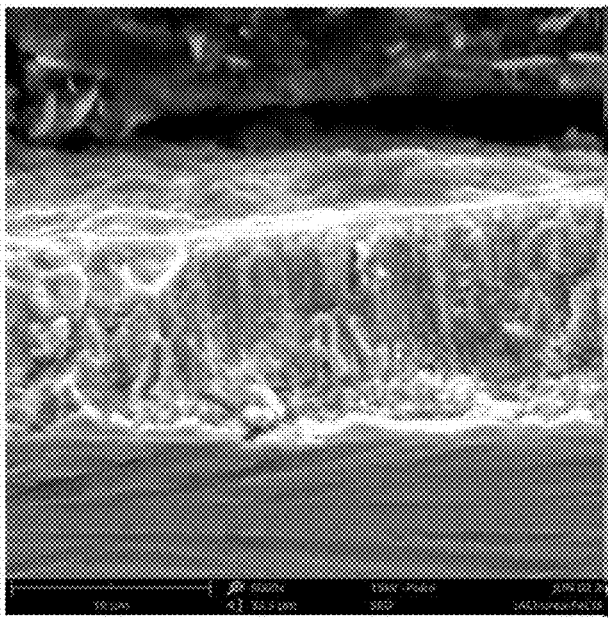
FIGS. 13A&B show grayscale (FIG. 13A) and color-coded (FIG. 13B) cross-sections of iron deposits prepared at −1.8 V (reference electrode is iron) from in 1:2 (mol/mol) TMACl/urea ionic liquid with 0.3 M $FeCl_3$.
Figure 13B:
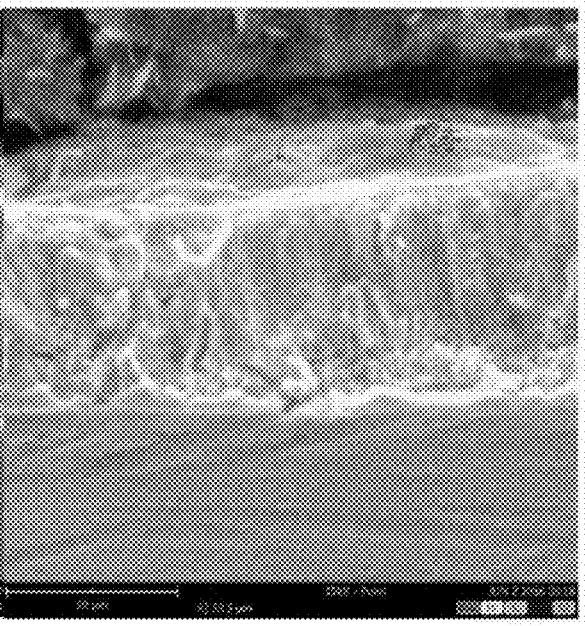

Furthermore, FIGS. 12A&B show grayscale (FIG. 12A) and color-coded (FIG. 12B) cross-sections of iron deposits prepared at −2.0 V (reference electrode is iron) from in 1:2 (mol/mol) TEACl/urea ionic liquid with 0.3 M $FeCl_3$. These measurements were repeated at −1.8 V in TMACl/urea ionic liquid (FIGS. 13A&B). These cross-sections show that the iron deposit was dense and adhered well to the mild steel substrate. In FIGS. 12B and 13B, the carbon-based epoxy remaining cross-sectioning process appeared in teal in the top parts of the figures.

Figure 14A:
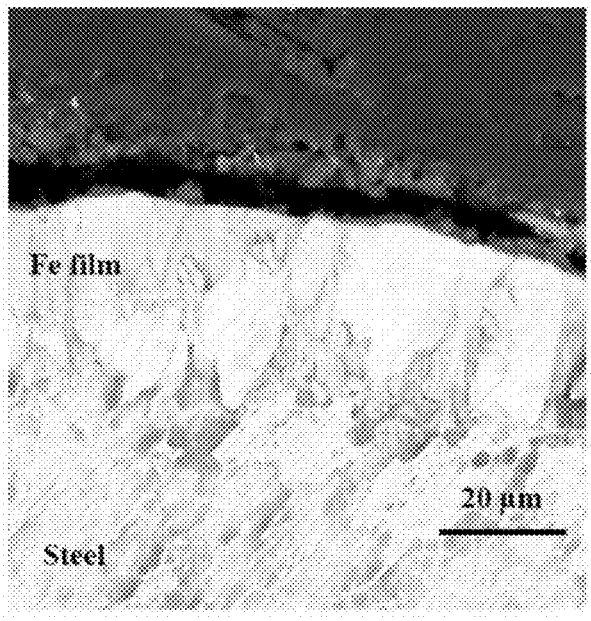
FIGS. 14A&B show grayscale (FIG. 14A) and color-coded (FIG. 14B) cross-sections of iron deposit after electropolishing at −2.0 V (reference electrode is iron) in 1:2 (mol/mol) TEACl/urea ionic liquid.
Figure 14B:
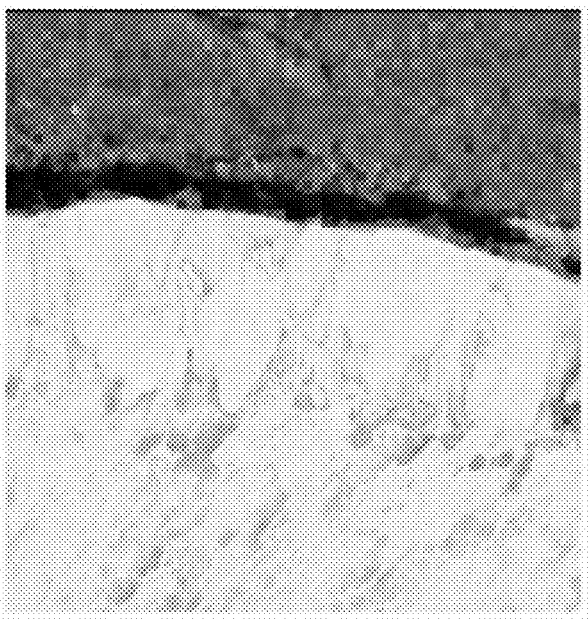

The cross-sections of FIG. 12 were electropolished. Referring to FIG. 14, the electropolished cross-section showed significant corrosion and pitting of the mild steel substrate but very little corrosion on the iron deposit itself. The iron deposit was very pure and dense, with higher corrosion resistance than the mild steel substrate. The corroded areas of the substrate indicated that the iron deposit penetrated the rough surface features of steel substrate, leading to strong adhesion of the iron deposit to the substrate.

Figure 15:
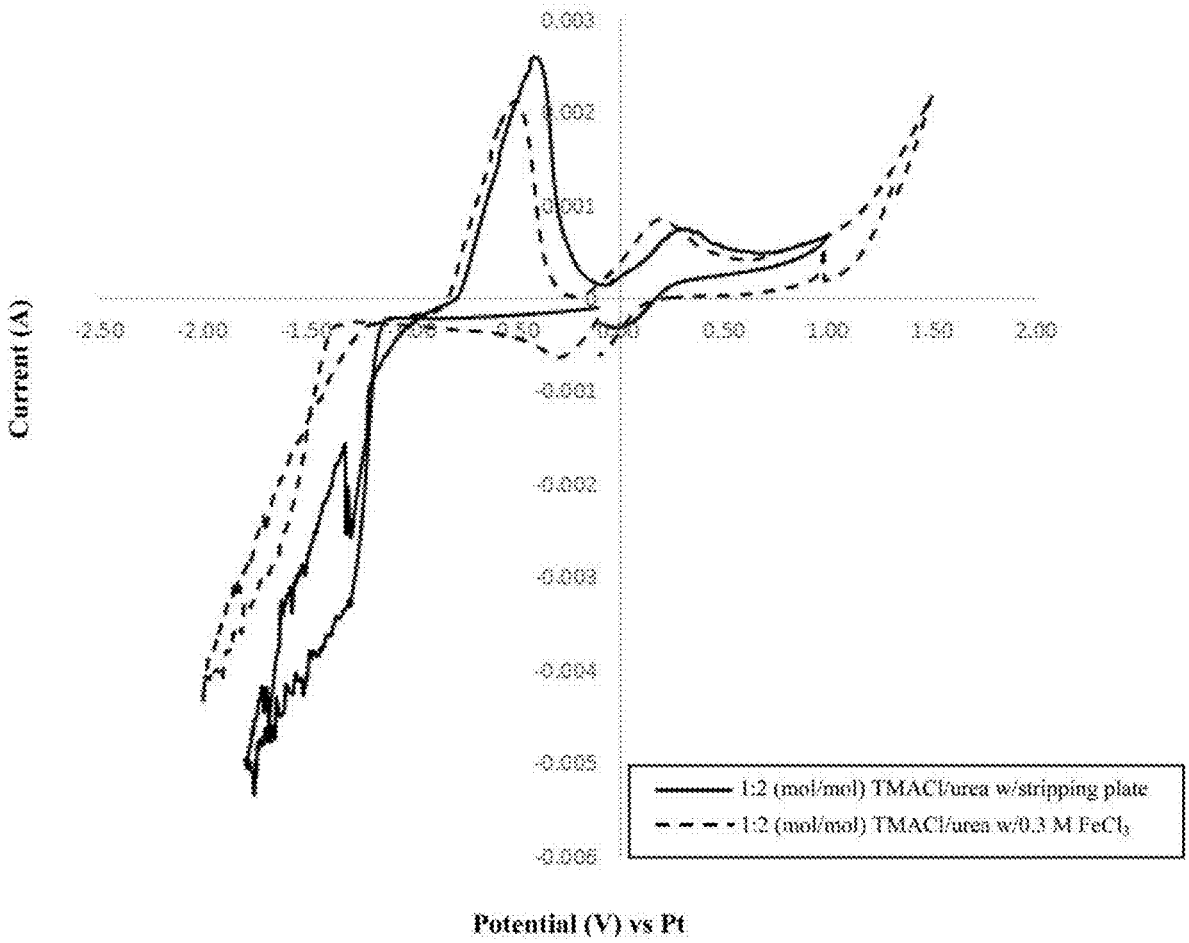
FIG. 15 shows a cyclic voltammogram of 1:2 (mol/mol) TMACl/urea ionic liquid without $FeCl_3$ on glassy carbon electrode after stripping an iron plate (solid line) and with $FeCl_3$ (dashed line).

Referring to FIG. 15, iron was provided to the electrolyte by stripping/corroding an iron plate into 1:2 (mol/mol) TMACl/urea ionic liquid, instead of including $FeCl_3$ in the electrolyte. The iron ions formed Fe-urea complexes in the electrolyte. The cyclic voltammetric data indicated that the Fe-urea complex formed from stripped iron and the dissolved $FeCl_3$ both exhibited a reduction nucleation loop. The overpotential of the iron electrodeposition of the Fe-urea complex was more positive at −1.2 V than −1.4 V for $FeCl_3$, possibly because additional $Cl^-$ from $FeCl_3$ changed the interfacial energy barriers, or because the stripped Fe was more stably reduced; that is, a higher concentration of the active Fe-urea complex was more easily reduced than was $FeCl_3$.

Figure 16A:
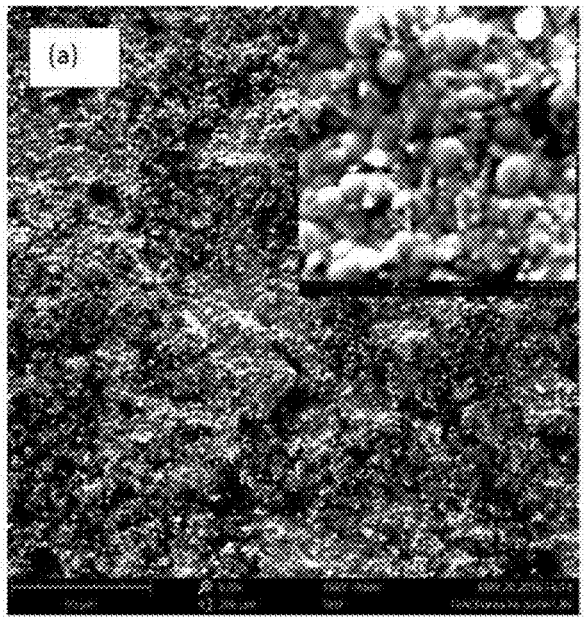
FIGS. 16A&B are scanning electromicrographs of iron deposits in (FIG. 16A) 1:2 (mol/mol) TEACl/urea ionic liquid at −1.8 V without $FeCl_3$, and (FIG. 16B) 1:2 (mol/mol) TMACl/urea ionic liquid at −1.4 V without $FeCl_3$. Stripping this iron plate provided the iron source in the electrolyte.
Figure 16B:
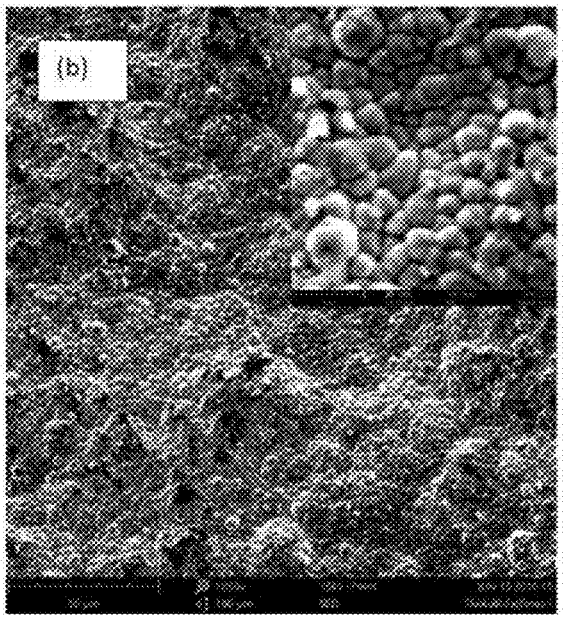
FIG. 16C shows the EDS data for FIG. 16A.
FIG. 16D shows the EDS data for FIG. 16B.

FIGS. 16A&B are scanning electron micrographs of iron deposits in (FIG. 16A) 1:2 (mol/mol) TEACl/urea ionic liquid at −1.8 V without $FeCl_3$, and (FIG. 16B) 1:2 (mol/mol) TMACl/urea ionic liquid at −1.4 V without $FeCl_3$. The counter and reference electrodes were an iron plate. Stripping this iron plate provided the iron source in the electrolyte. The electromicrographs (FIGS. 16A&B) showed that iron deposits from stripping iron plate had average grain sizes average both ionic liquids are between about 1 μm and about 3 μm, as previously demonstrated at these reduction potentials.

Figure 16C:
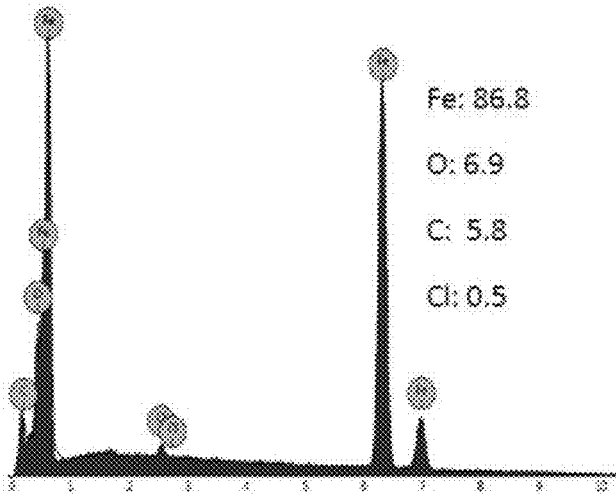
Figure 16D:
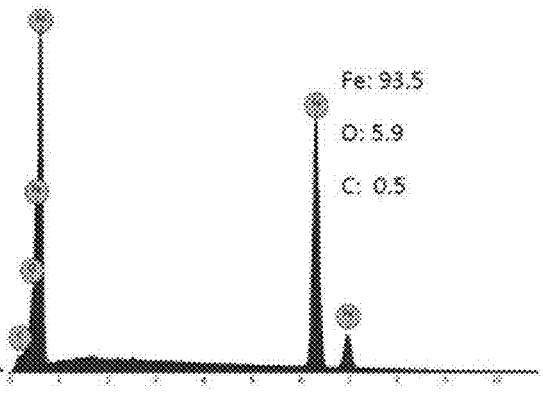

FIG. 16C shows the EDS data for FIG. 16A collected with 338,848 counts in 67 seconds, revealing 86.5% Fe, 6.9% 0, 5.8% C, and 0.5% Cl. FIG. 15D shows the EDS data for FIG. 16B collected with 416,284 counts in 67 seconds, revealing 93.5% F, 5.9% 0, and 0.5% C. The concentration of chloride was within the scanning electron microscope's detectable error. The concentration of carbon was very low and potential-dependent for both ionic liquids. The concentration of oxygen shown here did not represent the ultra-low oxygen concentrations content resulting from electrodeposition. The observed concentrations were much higher (1) because flash oxidation occurred once the sample was removed from the deposition chamber and exposed to air, and (2) because the higher surface area substrates generally yielded proportionately higher oxygen levels not represented in bulk concentrations. A bare mild steel substrate usually reflects an oxygen concentration of about 6%. Thus, the present deposition methods using trialkylamine chloride/urea ionic liquids yielded highly pure iron deposits. Remarkably, no traces of nitrogen were observed in any of the samples prepared and tested.

Example 4—Molar Ratios in the Ionic Liquid Affect the Properties of the Metal Deposit The molar ratios of trialkylamine halide and urea between 1:1 and 1:30 were explored. SEM data indicated that iron was deposited using any ratio of TEACl/urea or TMACl/urea tested, but that the properties of the electrolyte and the deposit varied. At ratios above 1 TEACl to 30 urea, components had difficulty solubilizing homogeneously. Morphology shifted more toward two-dimensional growth across the surface of the substrate when urea ratios increased, demonstrating the role of urea in reducing dissolved iron. As more urea complexed with Fe from anodic stripping or from $FeCl_3$, the overpotential of Fe(II) to the $Fe^0$ deposit decreased. The positive shift of overpotential was greater for triethylamine than for trimethylamine (which had a lower overpotential initially).

Figure 17:
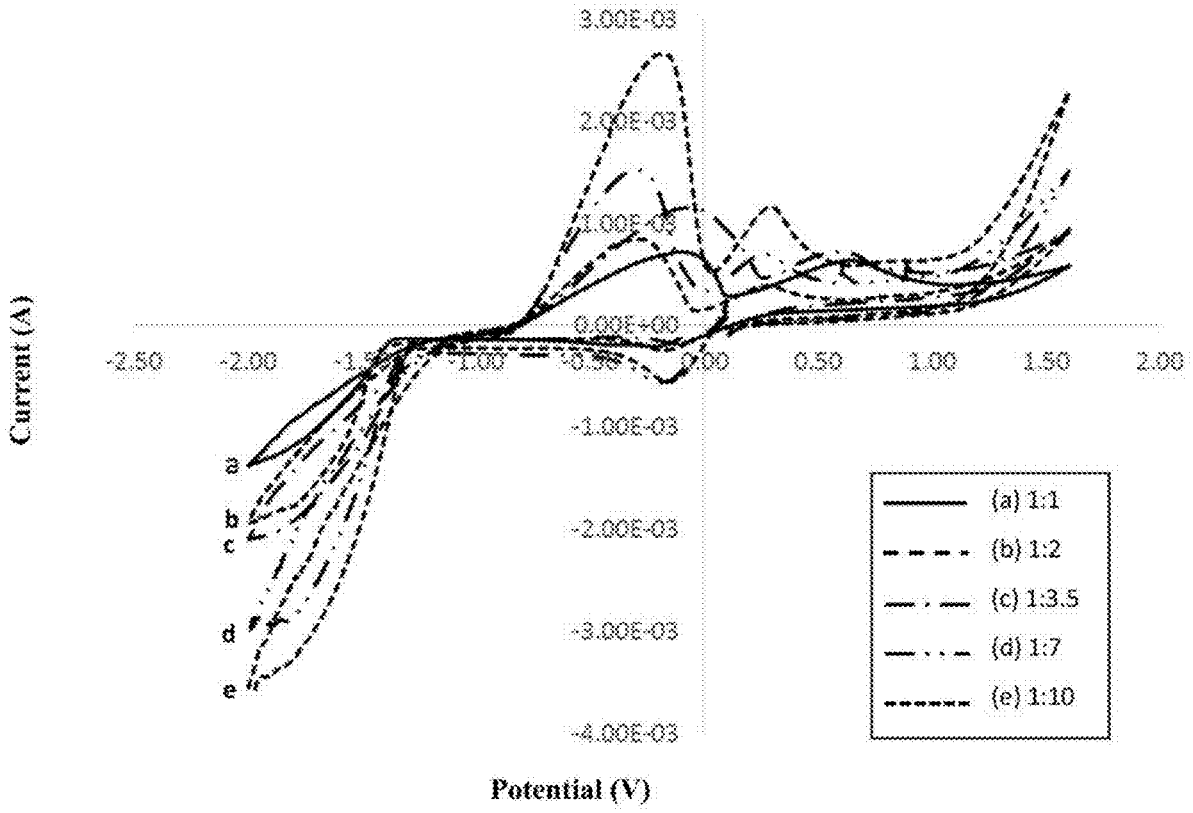
FIG. 17 shows a cyclic voltammogram of different molar ratios TEACl/urea ionic liquid at (a) 1:1, (b) 1:2, (c) 1:3.5, (d) 1:7 and (e) 1:10, each with a concentration of 0.3 moles of $FeCl_3$ per liter of ionic liquid.

FIG. 17 shows a cyclic voltammogram TEACl/urea ionic liquid at molar ratios of (a) 1:1, (b) 1:2, (c) 1:3.5, (d) 1:7 and (e) 1:10, each with a concentration of 0.3 moles of $FeCl_3$ per liter of ionic liquid. A 1:1 molar ratio of TEACl/urea had some precipitate in the mixture. The mixture was not completely melted at 100° C., but the reduction peak of Fe(II) to $Fe^0$ was nonetheless seen in the cyclic voltammetric data. When the urea concentration was increased to a molar ratio of 1:2-1:10, the solution had no precipitates and the reduction potential of Fe(II) to $Fe^0$ shifted to more positive.

When the urea concentration was increased to a molar ratio of 1:10 TEACl/urea, the mixture was liquid and had lower viscosity than the 1:2 ionic liquid. The reduction peak of Fe(II) to $Fe^0$ also shifted to more positive (FIG. 17, trace (e)). The iron deposits from these 1:10 ionic liquids were extremely smooth and pure. It is very unusual and surprising to see this level of conformity of a deposited layer.

Figure 18A:
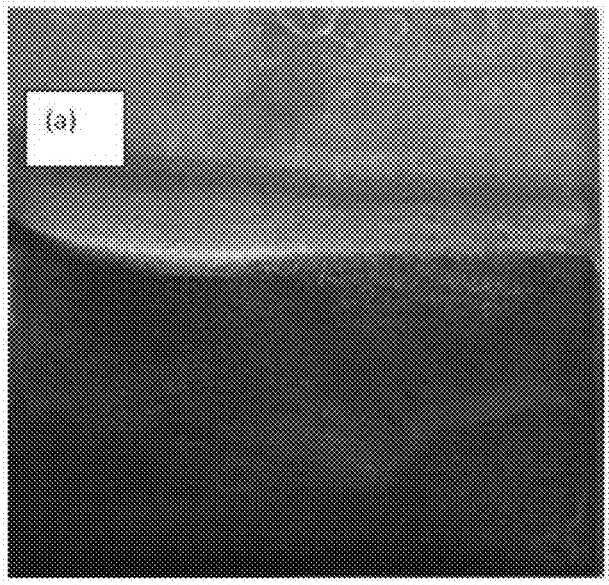
FIGS. 18A-C show photographs (FIGS. 18A&B) and scanning electromicrographs (FIGS. 18C&D) of iron deposits formed from different molar ratios TEACl/urea ionic liquid with 0.3 M $FeCl_3$-1:5 molar ratio at −1.0 V (FIGS. 18A&C), and 1:10 molar ratio at −1.4 V (FIGS. 18B&D).
Figure 18B:
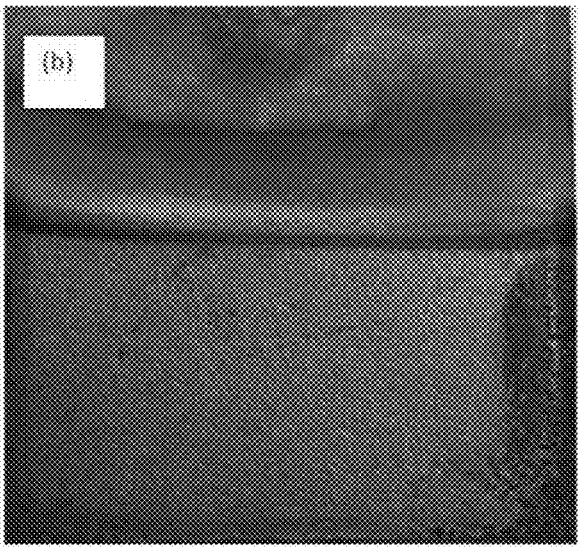
Figure 18C:
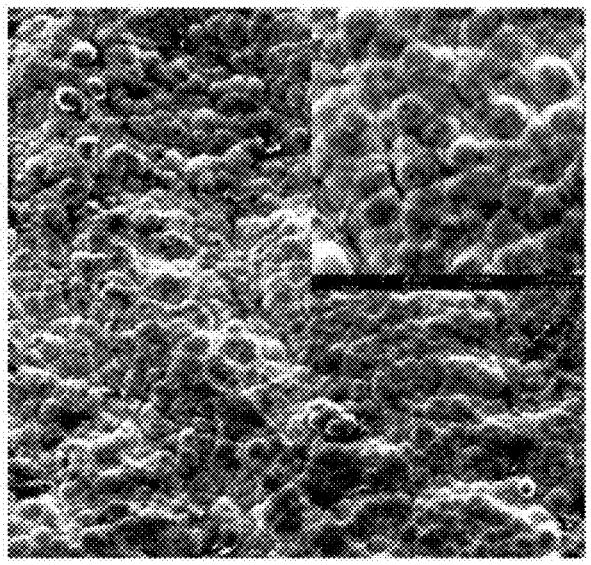
Figure 18D:
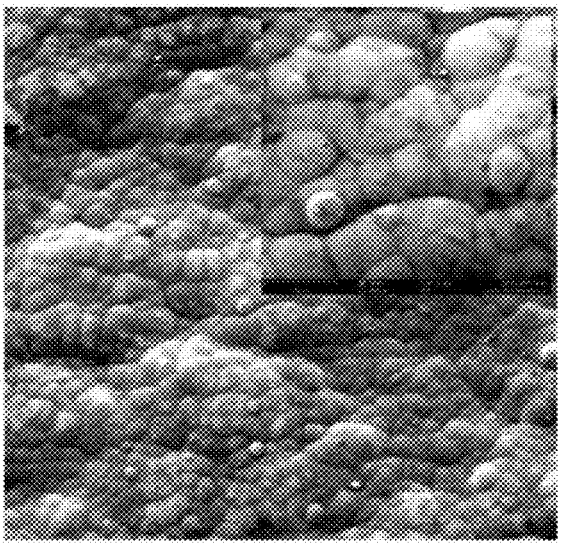

FIGS. 18A-D show photographs (FIGS. 18A&B) and scanning electron micrographs (FIGS. 18C&D) of iron deposits formed from TEACl/urea ionic liquids with 0.3 M $FeCl_3$-1:5 molar ratio at −1.0 V (FIGS. 18A&C), and 1:10 molar ratio at −1.4 V (FIGS. 18B&D). A molar ratio of 1:5 produced a cyclic voltammogram with exceptionally low reduction overpotential (FIG. 17, trace (d)), which behavior likely depends on the $FeCl_3$ concentration. Any texture visible in the photographs is from the substrate itself, and not the deposit.

Figure 19:
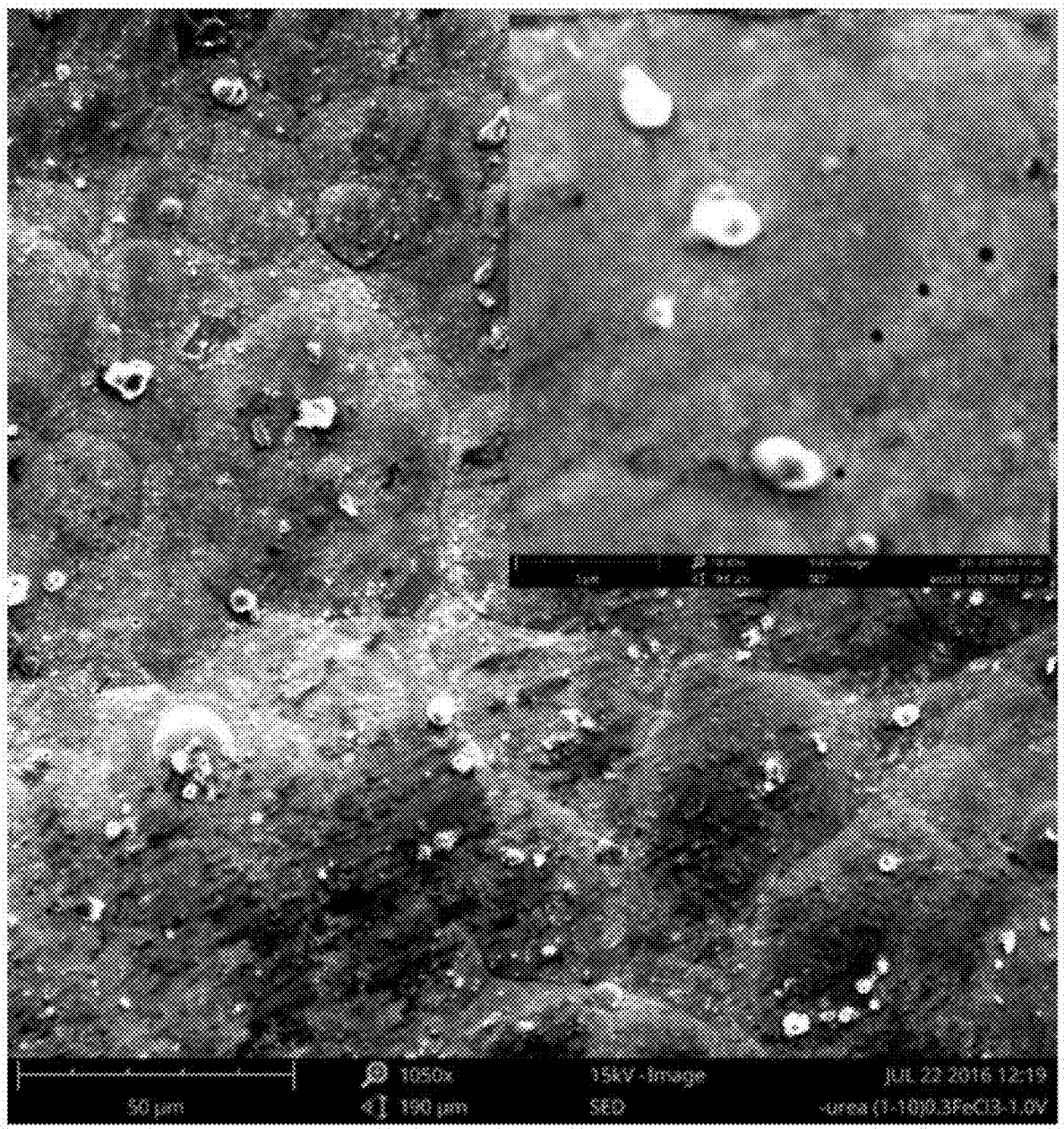
FIG. 19 shows a scanning electromicrograph of an iron deposit on steel formed from 1:10 (mol/mol) TEACl/urea with 0.3 M $FeCl_3$ at potential of −1.0 V.
Figure 20A:
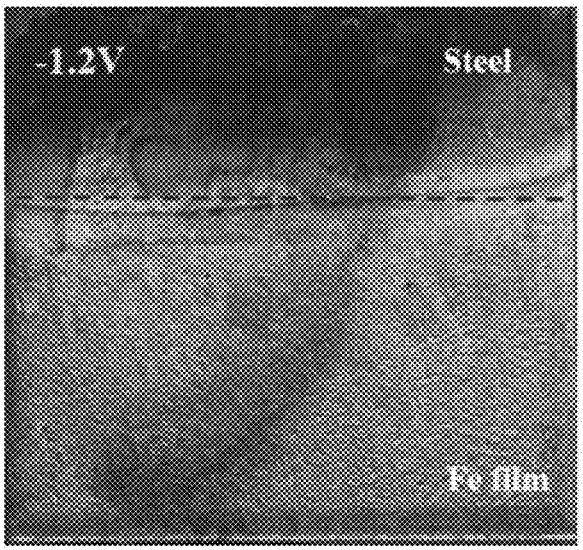
FIGS. 20A-J show photos (FIGS. 20A, C, E, G, and I) and scanning electromicrographs (FIGS. 20B, D, F, H, and J) of potentials tested in 1:10 (mol/mol) TEACl/urea ionic liquid with a concentration of 0.3 M $FeCl_3$: −1.2 V (FIGS. 20A&B), −1.4 V (FIGS. 20C&D), −1.6 V (FIGS. 20E&F), −1.8 V (FIGS. 20G&H), and −2.0 V (FIGS. 20I&J).
Figure 20B:
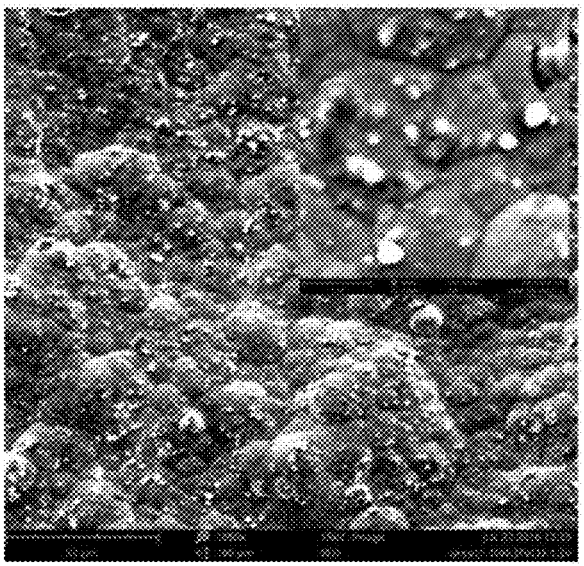
Figure 20C:
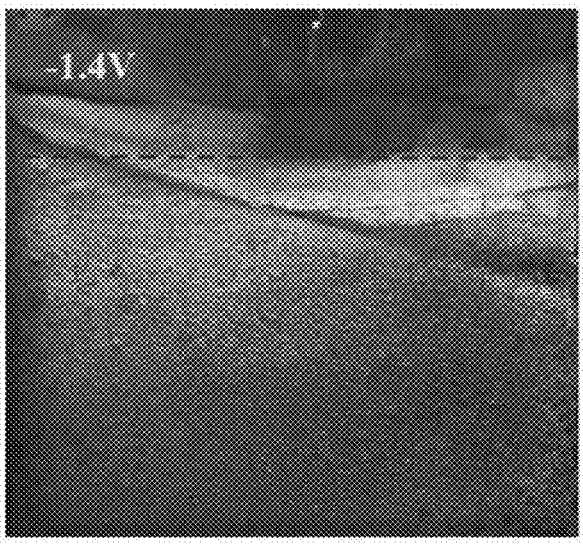
Figure 20D:
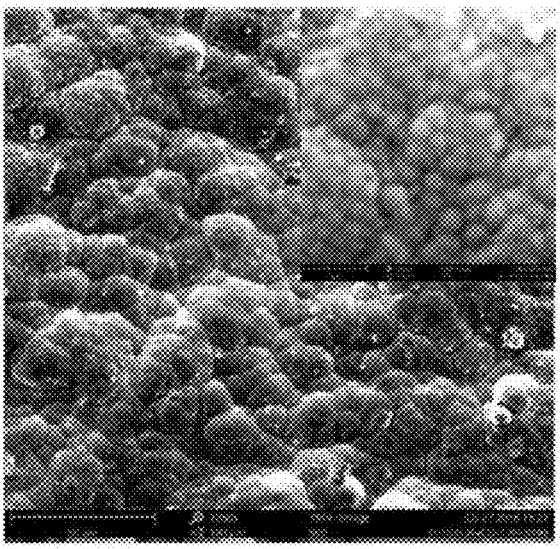
Figure 20E:
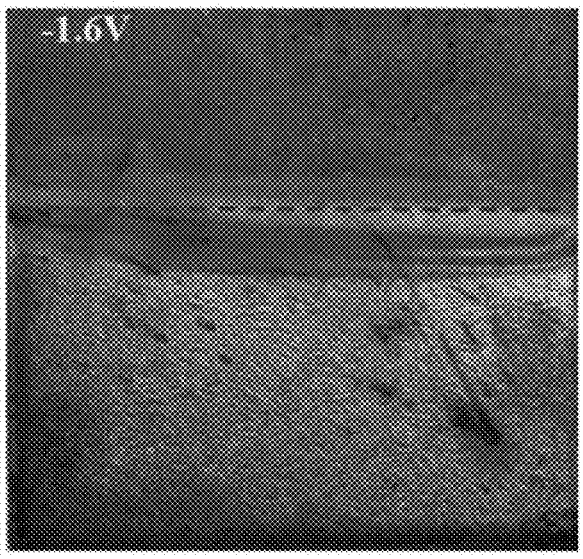
Figure 20F:
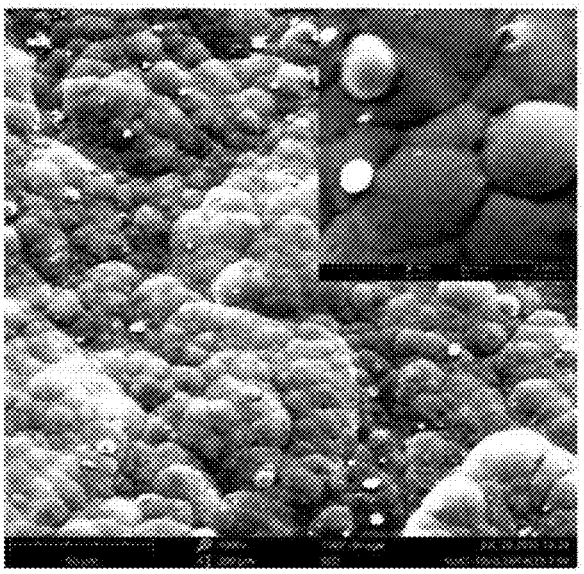
Figure 20G:
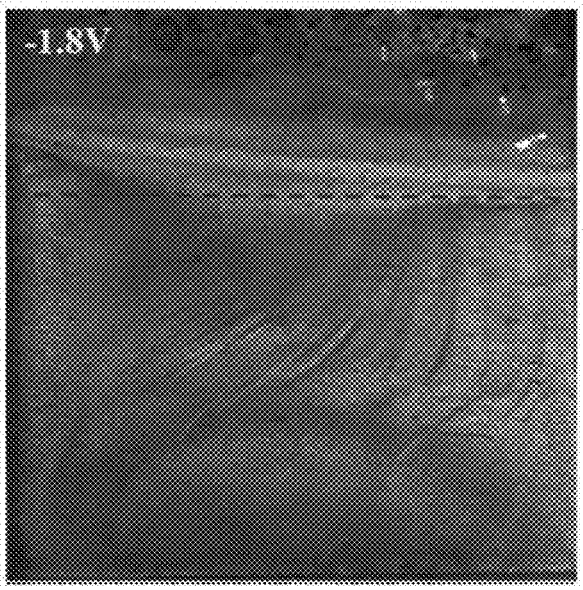
Figure 20H:
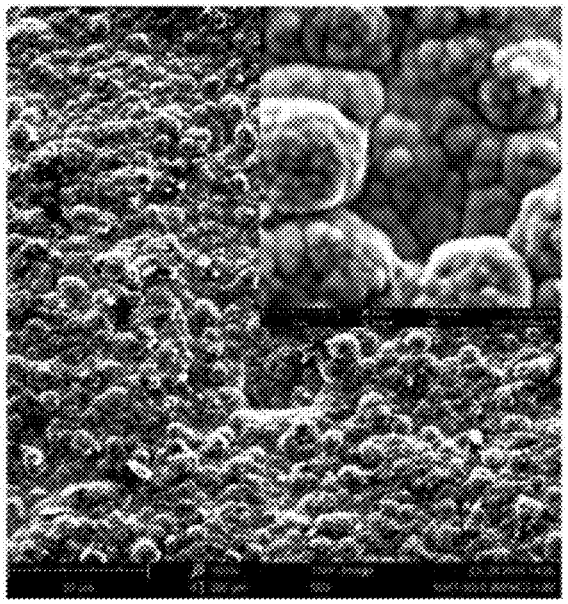
Figure 20I:
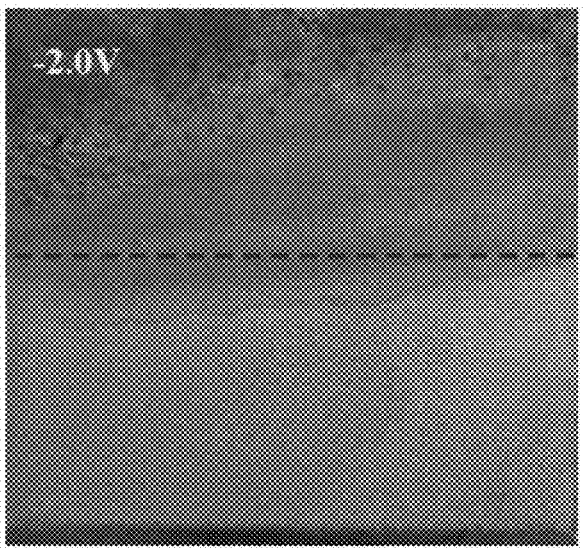
Figure 20J:
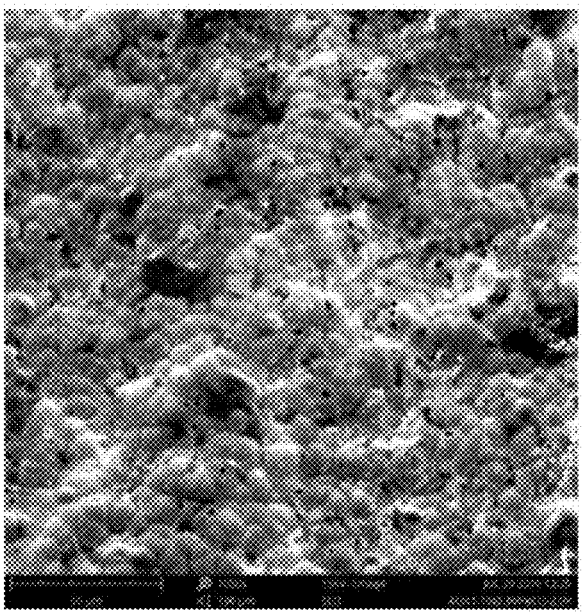
Figure 21:
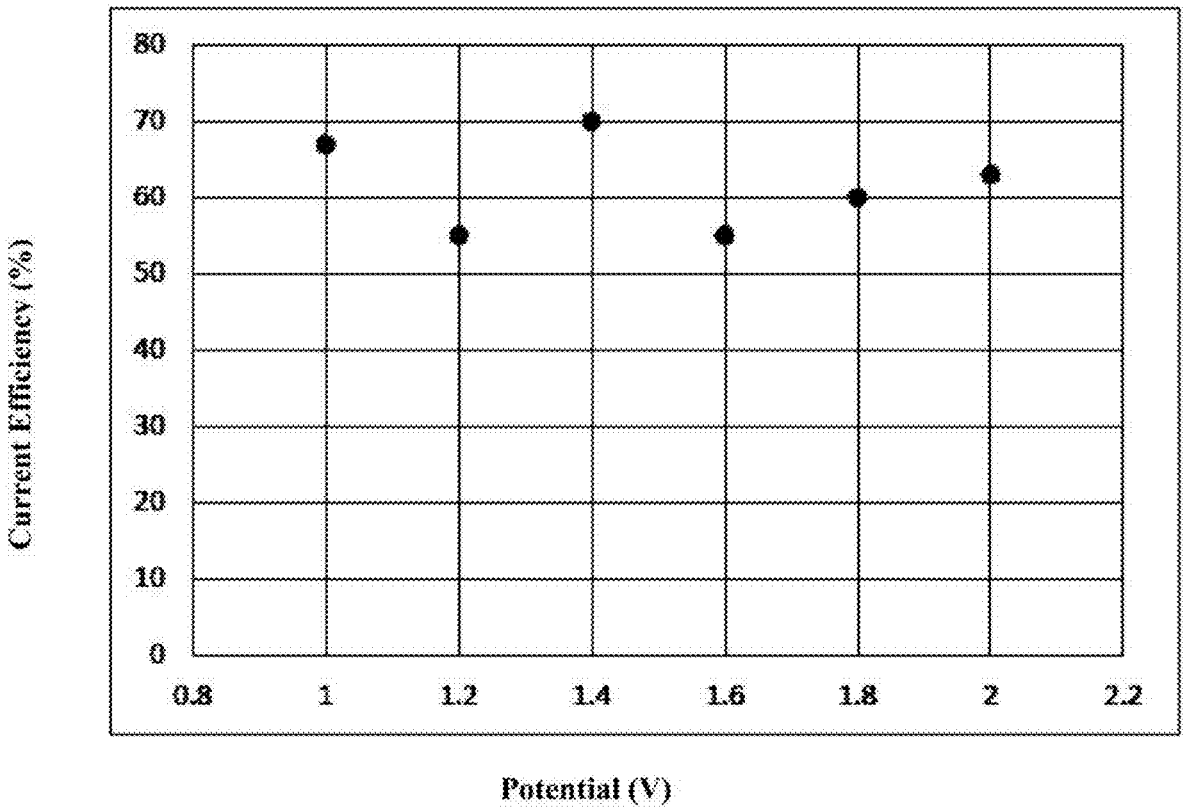
FIG. 21 is a graph reporting the current efficiency versus the varying potentials (V) tested in 1:10 (mol/mol) TEACl/urea ionic liquid with a concentration of 0.3 M $FeCl_3$.
Figure 22A:
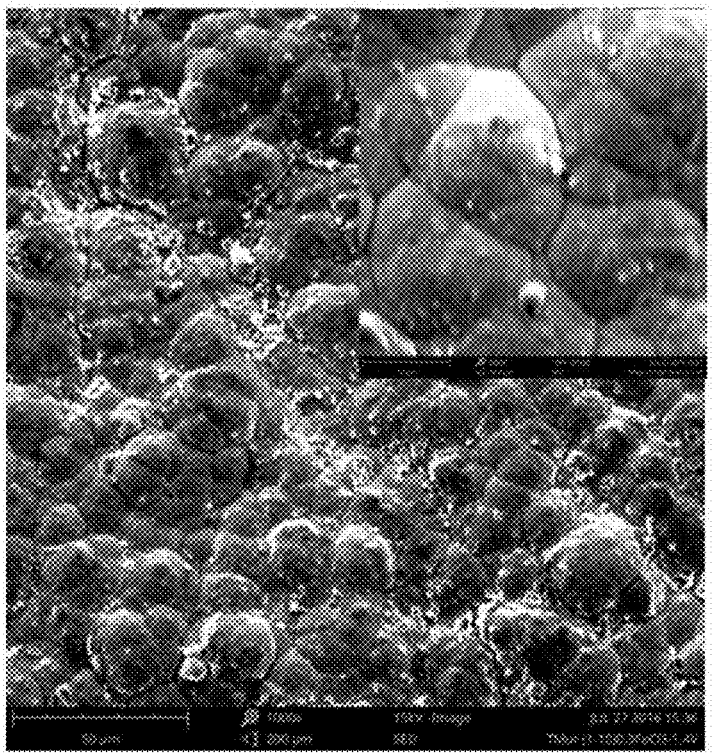
FIGS. 22A-E show scanning electromicrographs of cross-sections of $Fe^0$ deposits formed −1.4 V from 1:10 (mol/mol) TMACl/urea ionic liquid with a concentration of 0.3 M $FeCl_3$.
Figure 22B:
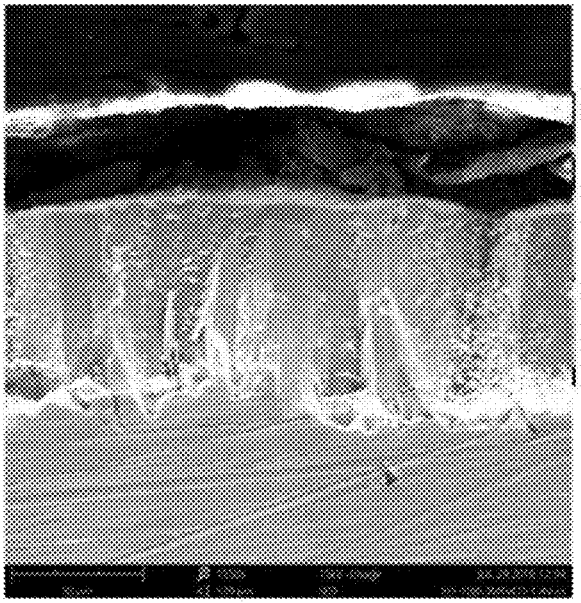
Figure 22C:
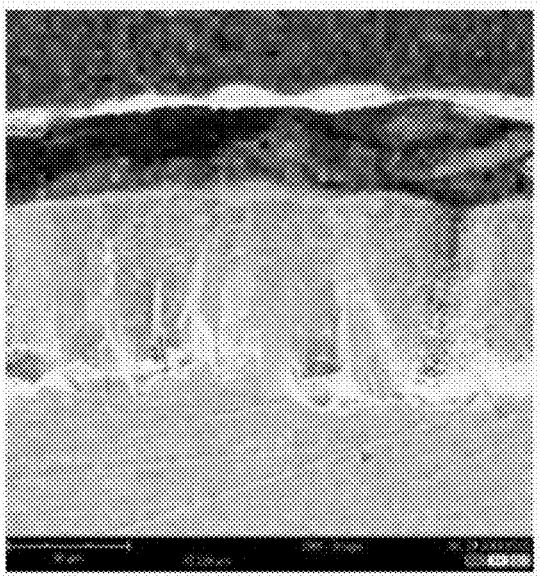
Figure 22D:
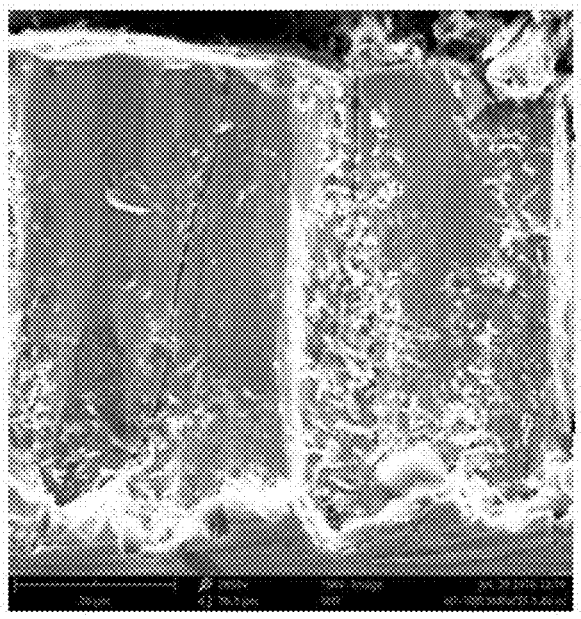
Figure 22E:
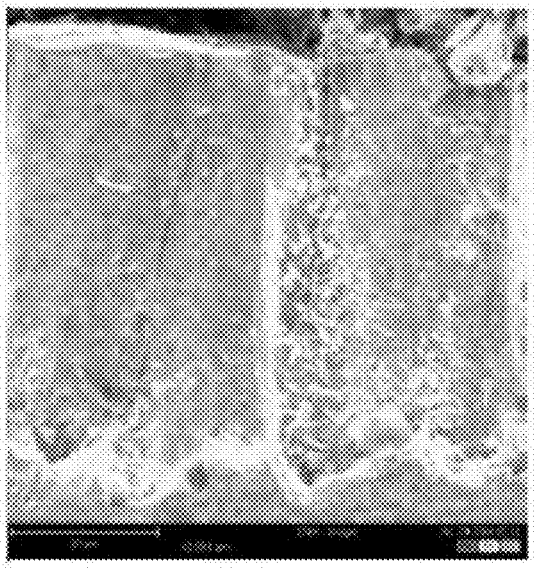

The potentials used for iron deposition were tested from 1:10 (mol/mol) TEACl/urea with 0.3 M $FeCl_3$ on steel substrates: −1.0 V (FIG. 19), −1.2 V (FIGS. 20A&B), −1.4 V (FIGS. 20C&D), −1.6 V (FIGS. 20E&F), −1.8 V (FIGS. 20G&H), −2.0 V (FIGS. 20I&J). The photos (FIGS. 20A, C, E, G, and I) and scanning electron micrographs (FIGS. 19, 20B, D, F, H, and J) indicated that the $Fe^0$ deposits looked very bright, smooth, and dense in TEACl/urea (1:10). The grain size increased as the potential increased, with an average between about 500 nm and about 2 μm. In each case, the surfaces of deposited layers from 1:10 molar ratio ionic liquid were much smoother and conformed to the substrate more than those prepared from the 1:2 ionic liquid. Referring to FIG. 21, the current efficiency with the tested potentials was almost constant, between about 60% and about 70%. Observed variances were likely due to systematic errors. Any texture visible in the photographs is from the substrate itself, and not the deposit.

As seen at FIG. 22, the iron deposits had thicknesses between about 40 μm and about were very dense and lacked the dendritic growth seen in the conventional electrodeposition. These iron deposits adhered well to mild steel. The morphology of iron deposition was denser in TMACl/urea than in TEACl/urea.

Figure 23A:
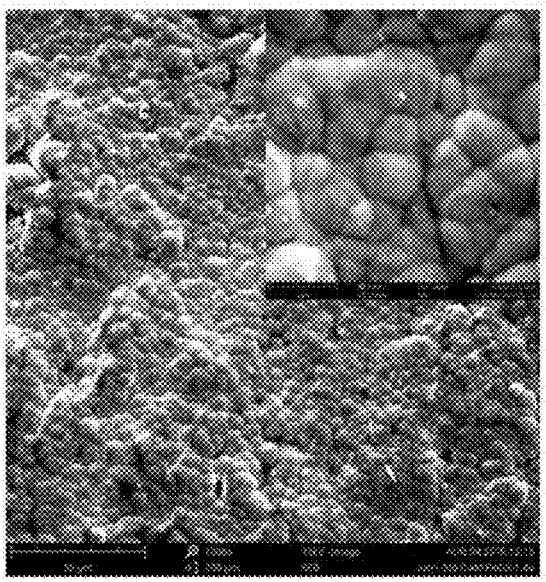
FIGS. 23A&B show a scanning electromicrograph (FIG. 23A) and energy-dispersive spectrometric (EDS) data (FIG. 23B) of an iron deposit formed −1.4 V from 1:30 (mol/mol) TEACl/urea ionic liquid with a concentration of 0.3 M $FeCl_3$.
Figure 23B:
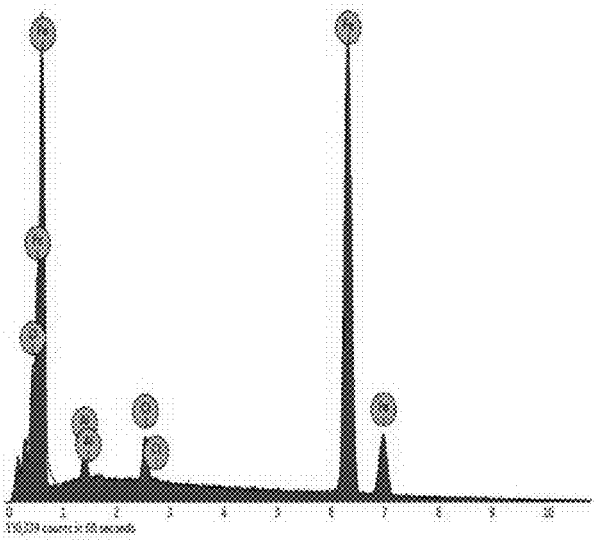

Referring to FIGS. 23A&B, an iron deposit was formed at −1.4 V from 1:30 (mol/mol) TEACl/urea ionic liquid with a concentration of 0.3 M $FeCl_3$. At this ratio, the ionic liquid had a melting point of about 80° C., but significantly more agitation was needed to homogenize the ionic liquid. By comparison, a solution of urea with $FeCl_3$ without TEACl yielded a mixture with an impractically high melting point. The scanning electron micrograph of the iron deposit from 1:30 ionic liquid (FIG. 23A) showed very smooth and dense iron deposit with a small grain size. The energy-dispersive spectrometric (EDS) data (FIG. 23B) were collected over 330,399 counts in 68 seconds. The EDS showed that this deposit was very high purity Fe (92.2%) with 2.0% Cl, 2% C, and 4.4% oxygen, which was likely due to the absorption of oxygen on the surface during atmospheric exposure.

Figure 24A:
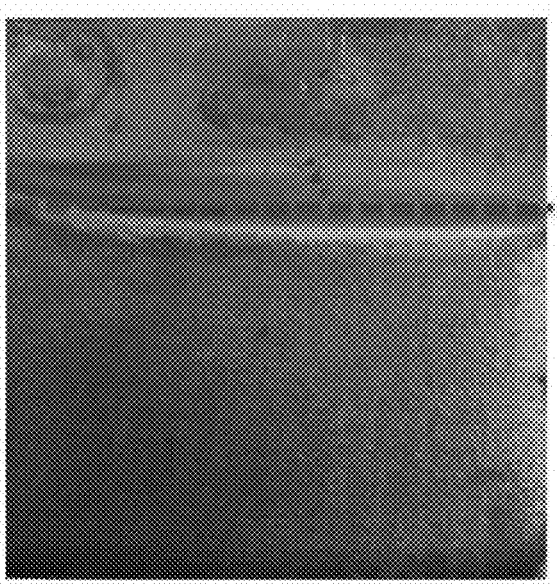
FIG. 24 shows a photo (FIG. 24A), a scanning electromicrograph (FIG. 24B), and energy-dispersive spectrometric data (FIG. 24C) of an iron deposit in formed in 1:20 (mol/nol) TEACl/urea with 1.5 M $FeCl_3$ at 100° C. with a high current density of 100 $mA/cm^2$.
Figure 24B:
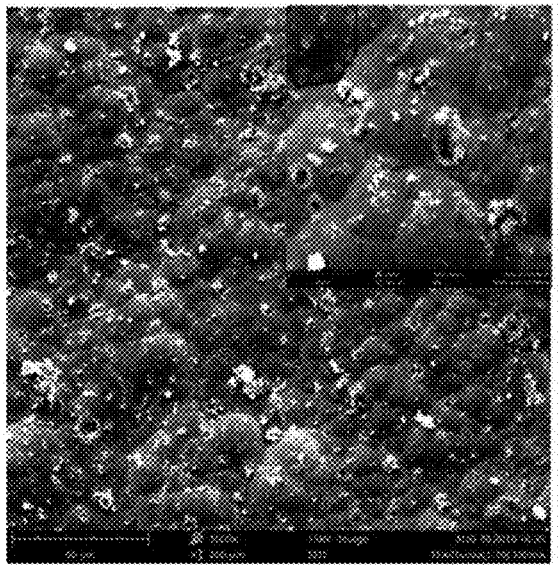
Figure 24C:
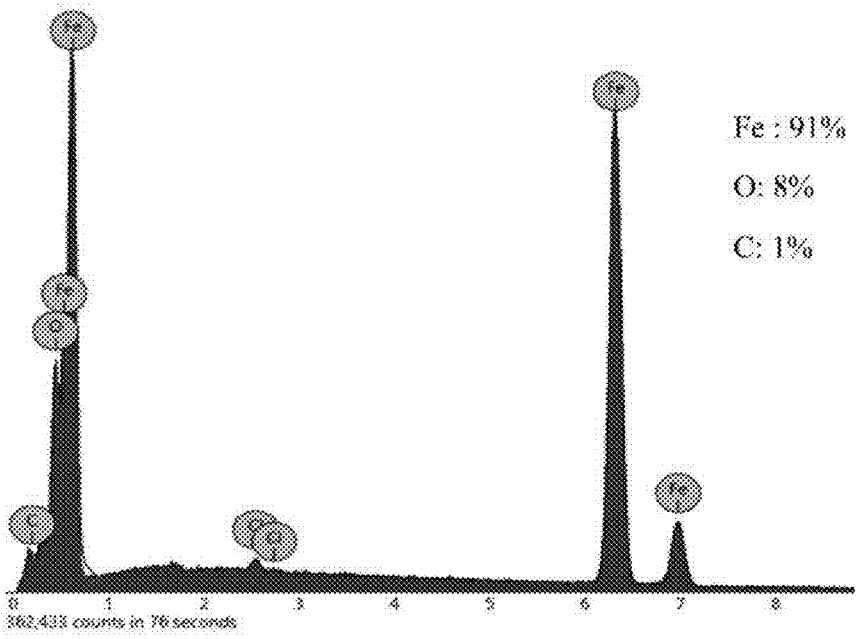
Figure 25A:
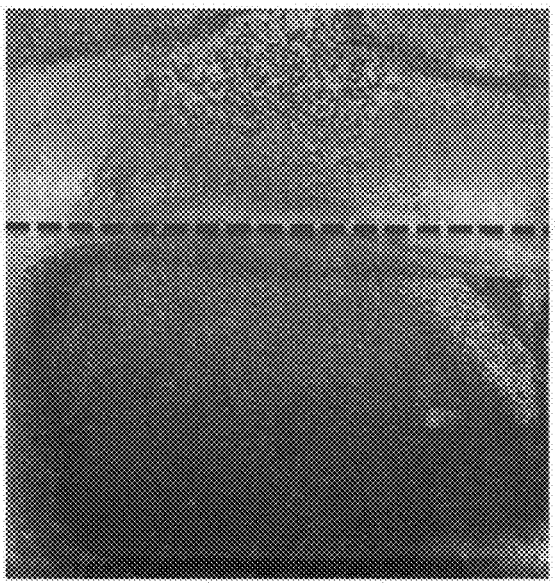
FIG. 25 shows a photo (FIG. 25A), a scanning electromicrograph (FIG. 25B), and energy-dispersive spectrometric data (FIG. 25C) of an iron deposit in formed in 1:20 (mol/nol) TEACl/urea with 1.5 M $FeCl_3$ at 100° C. with a high current density of 300 $mA/cm^2$.
Figure 25B:
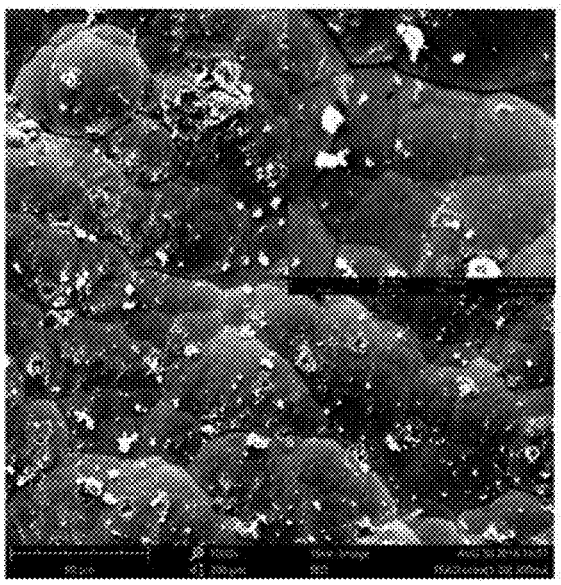
Figure 25C:
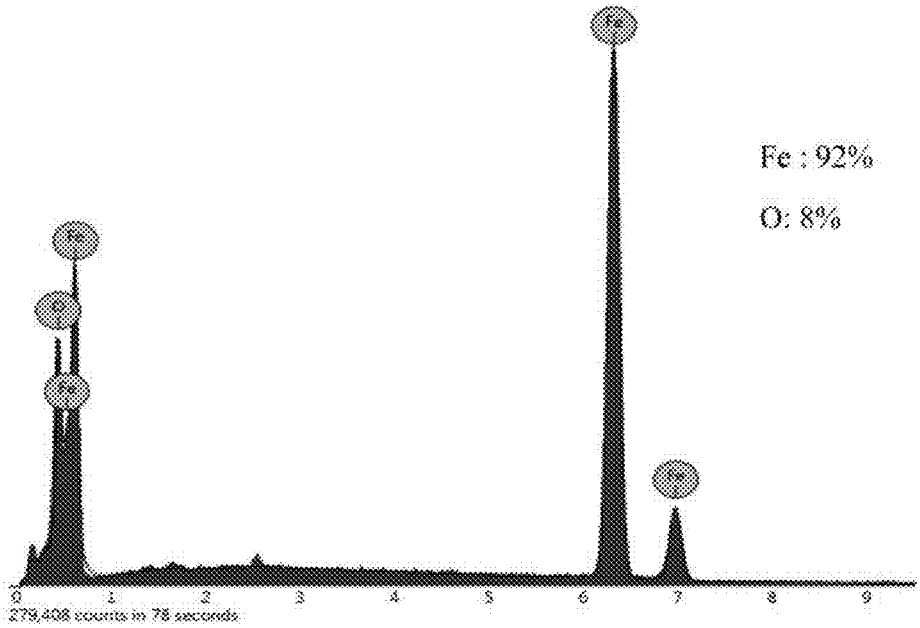
Figure 26A:
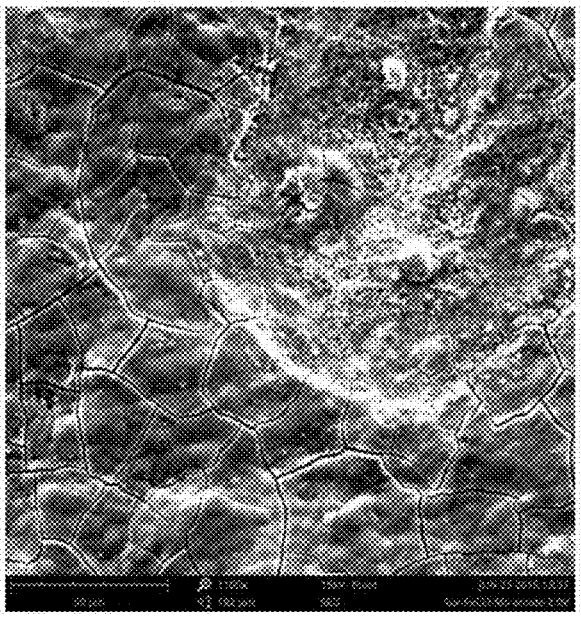
FIGS. 26A-J show grayscale (FIGS. 26A, C, E, G, and I) and color-coded (FIGS. 26B, D, F, H, and J) scanning electromicrographs of metal deposits formed from 1:2 (mol/mol) TMACl/urea, where the metal source was provided in the electrolyzed by stripping pressed metal anodes.
Figure 26B:
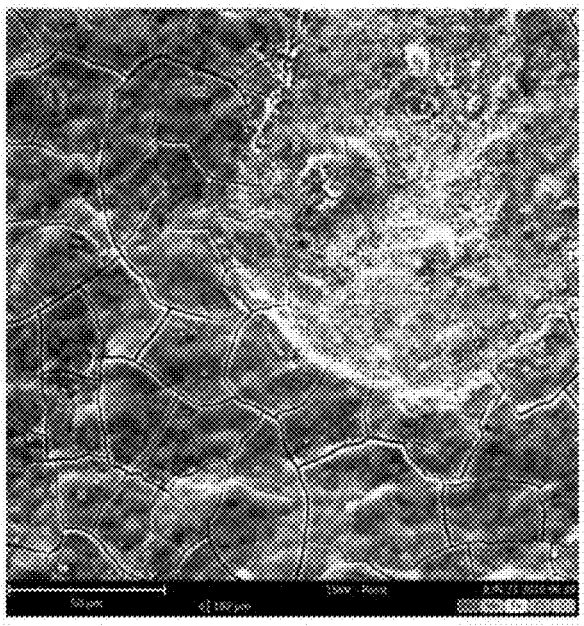
Figure 26C:
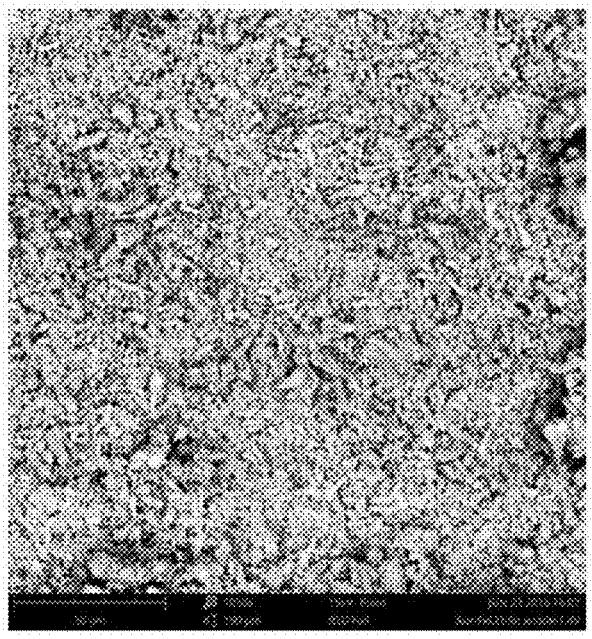
Figure 26D:
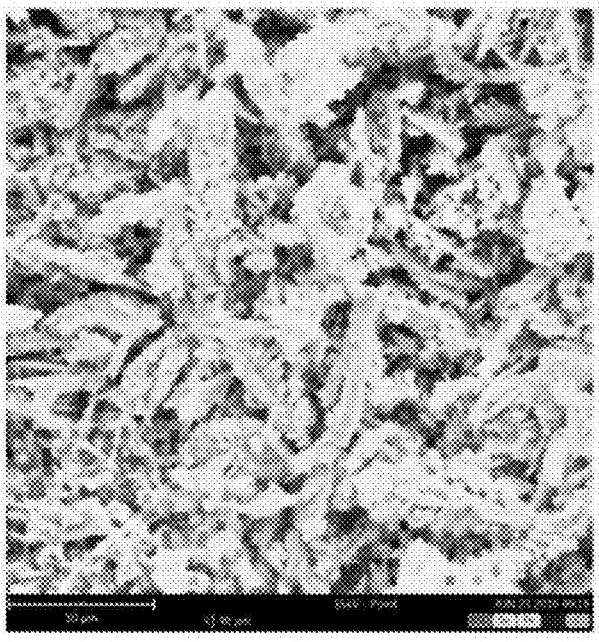
Figure 26E:
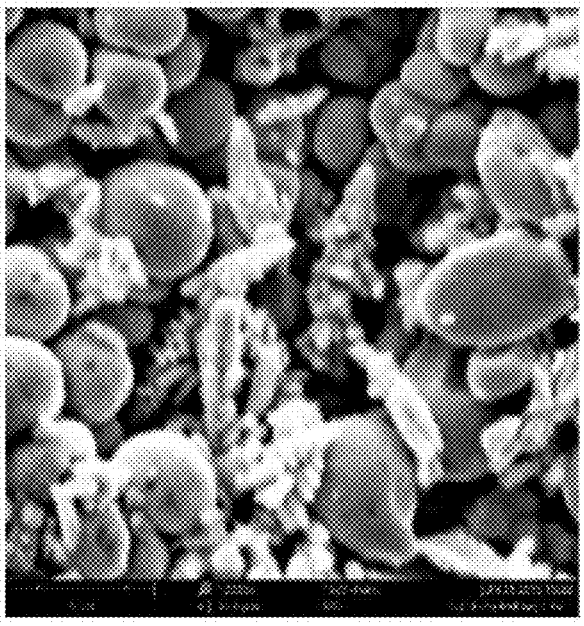
Figure 26F:
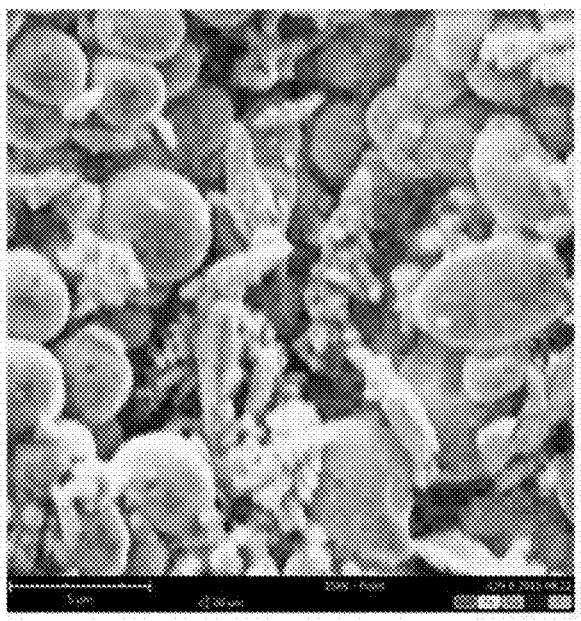
Figure 26G:
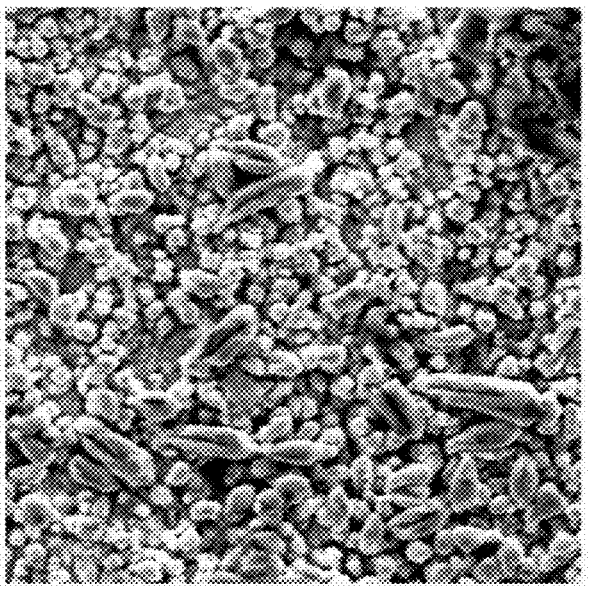
Figure 26H:
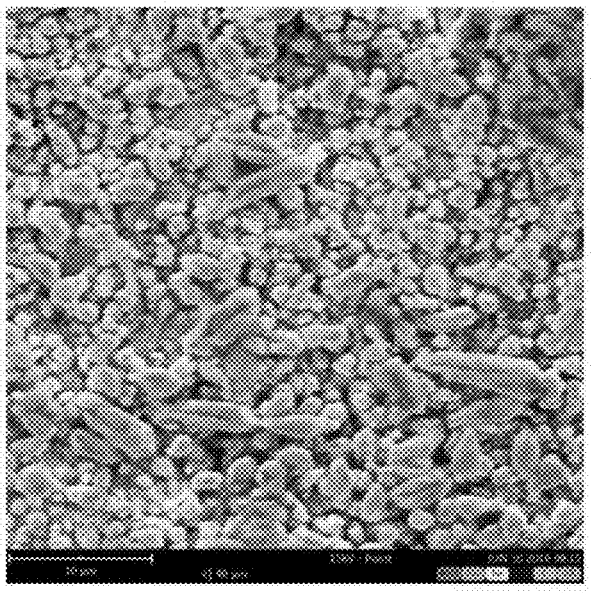
Figure 26I:
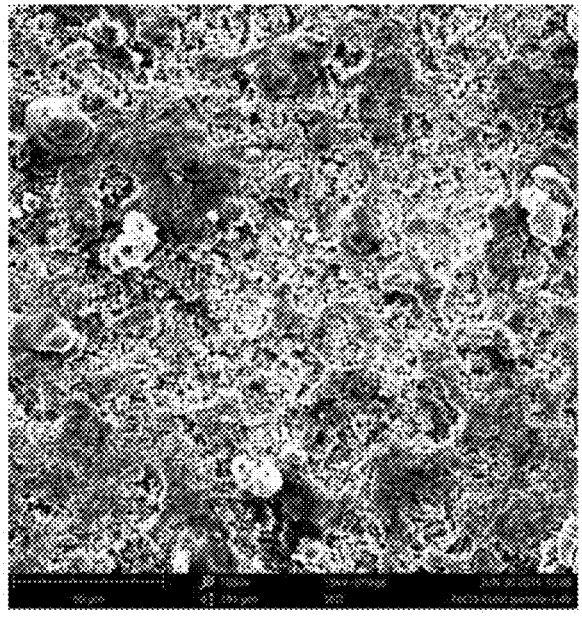
Figure 26J:
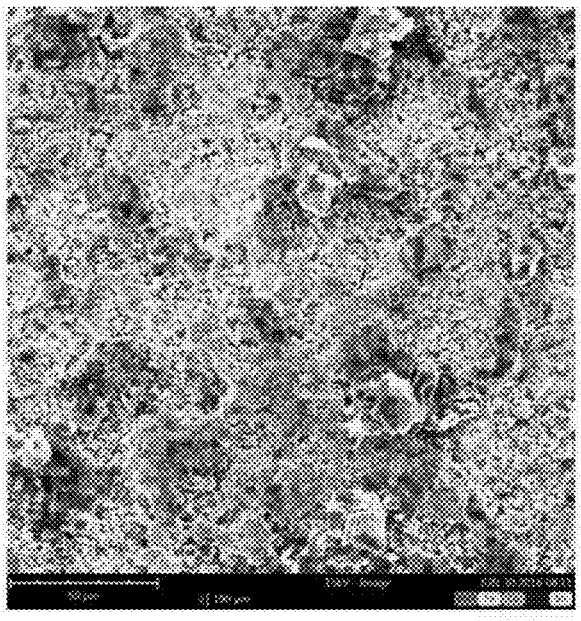

FIG. 24 shows a photo (FIG. 24A), a scanning electromicrograph (FIG. 24B), and energy-dispersive spectrometric data (FIG. 24C) of an iron deposit in formed in 1:20 (mol/nol) TEACl/urea with 1.5 M $FeCl_3$ at 100° C. with a high current density of 100 mA/cm$^2$. The EDS was collected over 362,433 counts in 76 seconds, showing that the metal deposit contained 91% Fe, 8% 0, and 1% Cl. Similarly, FIG. 25 shows a photo (FIG. 25A), a scanning electromicrograph (FIG. 25B), and energy-dispersive spectrometric data (FIG. 25C) of an iron deposit formed under the same conditions but at a current density of 300 mA/cm$^2$. The EDS was collected over 279,408 counts in 78 seconds, showing that the metal deposit contained 92% Fe and 8% O. Adhesion was reasonable in both samples. Oxygen concentration increased by about 3% compared to current densities at 40 mA/cm$^2$ and lower.

Without wishing to be bound by theory, the active species for deposition of iron was the urea-$FeCl_x$ complex. TEA-HCl or TMA-HCl disrupted the crystallization of this complex to allow dissolution at lower temperatures. TEA-HCl added some conductivity to the solution by supplying CF ions, but the biggest impact was due to lowering the solution viscosity to increase ion mobility. Because the conductivity remained high and similar among all ratios tested, most of the charge-carrying species originated from $FeCl_3$.

Higher ratios of urea to trialkylamine generally resulted in deposits of higher density and better adhesion. Again, without wishing to be bound by theory, adhesion between a deposited layer and the substrate might fail due to impurities at the interface, crystalline differences, and the like, resulting in delamination of the deposited material from the substrate. In these deposits, however, growth is highly epitaxial with a nearly homogenous interface, making delamination unlikely. So the next most likely mechanism of failure is stored stresses in the high-density deposit itself, leading to cracks roughly perpendicular to the substrate's surface. Crack propagation eventually causes portions of material to fall off of the substrate. This stress may be relieved while maintaining excellent adhesion (that is, low delamination probability) by using an ionic liquid with a 1:5 molar ratio, or by using a conventional ON/OFF pulsing program during deposition, where Time-ON>>Time OFF.

Example 5—Pressed Anodes May Provide the Metal Source in the Electrolyte

Scanning electron microscopy showed that different metals could be deposited from the 1:2 (mol/mol) TMACl/urea ionic liquid by stripping different metals from a pressed powder anode, the sole provider of metal for these experiments.

The pressed anodes were made from metal powders of varying size distribution were mixed together in a vial at selected ratios and then added to a 13-mm diameter pellet die. The interior of the die was evacuated using a vacuum line. The entire die is placed into a hand-operated press. The die was gradually pressed to a final load of 10 tons and held for about 30 minutes to allow compaction of the powder into a solid shape. Pellets could then be removed from the die with final dimensions of about 13-mm diameter and depth between about 3 mm and about 6 mm.

These pellets were seated in a custom-built polyterfluroroethylene (PTFE) electrode holder. The holder contained a seated cover so that, when in operation, exposed 11 mm of the diameter of the pellet to the electrolyte. A wire ran from electrical contact with the pellet through to the top of the holder. When assembled, the holder was configured to be placed into the electrolyte and operated as an electrode.

FIGS. 26A-J show grayscale (FIGS. 26A, C, E, G, and I) and color-coded (FIGS. 26B, D, F, H, and J) scanning electron micrographs of metal deposits formed from 1:2 (mol/mol) TMACl/urea, where the metal source was provided in the electrolyte by stripping pressed metal anodes: (FIGS. 26A&B) Mo pressed anode, (FIGS. 26C&D) Sn pressed anode, (FIGS. 26E&F), Cu—Fe pressed anode, (FIGS. 26G&H) Cu pressed anode, and (FIGS. 26I&J) Cu—Sn pressed anode.

Example 6—Ionic Liquids Containing Biuret

Figure 27:
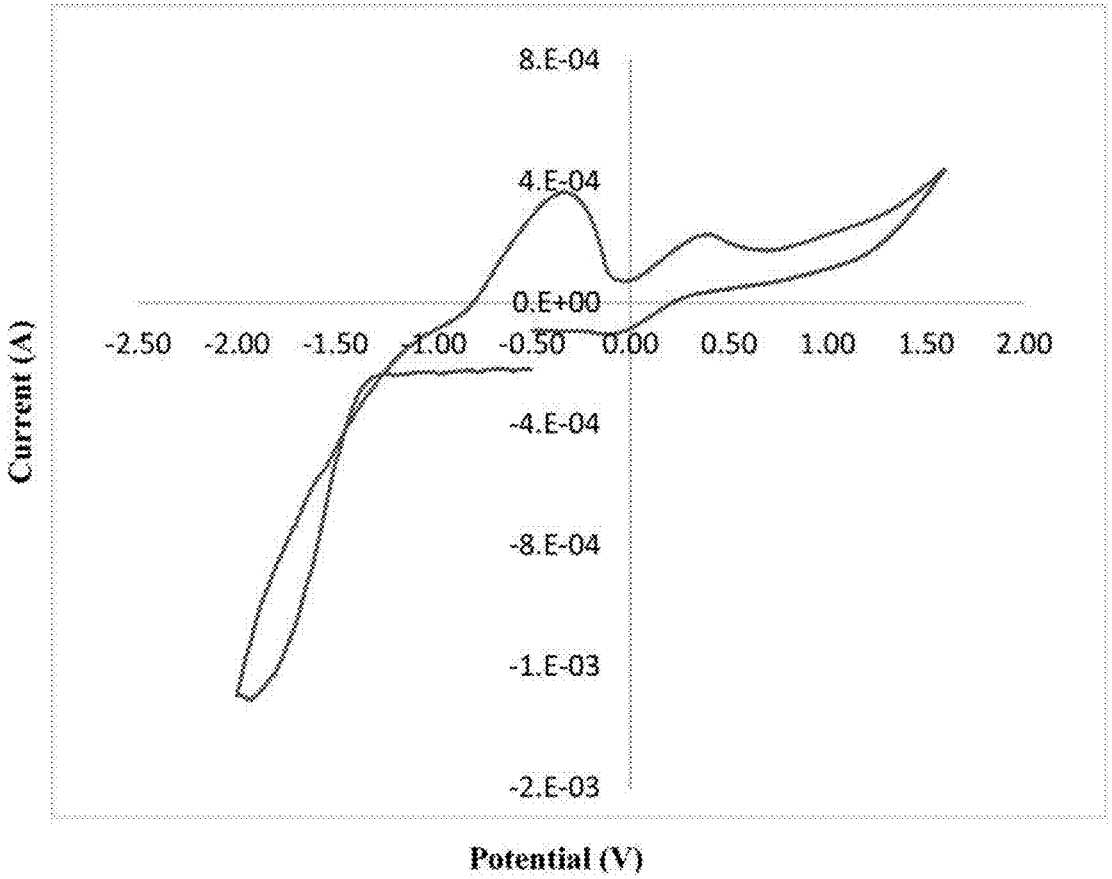
FIG. 27 shows the cyclic voltammogram of 1:2.5 (mol/mol) TEACl/biuret ($C_2H_5N_3O_2$) ionic liquid. Without $FeCl_3$, the melting point is 150° C. With $FeCl_3$, the melting point is 100° C.

Besides urea, other carboxamides of Formula (I) described herein may be used for complexing metals, having similar solution melting points and performance when combined with a trialkylamine and $FeCl_3$. For example, FIG. 27 shows the cyclic voltammogram of 1:2.5 (mol/mol) TEACl/biuret ionic liquid. Without $FeCl_3$, the melting point is 150° C. With $FeCl_3$, the melting point is 100° C.

Example 7—Ionic Liquids Containing Triethanolamine

Figure 28:
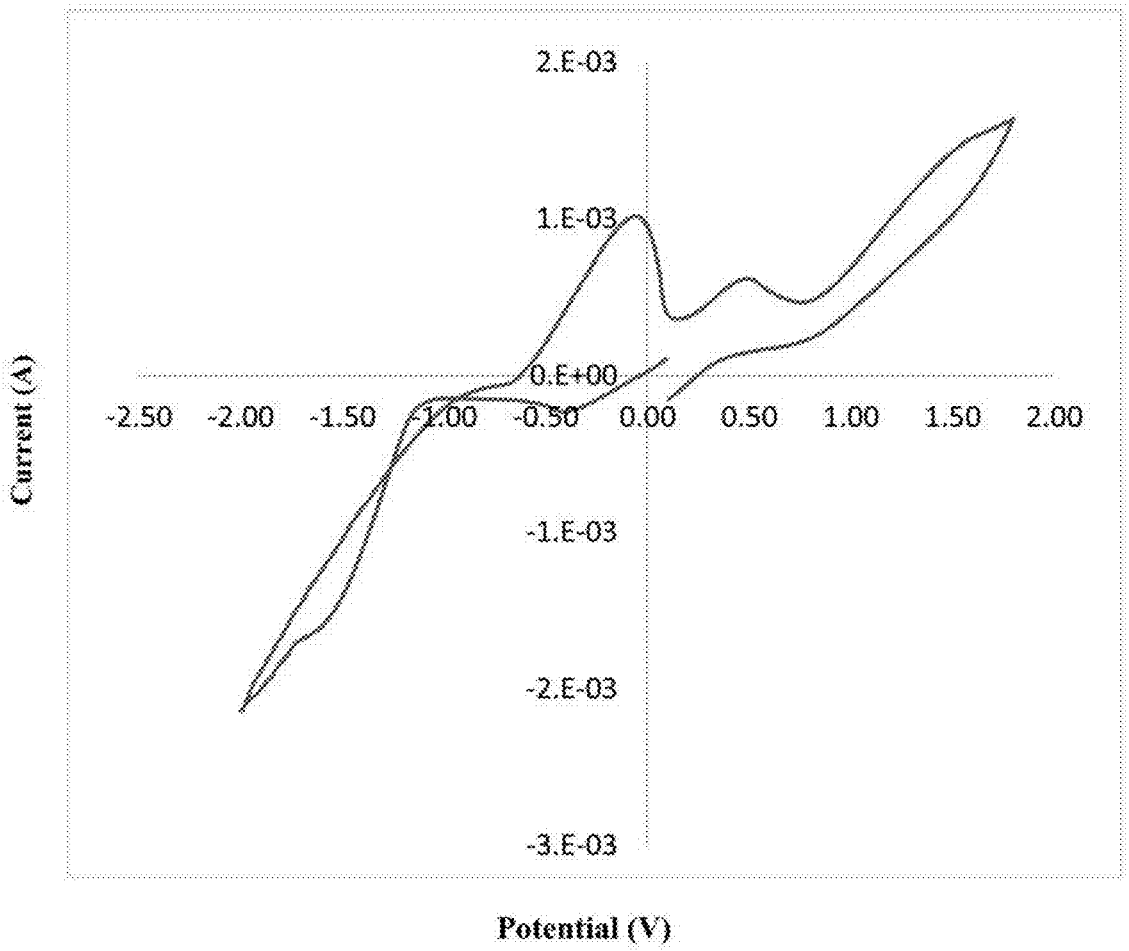
FIG. 28 shows the cyclic voltammogram of 1:2.6 (mol/mol) triethanolamine chloride/urea (1:2.6) With $FeCl_3$ the melting point is 80° C.

FIG. 28 shows the cyclic voltammogram of 1:2.6 (mol/mol) triethanolamine chloride/urea (1:2.6) With $FeCl_3$, the melting point is 80° C. Triethanolamine chloride forms a complex with iron due to its functional groups. Triethanolamine chloride cannot be used with complexing agents that bind iron more strongly than urea because the solution remains solid.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

EXEMPLARY EMBODIMENTS

1. A method comprising:
   inducing a potential between a metal source and a substrate through an electrolyte to deposit metal onto the substrate by causing a metal-metal bond to form between the metal source and metal on the substrate;
   the electrolyte comprising trialkylamine halide, the metal source, and a carboxamide of Formula (I):

(I)

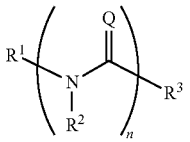

wherein n is 1 to 6;
each Q is independently chosen from O or $NR^4R^5$;
$R^1$ is independently chosen from H or alkyl, and $R^3$ is $NR^4R^5$; or $R^1$ and $R^3$ are taken together to form a ring; and each $R^2$, $R^4$, and $R^5$ is independently chosen from H or alkyl;

the trialkylamine halide and the carboxamide being in molar ratio between 1:1 and 1:30 to form an ionic liquid, and the metal source being at a concentration between about 0.2 and about 1.5 moles per liter of the ionic liquid.

2. The method of claim 1, wherein the potential has a current density between about 10 $mA/cm^3$ and about 300 $mA/cm^3$.

3. The method of claim 2, wherein the current density is about 20 $mA/cm^3$.

4. The method of claims 1-3, wherein the potential has a reducing potential of between about −0.6 V and about −2.2 V.

5. The method of claims 1-4, wherein the carboxamide of Formula (I) comprises a compound of Formula (II):

(II)

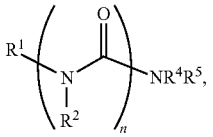

wherein n is 1 to 6;

each Q is independently chosen from O or $NR^4R^5$;

$R^1$, $R^4$, and $R^5$ are independently chosen from H or alkyl; and each $R^2$ is chosen from H or alkyl.

6. The method of claim 5, wherein the carboxamide of Formula (II) comprises a compound of Formula (III):

(III)

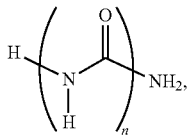

wherein n is 1 to 6.

7. The method of claims 1-4, wherein the carboxamide of Formula (I) comprises a compound of Formula (IV):

(IV)

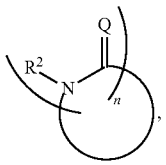

n is 2 to 6;

each Q is independently chosen from O or $NR^4R^5$; and each $R^2$, $R^4$, and $R^5$ is independently chosen from H or alkyl.

8. The method of claim 7, wherein the carboxamide of Formula (IV) comprises a compound of Formula (V):

(V)

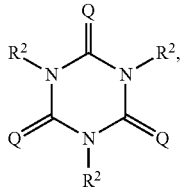

each Q is independently chosen from O or $NR^4R^5$; and each $R^2$, $R^4$, and $R^5$ is independently chosen from H or alkyl.

9. The method of claims 1-4, wherein the carboxamide of Formula (I) is selected from the group consisting of urea, biuret, triuret, tetrauret, pentauret, hexauret, cyanuric acid, ammelide, ammeline, and combinations thereof.

10. The method of claim 9, wherein the carboxamide is urea or biuret.

11. The method of claims 1-10, wherein the trialkylamine halide is optionally substituted with one or more hydroxy groups.

12. The method of claims 1-10, wherein the trialkylamine halide is trimethylamine chloride, triethylamine chloride, triethanolamine, or combinations thereof.

13. The method of claims 1-12, wherein the trialkylamine halide and the carboxamide are in molar ratio of about 1:2.

14. The method of claims 1-12, wherein the trialkylamine halide and the carboxamide are in molar ratio of about 1:10.

15. The method of claims 1-14, wherein the metal source provided by a pressed anode.

16. The method of claim 15, wherein the pressed anode comprises one or more metals selected from the group consisting of Mo, Sn, Fe, and Cu.

17. The method of claims 1-16, wherein the metal source is a metal salt having the formula $MX_y$, wherein M is a metal, X is a halide, and y is an oxidation number of M.

18. The method of claim 17, wherein $MX_y$ is $FeCl_3$.

19. The method of claims 1-18, wherein the concentration of metal source is about 0.3 moles per liter of the ionic liquid.

20. The method of claims 1-19, wherein the electrolyte further comprises tetraethoxysilane.

21. The method of claims 1-20, wherein the electrolyte is substantially non-aqueous.

22. The method of claims 1-21, wherein the electrolyte has a temperature between about 80° C. and about 120° C. when the potential is induced.

23. The method of claims 1-22, wherein the deposited metal has an average grain size between about 0.2 μm and about 3 μm.

24. The method of claims 1-23, wherein the deposited metal contains less than about 1 mol % of each oxygen, carbon, and chlorine.

25. A method comprising:

inducing a potential between a metal salt and a substrate through an electrolyte to deposit metal onto the substrate by causing a metal-metal bond to form between the metal salt and metal on the substrate;

the potential having a current density between about 10 $mA/cm^3$ and about 300 $mA/cm^3$ and a reducing potential of between about −0.6 V and about −2.2 V;

the electrolyte comprising trialkylamine chloride, the metal salt, and a carboxamide of Formula (I):

(I)

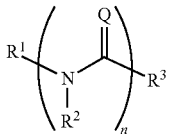

wherein n is 1 to 6;

each Q is independently chosen from O or $NR^4R^5$;

$R^1$ is independently chosen from H or alkyl, and $R^3$ is $NR^4R^5$; or $R^1$ and $R^3$ are taken together to form a ring; and each $R^2$, $R^4$, and $R^5$ is independently chosen from H or alkyl;

the trialkylamine chloride and the carboxamide being in molar ratio between 1:1 and 1:30 to form an ionic liquid, wherein the trialkylamine chloride is trimethylamine chloride, triethylamine chloride, triethanolamine, or combinations thereof; and the metal salt having the formula $MX_y$, wherein M is a metal, X is a halide, and y is an oxidation number of M, the metal salt being in a concentration between about 0.2 and about 1.5 moles per liter of the ionic liquid;

wherein the deposited metal has an average grain size between about 0.2 μm and about 3 μm and contains less than about 1 mol % of each oxygen, carbon, and chlorine.

26. The method of claim 25, wherein the current density is about 20 mA/cm$^3$.

27. The method of claim 25 or 26, wherein the trialkylamine chloride and the carboxamide are in molar ratio of about 1:2.

28. The method of claim 25 or 26, wherein the trialkylamine chloride and the carboxamide are in molar ratio of about 1:10.

29. The method of claims 25-28, wherein M is Fe, X is Cl, and y is 3.

30. The method of claims 25-29, wherein the concentration of metal salt is about 0.3 moles per liter of the ionic liquid.

31. The method of claims 25-30, wherein the electrolyte has a temperature between about 80° C. and about 120° C. when the potential is induced.

32. A metal deposit formed by a method of one of claims 1-31.

33. An iron deposit having an average grain size between about 0.2 μm and about 3 μm and containing less than about 1 mol % of each oxygen, carbon, and chlorine;

the iron deposit being formed on a substrate by inducing a potential between an iron salt and the substrate through an electrolyte to cause a metal-metal bond to form between the iron salt and metal on the substrate;

the electrolyte comprising trialkylamine halide, urea, and the iron salt, the trialkylamine halide and urea being in molar ratio between 1:1 and 1:30 to form an ionic liquid, and the iron salt being at a concentration between about 0.2 and about 1.5 moles per liter of the ionic liquid.

34. The iron deposition of claim 33 with an average grain size between about 0.5 μm and about 2 μm.

35. The iron deposit of claim 33 or 34, wherein the potential has a current density between about 10 mA/cm$^3$ and about 300 mA/cm$^3$.

36. The iron deposit of claim 35, wherein the current density is about 20 mA/cm$^3$.

37. The iron deposit of claims 33-36, wherein the potential has a reducing potential of between about −0.6 V and about −2.2 V.

38. The iron deposit of claims 33-37, wherein the trialkylamine halide is trimethylamine chloride (TMACl), triethylamine chloride (TEACl), or combinations of the two.

39. The iron deposit of claims 33-38, wherein the trialkylamine halide and urea are in molar ratio of about 1:2.

40. The iron deposit of claims 33-39, wherein the trialkylamine halide and urea are in molar ratio of about 1:10.

41. The iron deposit of claims 33-40, wherein the iron salt has the formula $MX_y$, wherein M is Fe, X is a halide, and y is an oxidation number of M.

42. The iron deposit of claim 41, wherein $MX_y$ is $FeCl_3$.

43. The iron deposit of claims 33-42, wherein the concentration of iron salt is about 0.3 moles per liter of the ionic liquid.

44. The iron deposit of claims 33-43, wherein the electrolyte further comprises tetraethoxysilane.

45. The iron deposit of claims 33-44, wherein the electrolyte is substantially non-aqueous.

46. The iron deposit of claims 33-45, wherein the electrolyte has a temperature between about 80° C. and about 120° C. when the potential is induced.

47. A composition for forming an iron deposit on a substrate, the composition consisting essentially of a carboxamide, trialkylamine chloride, and a metal salt;

the carboxamide comprising Formula (I):

(I)

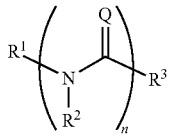

wherein n is 1 to 6;

each Q is independently chosen from O or $NR^4R^5$;

$R^1$ is independently chosen from H or alkyl, and $R^3$ is $NR^4R^5$; or $R^1$ and $R^3$ are taken together to form a ring; and each $R^2$, $R^4$, and $R^5$ is independently chosen from H or alkyl;

the trialkylamine chloride and the carboxamide being in molar ratio between 1:1 and 1:30 to form an ionic liquid, wherein the trialkylamine chloride is trimethylamine chloride (TMACl), triethylamine chloride (TEACl), or combinations of the two; and the metal salt having the formula $MX_y$, wherein M is a metal, X is a halide, and y is an oxidation number of M, the metal salt being in a concentration between about 0.2 and about 1.5 moles per liter of the ionic liquid;

wherein the iron deposit has an average grain size between about 0.2 μm and about 3 μm and contains less than about 1 mol % of each oxygen, carbon, and chlorine.

48. The composition of claim 47, wherein the carboxamide of Formula (I) comprises a compound of Formula (II):

(II)

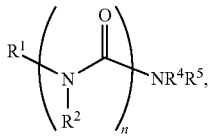

wherein n is 1 to 6;

each Q is independently chosen from O or $NR^4R^5$;

$R^1$, $R^4$, and $R^5$ are independently chosen from H or alkyl; and each $R^2$ is chosen from H or alkyl.

49. The composition of claim 48, wherein the carboxamide of Formula (II) comprises a compound of Formula (III):

(III)

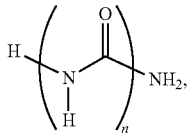

wherein n is 1 to 6.

50. The composition of claim 47, wherein the carboxamide of Formula (I) comprises a compound of Formula (IV):

(IV)

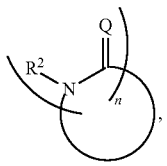

n is 2 to 6;

each Q is independently chosen from O or $NR^4R^5$; and each $R^2$, $R^4$, and $R^5$ is independently chosen from H or alkyl.

51. The composition of claim 50, wherein the carboxamide of Formula (IV) comprises a compound of Formula (V):

(V)

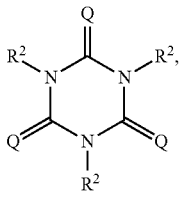

each Q is independently chosen from O or $NR^4R^5$; and each $R^2$, $R^4$, and $R^5$ is independently chosen from H or alkyl.

52. The composition of claim 47, wherein the carboxamide of Formula (I) is selected from the group consisting of urea, biuret, triuret, tetrauret, pentauret, hexauret, cyanuric acid, ammelide, ammeline, and combinations thereof.

53. The composition of claim 52, wherein the carboxamide is urea or biuret.

54. The composition of claims 47-53, wherein the trialkylamine chloride and the carboxamide are in molar ratio of about 1:2.

55. The composition of claims 47-53, wherein the trialkylamine chloride and the carboxamide are in molar ratio of about 1:10.

56. The composition of claims 47-55, wherein M is Fe.

57. The composition of claims 47-56, wherein X is Cl.

58. The composition of claims 47-57, wherein y is 3.

59. The composition of claims 47-58, wherein the metal salt is $FeCl_3$.

60. The composition of claims 47-59, wherein the concentration of metal salt is about 0.3 moles per liter of the ionic liquid.

What is claimed is:

1. A method of forming a metal deposit on a substrate, the method comprising:

forming a metal deposit on a substrate from an electrolyte composition, the electrolyte composition comprising a carboxamide, a trialkylamine hydrochloride, and a metal salt;

the metal deposit being formed on the substrate by inducing a potential between the metal salt and the substrate through the electrolyte composition to cause a metal-metal bond to form between the metal salt and the substrate;

the carboxamide comprising Formula (I):

(I)

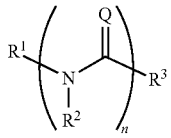

wherein n is 1 to 6;

each Q is O;

$R^1$ is independently chosen from H or alkyl, and $R^3$ is $NR^4R^5$; or $R^1$ and $R^3$ are taken together to form a ring; and each $R^2$, $R^4$, and $R^5$ is independently chosen from H or alkyl;

the trialkylamine hydrochloride being selected from the group consisting of trimethylamine hydrochloride (TMA-HCl), triethylamine hydrochloride (TEA-HCl), triethanolamine hydrochloride, and combinations thereof; and the metal salt having a formula $MX_y$, wherein M is a metal, X is a halide, and y is an oxidation number of M;

wherein the trialkylamine hydrochloride and the carboxamide are present in the electrolyte composition in molar ratio between 1:3 and 1:30 to form an ionic liquid, and the metal salt is present in the electrolyte composition in a concentration between 0.2 and 1.5 moles per liter of the ionic liquid; and wherein the metal deposit is formed on the substrate from the electrolyte composition such that the metal deposit has an average grain size between 0.2 μm and 3 μm and contains less than 1 mol % of each oxygen, carbon, and chlorine.

2. The method of claim 1, wherein the carboxamide of Formula (I) comprises a compound of Formula (II):

(II)

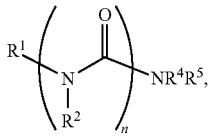

wherein n is 1 to 6;

$R^1$, $R^4$, and $R^5$ are independently chosen from H or alkyl; and each $R^2$ is chosen from H or alkyl.

3. The method of claim 2, wherein the carboxamide of Formula (II) comprises a compound of Formula (III):

(III)

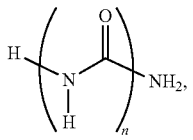

wherein n is 1 to 6.

4. The method of claim 1, wherein the carboxamide of Formula (I) comprises a compound of Formula (IV):

(IV)

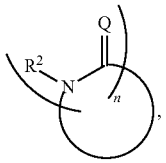

n is 2 to 6;

each Q is O; and each $R^2$, $R^4$, and $R^5$ is independently chosen from H or alkyl.

5. The method of claim 4, wherein the carboxamide of Formula (IV) comprises a compound of Formula (V):

(V)

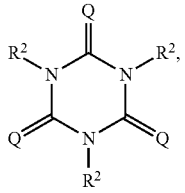

each Q is O; and each $R^2$, $R^4$, and $R^5$ is independently chosen from H or alkyl.

6. The method of claim 1, wherein the carboxamide of Formula (I) is selected from the group consisting of urea, biuret, triuret, tetrauret, pentauret, hexauret, cyanuric acid, ammelide, ammeline, and combinations thereof.

7. The method of claim 6, wherein the carboxamide is urea or biuret.

8. The method of claim 1, wherein the trialkylamine hydrochloride and the carboxamide are in molar ratio of 1:5.

9. The method of claim 1, wherein the trialkylamine hydrochloride and the carboxamide are in molar ratio of 1:10.

10. The method of claim 1, wherein the concentration of metal salt is 0.3 moles per liter of the ionic liquid.

11. The method of claim 1, wherein M is Fe.

12. The method of claim 1, wherein X is Cl.

13. The method of claim 1, wherein y is 3.

14. The method of claim 1, wherein the metal deposit is an iron deposit.

15. The method of claim 1, wherein M is Fe, X is Cl, and y is 3, and the metal deposit is an iron deposit.

16. The method of claim 1, wherein the potential has a current density between 10 $mA/cm^3$ and 300 $mA/cm^3$.

17. The method of claim 1, wherein the potential has a reducing potential of between −0.6 V and −2.2 V.

18. The method of claim 1, wherein the concentration of metal salt is 0.3 moles per liter of the ionic liquid.

* * * * *